US009154896B2

(12) United States Patent
Mahabub et al.

(10) Patent No.: US 9,154,896 B2
(45) Date of Patent: Oct. 6, 2015

(54) AUDIO SPATIALIZATION AND ENVIRONMENT SIMULATION

(75) Inventors: Jerry Mahabub, Broomfield, CO (US); Stephan A. Bernsee, Mainz (DE); Gary Smith, Castle Rock, CO (US)

(73) Assignee: GenAudio, Inc., Centennial, CO (US)

( * ) Notice: Subject to any disclaimer, the term of this patent is extended or adjusted under 35 U.S.C. 154(b) by 463 days.

(21) Appl. No.: 13/332,699

(22) Filed: Dec. 21, 2011

(65) Prior Publication Data

US 2012/0213375 A1 Aug. 23, 2012

Related U.S. Application Data

(60) Provisional application No. 61/426,210, filed on Dec. 22, 2010.

(51) Int. Cl.

| | |
|---|---|
| ***H04R 5/00*** | (2006.01) |
| ***H04S 5/00*** | (2006.01) |
| *H04S 3/00* | (2006.01) |
| *H04S 1/00* | (2006.01) |

(52) U.S. Cl.

CPC ..... *H04S 5/00* (2013.01); *H04R 2499/13* (2013.01); *H04S 1/00* (2013.01); *H04S 3/00* (2013.01); *H04S 2400/03* (2013.01); *H04S 2420/01* (2013.01)

(58) Field of Classification Search

CPC ..... H04R 3/12; H04R 5/00; H04R 5/02; H04R 5/033; H04R 5/04; H04R 31/006; H04R 2201/34; H04R 2201/401; H04R 2201/403; H04R 2201/405; H04R 2203/00; H04R 2203/12; H04R 2205/022; H04R 2205/024; H04R 2205/026; H04R 2205/041; H04R 2227/005; H04R 2227/007; H04R 2227/009; H04R 2420/01; H04R 2420/03; H04R 2420/05; H04R 2420/07; H04R 2430/03; H04R 2430/20; H04R 2460/07; H04S 7/00; H04S 7/30; H04S 7/40; H04S 2400/01; H04S 2400/03; H04S 2400/05; H04S 2400/07; H04S 2400/09; H04S 2400/11; H04S 2420/01; H04S 2420/03; H04S 2420/05; H04S 2420/07; H04S 2420/11; H04S 2420/13

USPC ..... 381/1, 2, 10, 17, 18, 19, 20, 21, 22, 23, 381/77, 80, 81, 85, 300, 303, 304, 305, 307, 381/309, 310, 61, 332, 103, 119; 700/94

See application file for complete search history.

(56) References Cited

U.S. PATENT DOCUMENTS

| | | | | |
|---|---|---|---|---|
| 3,969,682 | A * | 7/1976 | Rossum | 330/85 |
| 4,905,283 | A * | 2/1990 | Ishikawa et al. | 381/22 |

(Continued)

FOREIGN PATENT DOCUMENTS

| | | | |
|---|---|---|---|
| EP | 0615399 | A1 | 9/1994 |
| JP | H11-032398 | A | 2/1999 |

(Continued)

OTHER PUBLICATIONS

PCT International Search Report and Written Opinion dated Sep. 24, 2012, PCT Application No. PCT/US2011/066623, 8 pages.

(Continued)

*Primary Examiner* — Leshui Zhang
(74) *Attorney, Agent, or Firm* — Polsinelli PC

(57) ABSTRACT

Methods and apparatus are disclosed for processing an audio sound source to create four-dimensional spatialized sound. A virtual sound source may be moved along a path in three-dimensional space over a specified time period to achieve four-dimensional sound localization. The various embodiments described herein provide methods and systems for converting existing mono, 2-channel and/or multi-channel audio signals into spatialized audio signals have two or more audio channels. The incoming audio signals may be down-mixed, up-mixed or otherwise translated into fewer, greater or the same number of audio channels. The various embodiments also describe methods, systems and apparatus for generating low frequency effect and center channel signals from incoming audio signals having one or more channels.

35 Claims, 39 Drawing Sheets

(56) References Cited

U.S. PATENT DOCUMENTS

| | | | | |
|---|---|---|---|---|
| 5,572,591 | A * | 11/1996 | Numazu et al. | 381/1 |
| 5,857,026 | A * | 1/1999 | Scheiber | 381/23 |
| 7,764,802 | B2 * | 7/2010 | Oliver | 381/103 |
| 2008/0273721 | A1 * | 11/2008 | Walsh | 381/300 |
| 2009/0046864 | A1 * | 2/2009 | Mahabub et al. | 381/17 |
| 2009/0122994 | A1 | 5/2009 | Ohta et al. | |
| 2010/0222904 | A1 * | 9/2010 | Yamashita et al. | 700/94 |

FOREIGN PATENT DOCUMENTS

| | | | |
|---|---|---|---|
| JP | 2009-532985 | A | 9/2009 |
| JP | 2010-520671 | A | 6/2010 |
| JP | 2012-506673 | A | 3/2012 |
| WO | 2006/070782 | A1 | 7/2006 |
| WO | 2008/065731 | A1 | 6/2008 |

OTHER PUBLICATIONS

Taiwan Search Report (with English Translation) dated Apr. 14, 2014 for Taiwan Application No. 100147818, 22 pages.

Japanese Notice of Reasons for Rejection (with English Translation) dated Aug. 1, 2014 for Japanese Application No. 2013-546391, 8 pages.

* cited by examiner

AUDIO SPATIALIZATION AND ENVIRONMENT SIMULATION

CROSS-REFERENCE TO RELATED APPLICATIONS

This application is related to co-pending U.S. Non-Provisional application Ser. No. 12/582,449, entitled "Audio Spatialization and Environment Simulation," which was filed on Oct. 21, 2009 in the name of inventors Jerry Mahubub, et al., the disclosure and entire contents of which is incorporated by reference herein in its entirety. The present application is also related to co-pending U.S. Non-Provisional application Ser. No. 12/041,191, entitled "Audio Spatialization and Environment Simulation," which was filed on Mar. 3, 2008 in the name of inventors Jerry Mahubub, et al., the disclosure and entire contents of which are incorporated herein by reference in its entirety. The present application also is related to and claims priority to co-pending U.S. Provisional Application Ser. No. 61/426,210, entitled "Audio Spatialization and Environment Stimulation," which was filed on Dec. 22, 2010 in the name inventors Jerry Mahubub et al., the disclosure and entire contents of which are incorporated herein by reference in its entirety.

BACKGROUND OF THE INVENTION

1. Technical Field

This disclosure relates generally to sound engineering, and more specifically to digital signal processing methods and apparatuses for calculating and creating an audio waveform, which, when played through headphones, speakers, or another playback device, emulates at least one sound emanating from at least one spatial coordinate in four-dimensional space.

2. Background Art

Sounds emanate from various points in four-dimensional space. Humans hearing these sounds may employ a variety of aural cues to determine the spatial point from which the sounds originate. For example, the human brain quickly and effectively processes sound localization cues such as inter-aural time delays (i.e., the delay in time between a sound impacting each eardrum), sound pressure level differences between a listener's ears, phase shifts in the perception of a sound impacting the left and right ears, and so on to accurately identify the sound's origination point. Generally, "sound localization cues" refers to time and/or level differences between a listener's ears, time and/or level differences in the sound waves, as well as spectral information for an audio waveform. ("Four-dimensional space," as used herein, generally refers to a three-dimensional space across time, or a three-dimensional coordinate displacement as a function of time, and/or parametrically defined curves. A four-dimensional space is typically defined using a 4-space coordinate or position vector, for example $\{x, y, z, t\}$ in a rectangular system, $\{r, \theta, \phi, t,\}$ in a spherical system, and so on.)

The effectiveness of the human brain and auditory system in triangulating a sound's origin presents special challenges to audio engineers and others attempting to replicate and spatialize sound for playback across two or more speakers. Generally, past approaches have employed sophisticated pre- and post-processing of sounds, and may require specialized hardware such as decoder boards or logic. Good examples of currently known encoding and compression technologies include Dolby Labs' DOLBY Digital processing, DTS, Sony's SDDS format, and so forth. Good examples of currently known audio spatialization technologies t include QSound Labs, Inc.'s QSOUND Q3D Positional 3D Audio, Wave Arts, Inc.'s PANORAMA 5, and Arkamys, Inc.'s 3DSOUND. While these approaches have achieved some degree of success, they are cost- and labor-intensive. Further, playback of processed audio typically requires relatively expensive audio components. Additionally, these approaches may not be suited for all types of audio, or all audio applications.

Accordingly, a novel approach to audio spatialization is needed, that places the listener in the center of a virtual sphere (or simulated virtual environment of any shape or size) of stationary and moving sound sources to provide a true-to-life sound experience from as few as two speakers or headphones.

BRIEF SUMMARY OF THE INVENTION

Generally, one embodiment of the present disclosure takes the form of a method and apparatus for creating four-dimensional spatialized sound. In a broad aspect, an exemplary method for creating a spatialized sound by spatializing an audio waveform includes the operations of determining a spatial point in a spherical or Cartesian coordinate system, and applying an impulse response filter corresponding to the spatial point to a first segment of the audio waveform to yield a spatialized waveform. The spatialized waveform emulates the audio characteristics of the non-spatialized waveform emanating from the spatial point. That is, the phase, amplitude, inter-aural time delay, and so forth are such that, when the spatialized waveform is played from a pair of speakers, the sound appears to emanate from the chosen spatial point instead of the speakers.

A head-related transfer function is a model of acoustic properties for a given spatial point, taking into account various boundary conditions. In the present embodiment, the head-related transfer function is calculated in a spherical coordinate system for the given spatial point. By using spherical coordinates, a more precise transfer function (and thus a more precise impulse response filter) may be created. This, in turn, permits more accurate audio spatialization.

As can be appreciated, the present embodiment may employ multiple head-related transfer functions, and thus multiple impulse response filters, to spatialize audio for a variety of spatial points. (As used herein, the terms "spatial point" and "spatial coordinate" are interchangeable.) Thus, the present embodiment may cause an audio waveform to emulate a variety of acoustic characteristics, thus seemingly emanating from different spatial points at different times. In order to provide a smooth transition between two spatial points and therefore a smooth four-dimensional audio experience, various spatialized waveforms may be convolved with one another through an interpolation process.

It should be noted that no specialized hardware or additional software, such as decoder boards or applications, or stereo equipment employing DOLBY or DTS processing equipment, is required to achieve full spatialization of audio in the present embodiment. Rather, the spatialized audio waveforms may be played by any audio system having two or more speakers, with or without logic processing or decoding, and a full range of four-dimensional spatialization achieved.

In one embodiment, a method of producing a localized stereo output audio signal from one or more received input audio signals, wherein each audio signal is associated with a corresponding audio channel is described. In this embodiment, a processor may be configured for receiving at least one channel of an input audio signal; processing the at least one channel of an input audio signal to produce two or more localized channel output audio signals; and mixing each of the two or more localized channel output audio signals to generate a localized stereo output audio signal having at least two channels. Further, the input audio signal may be received in a sequence of two or more packets, with each packet having a fixed frame length. The input audio signal may be a mono channel input audio signal. A localized stereo output audio signal may include two or more output channels.

In at least one embodiment, at least one channel of an input audio signal may be processed to produce two or more localized channel output audio signals. Additionally and/or alternatively, each received channel of the input audio signal may be processed utilizing one or more DSP parameters. The DSP parameters utilized may be associated, for example, with an azimuth specified for use with at least one of two or more localized audio signals. Further, an azimuth may be specified based upon a selection of a bypass mode and the specified azimuth may be utilized by a digital signal processor to identify a filter to apply to an input audio signal, such as a mono channel audio signal. The filter may utilize a finite impulse response filter, an infinite impulse response filter or another form of filter.

In at least one embodiment, at least one channel of an input audio signal may be processed by using at least one of a low pass filter and a low pass signal enhancer. Also, each of two or more localized channel output audio signals may processed to adjust at least one of a reverb, a gain, a parametric equalization or other setting. Further, when two or more localized channel output audio signals are processed, one or more matched pairs of corresponding output channels may be selected. Such matched pairs may be selected from groups of channels such as front channels, side channels, rear channels, and surround channels.

In at least one embodiment, a method of producing a localized stereo output audio signal from one or more received input audio signals may also include identifying one or more DSP parameters. Such DSP parameters may be stored in a storage medium accessible to a digital signal processor.

In at least one embodiment, a method of producing a localized stereo output audio signal from one or more received input audio signals may be utilized with an input audio signal that includes N.M channels, wherein N is an integer >1 and M is an integer, of input audio signals and a localized stereo output audio signal includes at least two channels. Further, an identification may occur or be received of a desired output channel configuration that includes Q.R channels wherein Q is an integer >1 and R is an integer. Further, the input audio signals may be processed to generate localized stereo output audio signal to include each of the Q.R channels. It is to be appreciated that Q can be greater than N, less than N or equal to N. Similarly, either, one or both of M and R can equal the number one.

In at least one embodiment, a method of producing a localized stereo output audio signal from one or more received input audio signals may also include a selection of a bypass configuration for a pair of corresponding input channels. The input channels may be selected from corresponding pairs of front channels and corresponding pairs of rear channels of the N channels of input audio signals. Further, the selection of a bypass configuration for at least one channel selected from corresponding pairs of front channels and corresponding pairs of rear channels of the N channels of input audio signals may also include the specifying of an azimuth for each of the selected corresponding pairs of input channels. It is to be appreciated that each azimuth may be specified based upon a relationship of a virtual audio output component associated with each of the selected corresponding pairs of input channels. Likewise, such specifying may be relative to a virtual audio output component configured for outputting a center channel audio signal.

In at least one embodiment, a method of producing a localized stereo output audio signal from one or more received input audio signals may include specifying a second azimuth setting for each of a non-selected corresponding pair of input signals, wherein each of the second azimuth settings is specified based upon a relationship of a virtual audio output component, associated with each of the non-selected corresponding pairs of input channels, relative to the virtual audio output component configured for outputting a center channel audio signal. More specifically, in at least one embodiment, the corresponding pairs of rear channels may be selected and the azimuth for each of the selected corresponding pairs of rear input channels specified to equal 110°.

In at least one embodiment, a method of producing a localized stereo output audio signal from one or more received input audio signals may also include specifying a second azimuth setting, ranging from 22.5° to 30°, for each of a corresponding pair of front channels, wherein each specified second azimuth setting is specified based upon a relationship of each of a respective front left virtual audio component and a front right virtual audio component. Each of the virtual audio components may also be associated with a corresponding input channel of N channels of input audio signals, relative to the virtual audio output component configured for outputting a center channel audio signal.

In at least one embodiment, a method of producing a localized stereo output audio signal from one or more received input audio signals may include selecting, from an input audio signal, one or more input channels, specifying an elevation for each input channel, identifying an IIR filter to apply to each selected input channel based upon the elevation specified for each input channel. Further, the process may include filtering each of the selected input channels with an IIR filter to generate N localized channels. The process may also and/or alternatively include down-mixing or up-mixing, as the case may be, each of the N localized channels into two or more stereo paired output channels.

In at least one embodiment, a method of producing a localized stereo output audio signal from one or more received input audio signals may include applying a low pass frequency filter to the each of the N channels of input audio signals. The N channels of input audio include at least two side channels. The method may also and/or alternatively include mid-side decoding each side channels to generate a first phantom center channel. Further, it is to be appreciated that the N channels of input audio may include at least two front channels, and each of one or more set of channels may be mid-side decoded to generate a one or more phantom center channels. Such mid-side decoding may be applied, for example, to a corresponding pair of channels selected from the group consisting of front channels, side channels, surround channels and rear channels.

In at least one embodiment, a method of producing a localized stereo output audio signal from one or more received input audio signals may include identifying and enhancing any low frequency signals provided by each of N channels of input audio channels by applying low pass frequency filtering, gain and equalization to each of the N channels of input audio channels. The process may also and/or alternatively include mid-side decoding each of the N channels of input audio signals corresponding to a front pair of stereo channels. The process may also and/or alternatively include down-mixing each of the N channels of audio signals into a localized stereo audio output signal. The process may also and/or alternatively include up-mixing each of the N channels of audio signals into a localized stereo audio output signal.

In at least one embodiment, a method of producing a localized stereo output audio signal from one or more received input audio signals may include generating a virtual center mono channel by performing the operations of: (a) summing the first phantom center channel and the second phantom center channel, (b) dividing the result of the summing operation by 2; and (c) subtracting the quotient of the dividing operation from the second phantom center channel.

In at least one embodiment, a method of producing a localized stereo output audio signal from one or more received input audio signals may also at least one channel of an input audio signal that includes signals in an LtRt signal. The process may also and/or alternatively include isolating a left rear surround channel from an input audio signal by subtracting a right rear audio signal from a left rear LtRt audio signal; and isolating a right rear surround channel from an input audio signal by subtracting a left rear audio signal from a right rear LtRt audio signal.

These and other advantages and features of the present disclosure will be apparent upon reading the following description and claims.

DETAILED DESCRIPTION OF THE INVENTION

1. Overview of the Disclosure

Figure 1:
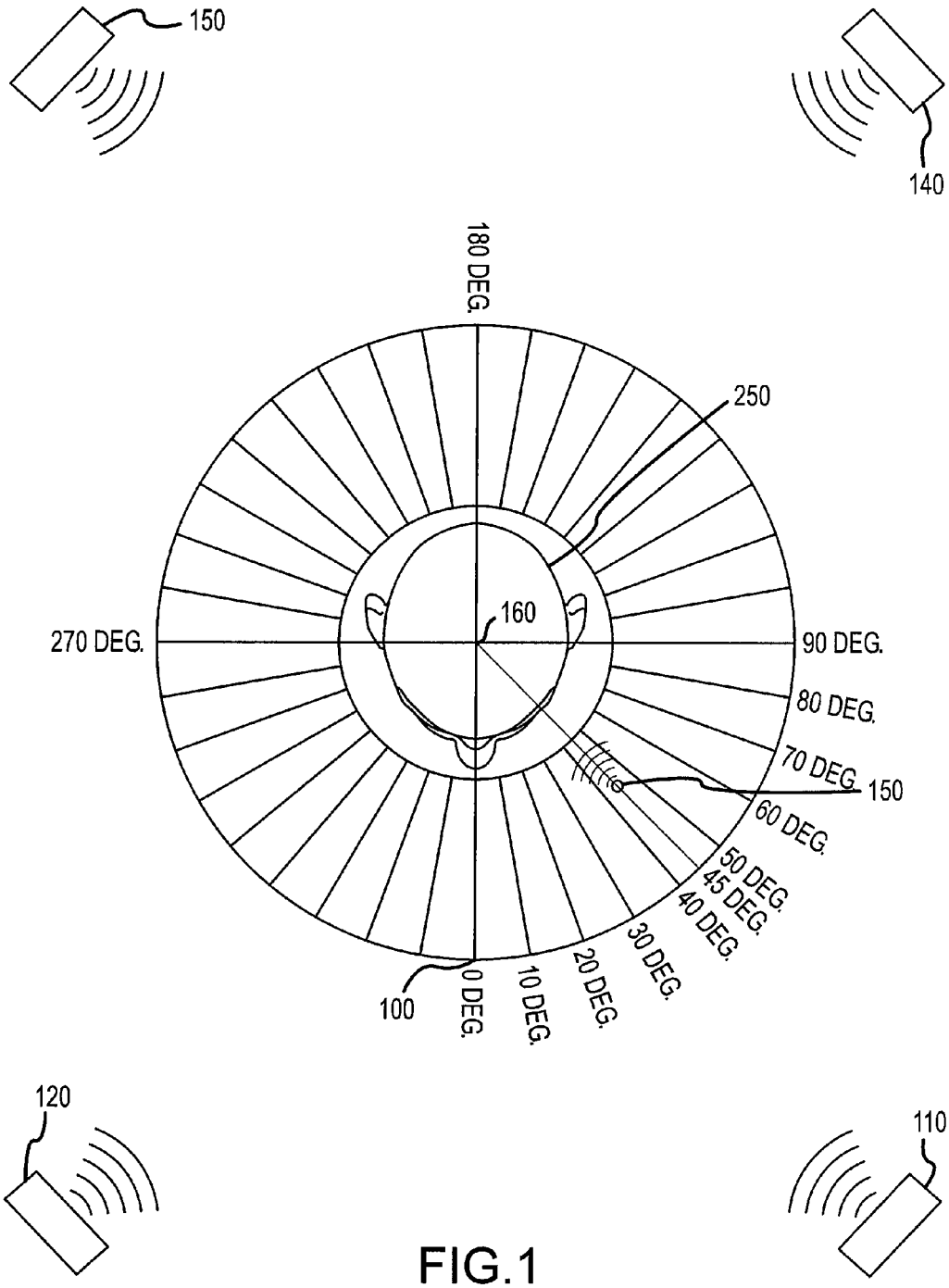
FIG. 1 depicts a top-down view of a listener occupying a "sweet spot" between four speakers, as well as an exemplary azimuthal coordinate system.

Generally, one embodiment of the present disclosure utilizes sound localization technology to place a listener in the center of a virtual sphere or virtual room of any size/shape of stationary and moving sound. This provides the listener with a true-to-life sound experience using as few as two speakers or a pair of headphones. The impression of a virtual sound source at an arbitrary position may be created by processing an audio signal to split it into a left and right ear channel, applying a separate filter to each of the two channels ("binaural filtering"), to create an output stream of processed audio that may be played back through speakers or headphones or stored in a file for later playback.

In one embodiment of the present disclosure audio sources are processed to achieve four-dimensional ("4D") sound localization. 4D processing allows a virtual sound source to be moved along a path in three-dimensional ("3D") space over a specified time period. When a spatialized waveform transitions between multiple spatial coordinates (typically to replicate a sound source "moving" in space), the transition between spatial coordinates may be smoothed to create a more realistic, accurate experience. In other words, the spatialized waveform may be manipulated to cause the spatialized sound to apparently smoothly transition from one spatial coordinate to another, rather than abruptly changing between discontinuous points in space (even though the spatialized sound is actually emanating from one or more speakers, a pair of headphones or other playback device). In other words, the spatialized sound corresponding to the spatialized waveform may seem not only to emanate from a point in 3D space other than the point(s) occupied by the playback device(s), but the apparent point of emanation may change over time. In the present embodiment, the spatialized waveform may be convolved from a first spatial coordinate to a second spatial coordinate, within a free field, independent of direction, and/or diffuse field binaural environment.

Three-dimensional sound localization (and, ultimately, 4D localization) may be achieved by filtering the input audio data with a set of filters derived from a pre-determined head-related transfer function ("HRTF") or head-related impulse response ("HRIR"), which may mathematically model the variance in phase and amplitude over frequency for each ear for a sound emanating from a given 3D coordinate. That is, each three-dimensional coordinate may have a unique HRTF and/or HRIR. For spatial coordinates lacking a pre-calculated filter, HRTF or HRIR, an estimated filter, HRTF or HRIR may be created from nearby filters/HRTFs/HRIRs. This process is described in more detail below. Details on how the HRTF and/or HRIR is derived may be found in U.S. patent application Ser. No. 10/802,319, filed on Mar. 16, 2004, which is hereby incorporated by reference in its entirety.

The HRTF may take into account various physiological factors, such as reflections or echoes within the pinna of an ear or distortions caused by the pinna's irregular shape, sound reflection from a listener's shoulders and/or torso, distance between a listener's eardrums, and so forth. The HRTF may incorporate such factors to yield a more faithful or accurate reproduction of a spatialized sound.

An impulse response filter may be created or calculated to emulate the spatial properties of the HRTF. In short, however, the impulse response filter is a numerical/digital representation of the HRTF.

A stereo waveform may be transformed by applying the impulse response filter, or an approximation thereof, through the present method to create a spatialized waveform. Each point (or every point separated by a time interval) on the stereo waveform is effectively mapped to a spatial coordinate from which the corresponding sound will emanate. The stereo waveform may be sampled and subjected to an impulse response filter, which may be generally referred to as a "Localization Filter", which approximates the aforementioned HRTF.

The Localization Filter, specified by its type and its coefficients, generally modifies the waveform to replicate the spatialized sound. As the coefficients of a Localization Filter are defined, they may be applied to additional dichotic waveforms (either stereo or mono) to spatialize sound for those waveforms, skipping the intermediate step of generating the Localization Filter every time.

The present embodiment may replicate a sound at a point in three-dimensional space, with increasing precision as the size of the virtual environment decreases. One embodiment of the present disclosure measures an arbitrarily sized room as the virtual environment using relative units of measure, from zero to one hundred, from the center of the virtual room to its boundary. The present embodiment employs spherical coordinates to measure the location of the spatialization point within the virtual room. It should be noted that the spatialization point in question is relative to the listener. That is, the center of the listener's head corresponds to the origin point of the spherical coordinate system. Thus, the relative precision of replication given above is with respect to the room size and enhances the listener's perception of the spatialized point.

One exemplary embodiment of the present disclosure employs a set of 7337 pre-computed HRTF filter sets located on the unit sphere, with a left and a right HRTF filter in each filter set. As used herein, a "unit sphere" is a spherical coordinate system with azimuth and elevation measured in degrees. Other points in space may be simulated by appropriately interpolating the filter coefficients for that position, as described in greater detail below.

2. Spherical Coordinate Systems

Generally, the present embodiment employs a spherical coordinate system (i.e., a coordinate system having radius r, altitude $\theta$, and azimuth $\phi$ as coordinates), but allows for inputs in a standard Cartesian coordinate system. Cartesian inputs may be transformed to spherical coordinates by certain embodiments of the disclosure. The spherical coordinates may be used for mapping the simulated spatial point, calculation of the HRTF filter coefficients, convolution between two spatial points, and/or substantially all calculations described herein. Generally, by employing a spherical coordinate system, accuracy of the HRTF filters (and thus spatial accuracy of the waveform during playback) may be increased. Accordingly, certain advantages, such as increased accuracy and precision, may be achieved when various spatialization operations are carried out in a spherical coordinate system.

Additionally, in certain embodiments the use of spherical coordinates may minimize processing time utilized to create the HRTF filters and convolve spatial audio between spatial points, as well as other processing operations described herein. Since sound/audio waves generally travel through a medium as a spherical wave, spherical coordinate systems are well-suited to model sound wave behavior, and thus spatialize sound. Alternate embodiments may employ different coordinate systems, including a Cartesian coordinate system.

Figure 2:
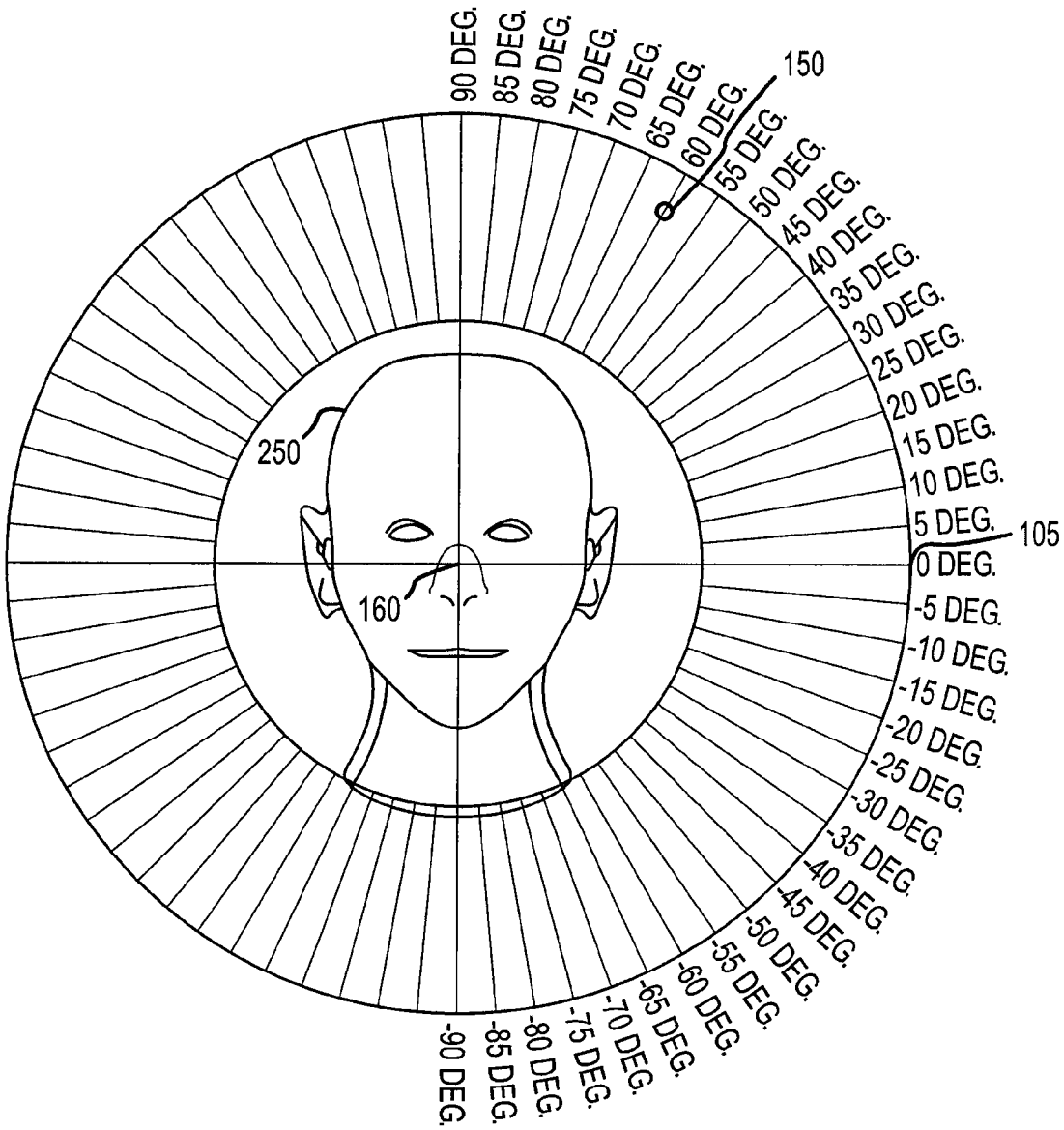
FIG. 2 depicts a front view of the listener shown in FIG. 1, as well as an exemplary altitudinal coordinate system.
Figure 3:
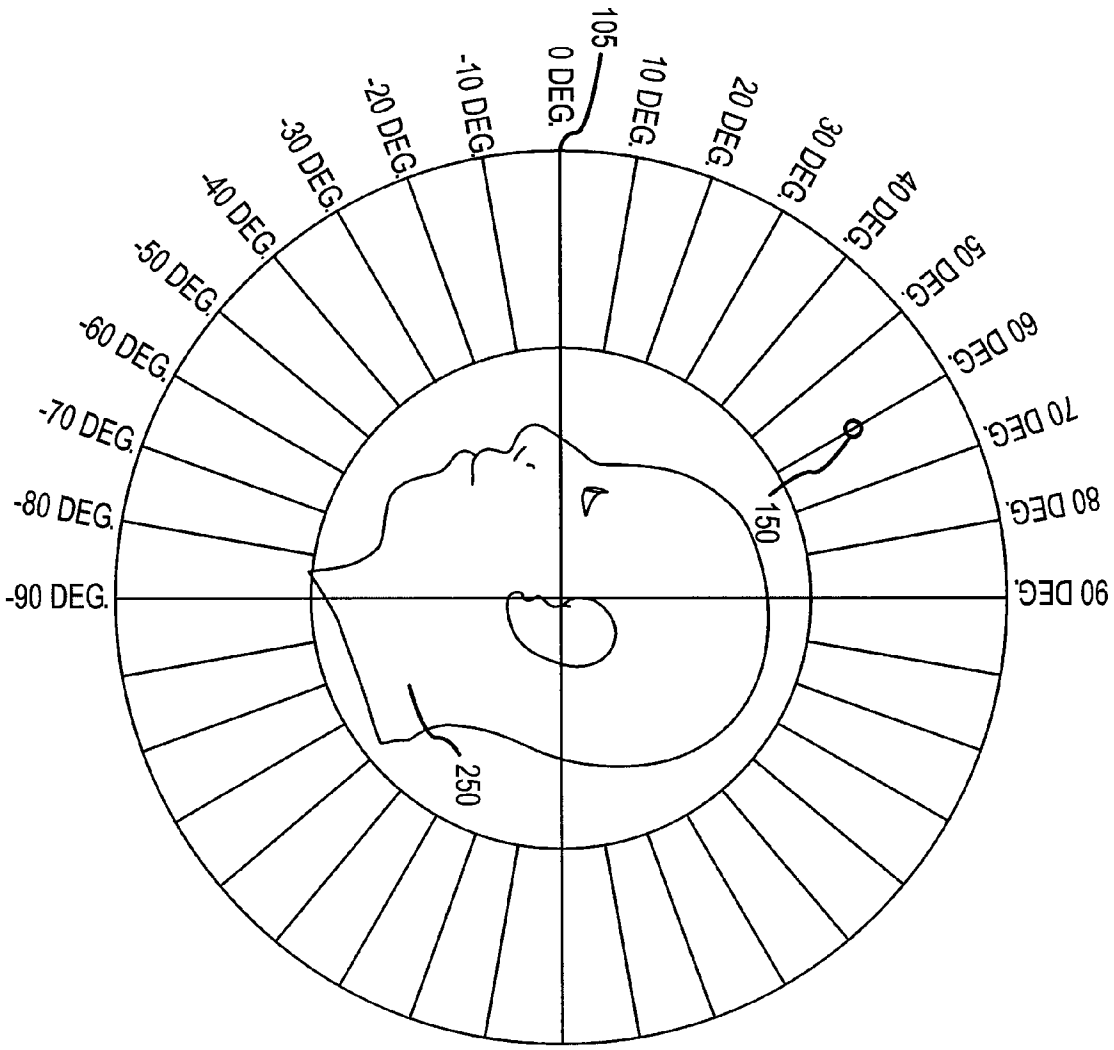
FIG. 3 depicts a side view of the listener shown in FIG. 1, as well as the exemplary altitudinal coordinate system of FIG. 2.

In the present document, a specific spherical coordinate convention is employed when discussing exemplary embodiments. Further, zero azimuth 100, zero altitude 105, and a non-zero radius of sufficient length correspond to a point in front of the center of a listener's head, as shown in FIGS. 1 and 3, respectively. As previously mentioned, the terms "altitude" and "elevation" are generally interchangeable herein. In the present embodiment, azimuth increases in a clockwise direction, with 180 degrees being directly behind the listener. Azimuth ranges from 0 to 359 degrees. An alternative embodiment may increase azimuth in a counter-clockwise direction as shown in FIG. 1. Similarly, altitude may range from 90 degrees (directly above a listener's head) to −90 degrees (directly below a listener's head), as shown in FIG. 2. FIG. 3 depicts a side view of the altitude coordinate system used herein.

It should be noted that in this document's discussion of the aforementioned coordinate system it is presumed a listener faces a main, or front, pair of speakers 110, 120. Thus, as shown in FIG. 1, the azimuthal hemisphere corresponding to the front speakers' emplacement ranges from 0 to 90 degrees and 270 to 359 degrees, while the azimuthal hemisphere corresponding to the rear speakers' emplacement ranges from 90 to 270 degrees. In the event the listener changes his rotational alignment with respect to the front speakers 110, 120, the coordinate system does not vary. In other words, azimuth and altitude are speaker dependent, and listener independent. However, the reference coordinate system is listener dependent when spatialized audio is played back across headphones worn by the listener, insofar as the headphones move with the listener. For purposes of the discussion herein, it is presumed the listener remains relatively centered between, and equidistant from, a pair of front speakers 110, 120. Rear, or additional ambient speakers 130, 140 are optional. The origin point 160 of the coordinate system corresponds approximately to the center of a listener's head 250, or the "sweet spot" in the speaker set up of FIG. 1. It should be noted, however, that any spherical coordinate notation may be employed with the present embodiment. The present notation is provided for convenience only, rather than as a limitation. Additionally, the spatialization of audio waveforms and corresponding spatialization effect when played back across speakers or another playback device do not necessarily depend on a listener occupying the "sweet spot" or any other position relative to the playback device(s). The spatialized waveform may be played back through standard audio playback apparatus to create the spatial illusion of the spatialized audio emanating from a virtual sound source location 150 during playback.

3. Software Architecture

Figure 4:
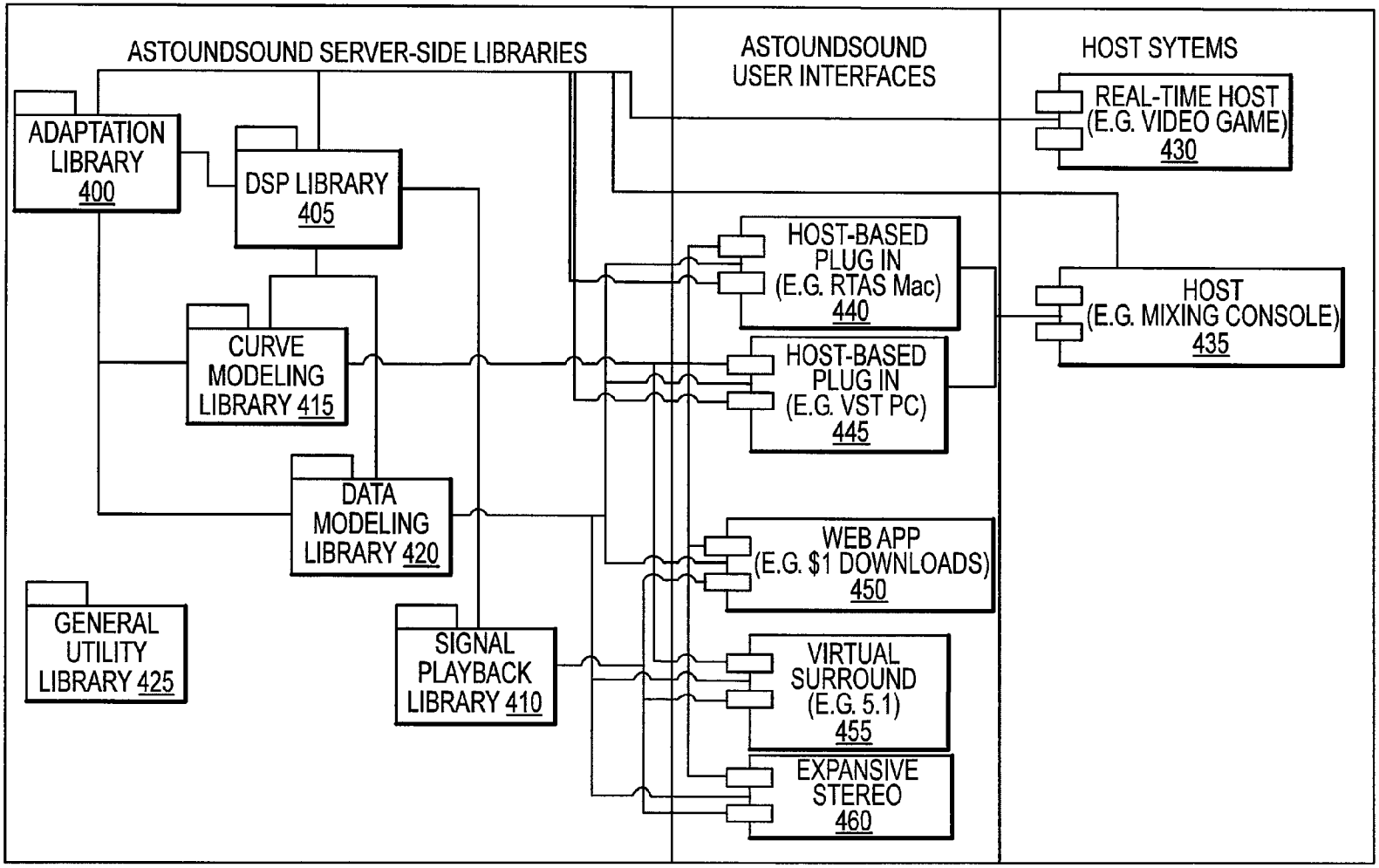
FIG. 4 depicts a high level view of the software architecture for one embodiment of the present disclosure.

FIG. 4 depicts a high level view of the software architecture, which for one embodiment of the present disclosure, utilizes a client-server software architecture. Such an architecture enables instantiation of the present disclosure in several different forms including, but not limited to, a professional audio engineer application for 4D audio post-processing, a professional audio engineer tool for simulating multi-channel presentation formats (e.g., 5.1 audio) in 2-channel stereo output, a "pro-sumer" (e.g., "professional consumer") application for home audio mixing enthusiasts and small independent studios to enable symmetric 3D localization post-processing and a consumer application that real-time localizes stereo files given a set of pre-selected virtual stereo speaker positions. All these applications utilize the same underlying processing principles and, often, code. Furthermore, the presently disclosed architecture may have applications in Consumer Electronics (CE)—where mono input, stereo input, or multi-channel input can be processed as real-time virtualization of (a) a single point source, as in the case of one or more mono inputs, (b) stereo input for stereo expansion or perceived virtual multi-channel output, (c) reproducing a virtual multi-channel listening experience from stereo output of a true multi-channel input, or (d) reproducing a different virtual multi-channel listening experience from a multi-channel, and optionally multi-channel plus additional integrated stereo, output of a true multi-channel input. These applications can be stand-alone (for example, a computer application) or embedded within a CE device of some sort, as will be described in greater detail in Section 8 of this disclosure, below.

As shown in FIG. 4, in one exemplary embodiment there are several server side libraries. The host system adaptation library 400 provides a collection of adaptors and interfaces that allow direct communication between a host application and the server side libraries. The digital signal processing library 405 includes the filter and audio processing software routines that transform input signals into 3D and 4D localized signals. The signal playback library 410 provides basic playback functions such as play, pause, fast forward, rewind and record for one or more processed audio signals. The curve modeling library 415 models static 3D points in space for virtual sound sources and models dynamic 4D paths in space traversed over time. The data modeling library 420 models input and system parameters typically including the musical instrument digital interface settings, user preference settings, data encryption and data copy protection. The general utilities library 425 provides commonly used functions for all the libraries such as coordinate transformations, string manipulations, time functions and base math functions.

Various embodiments of the present disclosure may be employed in various host systems including video game consoles 430, mixing consoles 435, host-based plug-ins including, but not limited to, a real time audio suite interface 440, a TDM audio interface, virtual studio technology interface 445, and an audio unit interface, or in stand alone applications running on a personal computing device (such as a desktop or laptop computer), a Web based application 450, a virtual surround application 455, an expansive stereo application 460, an iPod or other MP3 playback device, SD or HD radio receiver, home theater receiver or processor, automotive sound systems, cell phone, personal digital assistant or other handheld computer device, compact disc ("CD") player, digital versatile disk ("DVD") player or Blu-ray player, other consumer and professional audio playback or manipulation electronics systems or applications, etc. to provide a virtual sound source appearing at an arbitrary position in space when the processed audio file is played back through speakers or headphones. Furthermore, embodiments of the present disclosure may be employed in embedded applications, such as being embedded in headphones, sound bars, or embedded in a separate processing component that headphones/speakers can be plugged into or otherwise connected to. Embedded applications as described herein can also be used with input devices like positional microphones, for example, in a CE device that records sounds with more than one microphone, wherein the sound from each microphone is processed as an input with a fixed azimuth/elevation before it is recorded to the devices' physical media. This application would result in producing an appropriate localization effect when the recording is played back That is, the spatialized waveform may be played back through standard audio playback apparatus with no special decoding equipment required to create the spatial illusion of the spatialized audio emanating from the virtual sound source location during playback. In other words, unlike many audio sources that require sound systems that decode the encoded sources, by using DOLBY, DTS, and so forth, the playback apparatus need not include any particular programming or hardware to accurately reproduce the spatialization of the input waveform. Similarly, spatialization may be accurately experienced from any speaker configuration, including headphones, two-channel audio, three- or four-channel audio, five-channel audio or more, and so forth, either with or without a subwoofer.

Figure 5:
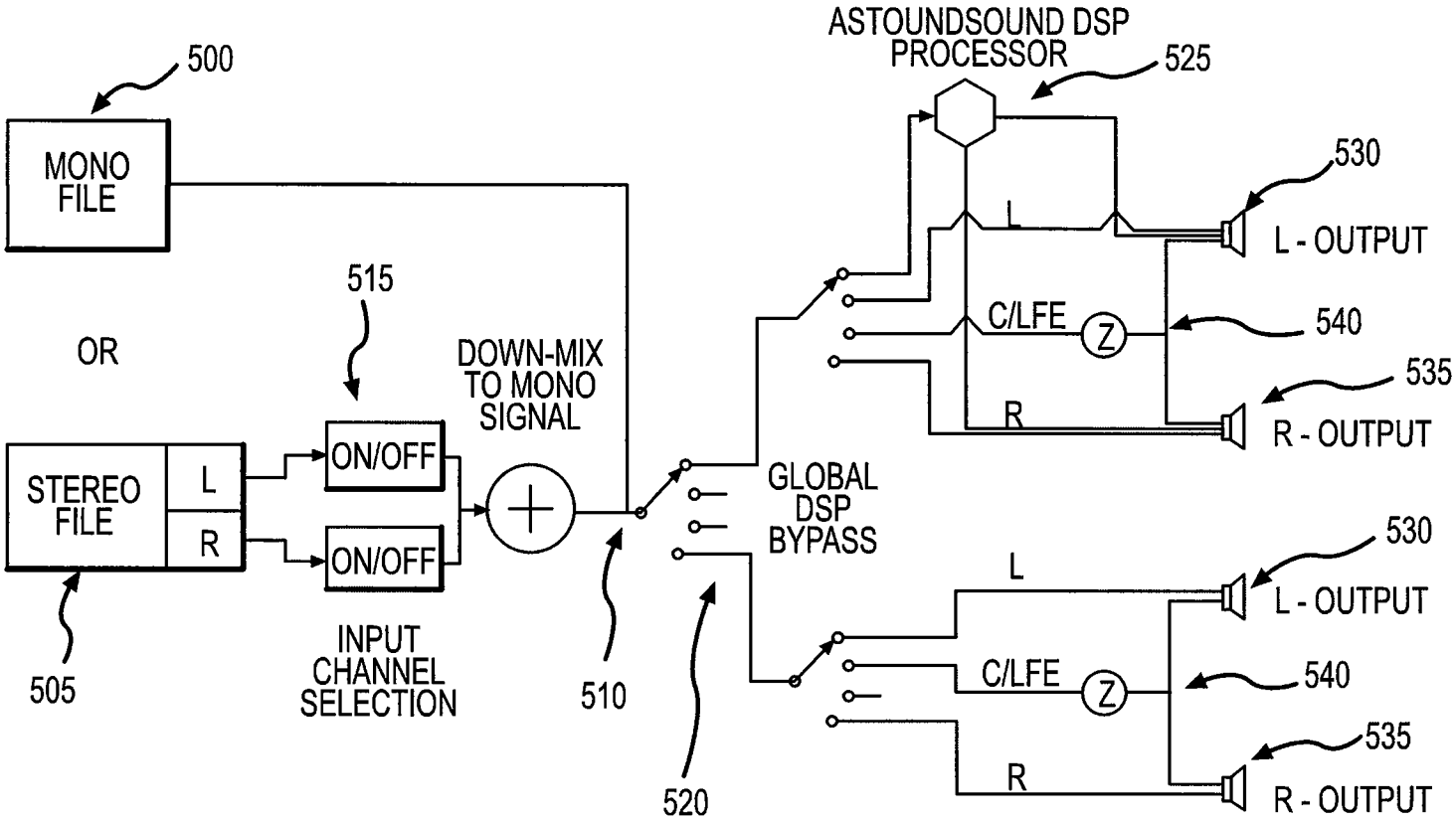
FIG. 5 depicts the signal processing chain for a monaural or stereo signal source for one embodiment of the present disclosure.

FIG. 5 depicts the signal processing chain for a monaural 500 or stereo 505 audio source input file or data stream (audio signal from a plug-in card such as a sound card) in a configuration where the desired output is a single spatialized point in 3D or 4D space. Because a single source is generally placed in 3D space, multi-channel audio sources such as stereo are mixed down to a single monaural channel 510 before being processed by the digital signal processor ("DSP") 525. Note that the DSP may be implemented on special purpose hardware or may be implemented on a CPU of a general purpose computer. Input channel selectors 515 enable either channel of a stereo file, or both channels, to be processed. The single monaural channel is subsequently split into two identical input channels that may be routed to the DSP 525 for further processing.

Some embodiments of the present disclosure enable multiple input files or data streams to be processed simultaneously. In general, FIG. 5 is replicated for each additional input file being processed simultaneously. A global bypass switch 520 enables all input files to bypass the DSP 525. This is useful for "A/B" comparisons of the output (e.g., comparisons of processed to unprocessed files or waveforms).

Additionally, each individual input file or data stream can be routed directly to the left output 530, right output 535 or center/low frequency emissions output 540, rather than passing through the DSP 525. This may be used, for example, when multiple input files or data streams are processed concurrently and one or more files will not be processed by the DSP. For example, if only the left-front and right-front channel will be localized, a non-localized center channel often may be utilized to provide context and may be routed around the DSP. Additionally, audio files or data streams having extremely low frequencies (for example, a center audio file or data stream having frequencies generally in the range of 20-500 Hz) may not need to be spatialized, insofar as most listeners typically have difficulty pinpointing the origin of low frequencies. Although waveforms having such frequencies may be spatialized by use of a HRTF filter, the difficulty most listeners would experience in detecting the associated sound localization cues minimizes the usefulness of such spatialization. Accordingly, such audio files or data streams may be routed around the DSP to reduce computing time and processing power utilized in computer-implemented embodiments of the present disclosure.

Figure 6:
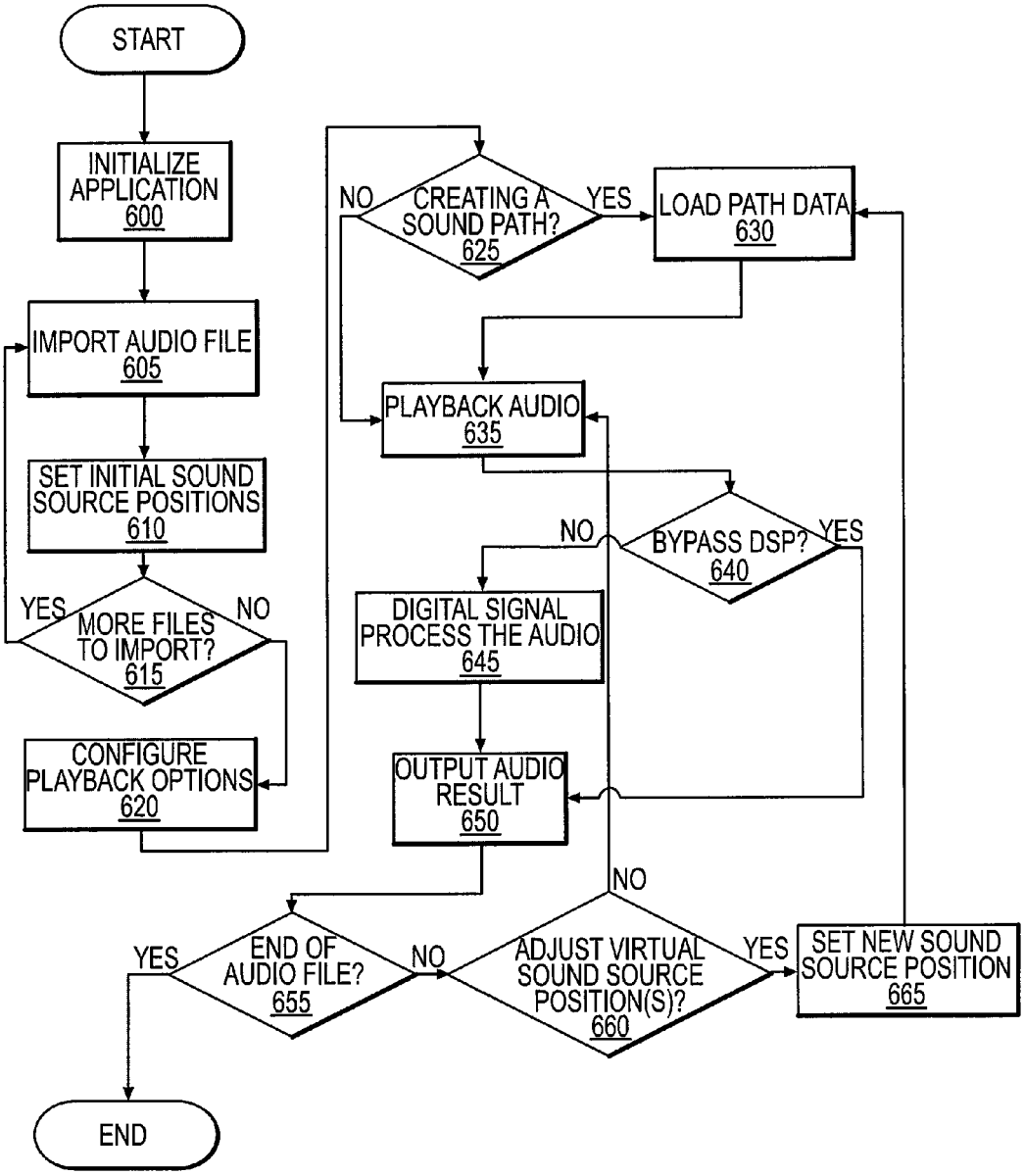
FIG. 6 is a flowchart of the high level software process flow for one embodiment of the present disclosure.

FIG. 6 is a flowchart of the high level software process flow for one embodiment of the present disclosure. The process begins in operation 600, where the embodiment initializes the software. Then operation 605 is executed. Operation 605 imports an audio file or a data stream from a plug-in to be processed. Operation 610 is executed to select the virtual sound source position for the audio file if it is to be localized or to select pass-through when the audio file is not being localized. In operation 615, a check is performed to determine if there are more input audio files to be processed. If another audio file is to be imported, operation 605 is again executed. If no more audio files are to be imported, then the embodiment proceeds to operation 620.

Operation 620 configures the playback options for each audio input file or data stream. Playback options may include, but are not limited to, loop playback and channel to be processed (left, right, both, etc.). Then operation 625 is executed to determine if a sound path is being created for an audio file or data stream. If a sound path is being created, operation 630 is executed to load the sound path data. The sound path data is the set of HRTF filters used to localize the sound at the various three-dimensional spatial locations along the sound path, over time. The sound path data may be entered by a user in real-time, stored in persistent memory, or in other suitable storage means. Following operation 630, the embodiment executes operation 635, as described below. However, if the embodiment determines in operation 625 that a sound path is not being created, operation 635 is accessed instead of operation 630 (in other words, operation 630 is skipped).

Operation 635 plays back the audio signal segment of the input signal being processed. Then operation 640 is executed to determine if the input audio file or data stream will be processed by the DSP. If the file or stream is to be processed by the DSP, operation 645 is executed. If operation 640 determines that no DSP processing is to be performed, operation 650 is executed.

Operation 645 processes the audio input file or data stream segment through the DSP to produce a localized stereo sound output file. Then operation 650 is executed and the embodiment outputs the audio file segment or data stream. That is, the input audio may be processed in substantially real time in some embodiments of the present disclosure. In operation 655, the embodiment determines if the end of the input audio file or data stream has been reached. If the end of the file or data stream has not been reached, operation 660 is executed. If the end of the audio file or data stream has been reached, then processing stops.

Operation 660 determines if the virtual sound position for the input audio file or data stream is to be moved to create 4D sound. Note that during initial configuration, the user specifies the 3D location of the sound source and may provide additional 3D locations, along with a time stamp of when the sound source is to be at that location. If the sound source is moving, then operation 665 is executed. Otherwise, operation 635 is executed.

Operation 665 sets the new location for the virtual sound source. Then operation 630 is executed.

It should be noted that operations 625, 630, 635, 640, 645, 650, 655, 660, and 665 are typically executed in parallel for each input audio file or data stream being processed concurrently. That is, each input audio file or data stream is processed, segment by segment, concurrently with the other input files or data streams.

4. Specifying Sound Source Locations and Binaural Filter Interpolation

Figure 7:
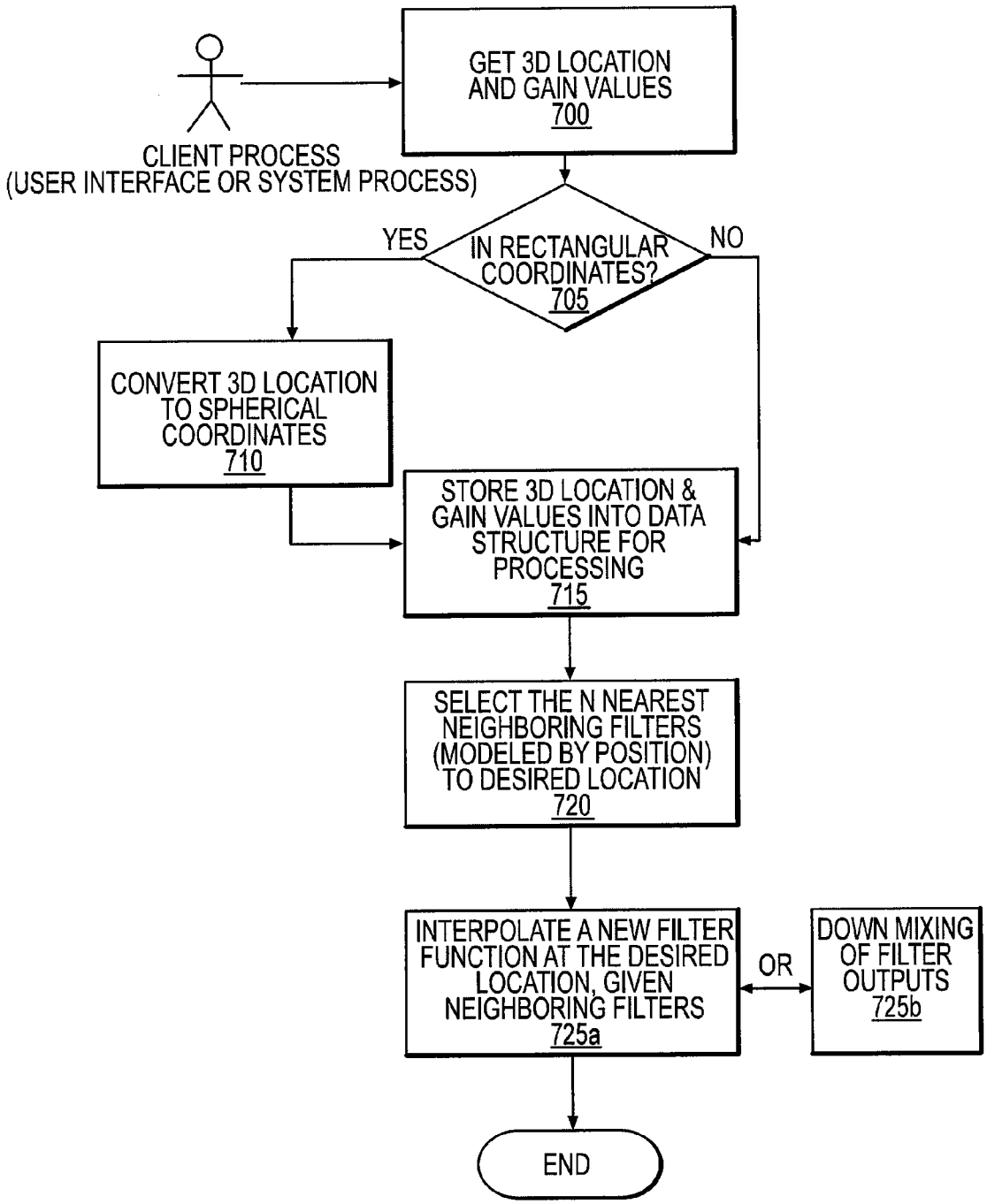
FIG. 7 depicts how a 3D location of a virtual sound source is set.

FIG. 7 shows the basic process employed by one embodiment of the present disclosure for specifying the location of a virtual sound source in 3D space. The operations and methods described in FIG. 7 may be performed by any appropriately-configured computing device. As one example, the method may be performed by a computer executing software embodying the method of FIG. 7. Operation 700 is executed to obtain the spatial coordinates of the 3D sound location. The user typically inputs the 3D source location via a user interface. Alternatively, the 3D location can be input via a file, a hardware device, or statically defined. The 3D sound source location may be specified in rectangular coordinates (x, y, z) or in spherical coordinates (r, theta, phi). Then operation 705 is executed to determine if the sound location is in rectangular coordinates. If the 3D sound location is in rectangular coordinates, operation 710 is executed to convert the rectangular coordinates into spherical coordinates. Then operation 715 is executed to store the spherical coordinates of the 3D location in an appropriate data structure for further processing along with a gain value. A gain value provides independent control of the "volume" of the signal. In one embodiment separate gain values are enabled for each input audio signal stream or file.

As previously described herein, one embodiment of the present disclosure stores 7,337 pre-defined binaural filters, each at a discrete location on the unit sphere. Each binaural filter has two components, a $HRTF_L$ filter (generally approximated by an impulse response filter, e.g., $IR_L$ filter) and a $HRTF_R$ filter (generally approximated by an impulse response filter, e.g., $IR_R$ filter), collectively, a filter set. Each filter set may be provided as filter coefficients in HRIR form located on the unit sphere. These filter sets may be distributed uniformly or non-uniformly around the unit sphere for various embodiments. Other embodiments may store more or fewer binaural filter sets. After operation 715, operation 720 is executed. Operation 720 selects the nearest N neighboring filters when the 3D location specified is not covered by one of the pre-defined binaural filters. If the actual 3D location is not covered by a pre-defined binaural Localization Filter, the filter output at the desired position can be generated by either of the two following methods (725*a*, 725*b*):

1. Nearest Neighbor (725*a*): The nearest neighbor filter with respect to the point that is to be localized is selected by calculating the distance between the desired location and the stored filter coordinates on a 3D sphere. This filter is then used for processing. A cross fade between the output of the selected filter and the audio output of the previously selected filter is computed in order to avoid sudden jumps in the localized position.

2. Down-mixing of Filter Outputs (725*b*): Three or fewer neighboring filters surrounding the specified spatial location are selected. All neighboring filters are used in parallel to process the same input signal and create three or fewer filtered output signals, each corresponding to the position of the filter. The output of the three or fewer filters is then mixed according to the relative distance between the individual filter position and the localized position. This creates a weighted sum so that the filter closest to the localized position makes the largest contribution to the combined filtered output signal. Other embodiments may generate a new filter using more or fewer pre-defined filters.

Still further embodiments may generate a new filter by using an infinite impulse response ("IIR") filter design process, such as the Remez Exchange methodology.

It should be understood that the HRTF filters are not waveform-specific. That is, each HRTF filter may spatialize audio for any portion of any input waveform, causing it to apparently emanate from the virtual sound source location when played back through speakers or headphones.

Figure 8:
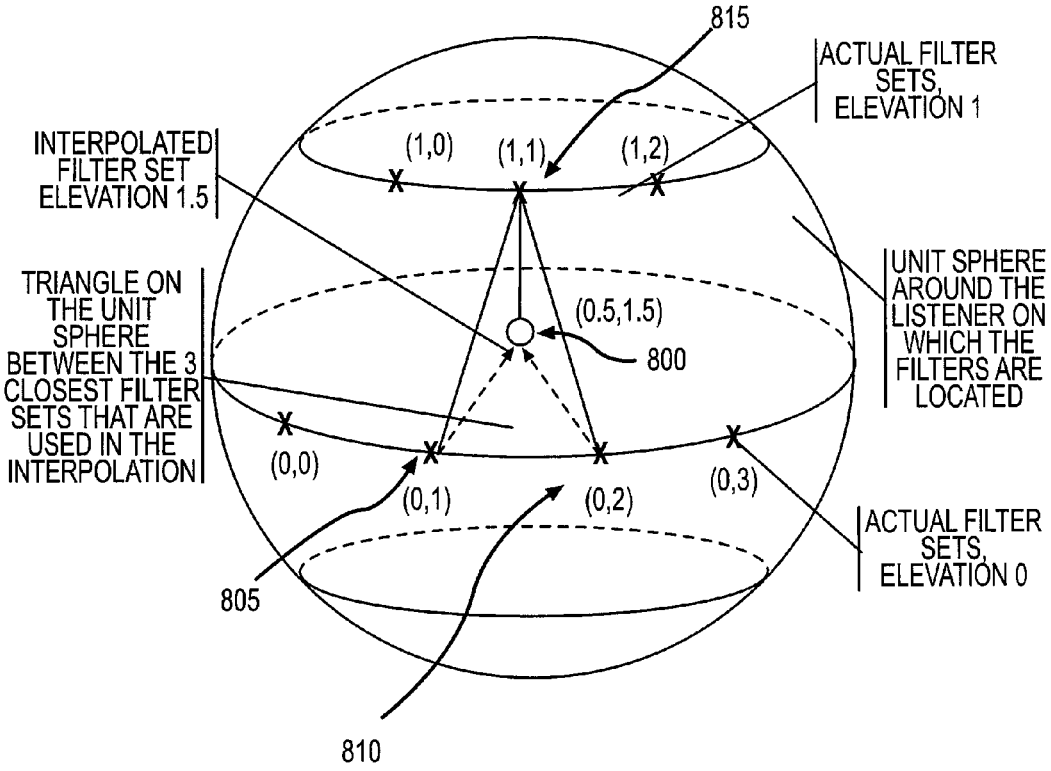
FIG. 8 depicts how a new HRTF filter may be interpolated from existing pre-defined HRTF filters.

FIG. 8 depicts several pre-defined HRTF filter sets, each denoted by an X, located on the unit sphere that are utilized to generate a new HRTF filter located at location 800. Location 800 is a desired 3D virtual sound source location, specified by its azimuth and elevation (0.5, 1.5). This location is not covered by one of the pre-defined filter sets. In this illustration, three nearest neighboring pre-defined filter sets 805, 810, 815 are used to generate the filter set for location 800. Selecting the appropriate three neighboring filter sets for location 800 is done by minimizing the distance D between the desired position and all stored positions on the unit sphere according to the Pythagorean distance relation:

$$D=SQRT((e_x-e_k)^2+(a_x-a_k)^2))$$

where $e_k$ and $a_k$ are the elevation and azimuth at stored location k and $e_x$ and $a_x$ are the elevation and azimuth at the desired location x.

Thus, filter sets 805, 810, 815 may be used by one embodiment to obtain the filtered output for location 800. Other embodiments may use more or fewer pre-defined filters for the generation of an in-between filter output.

Figure 9:
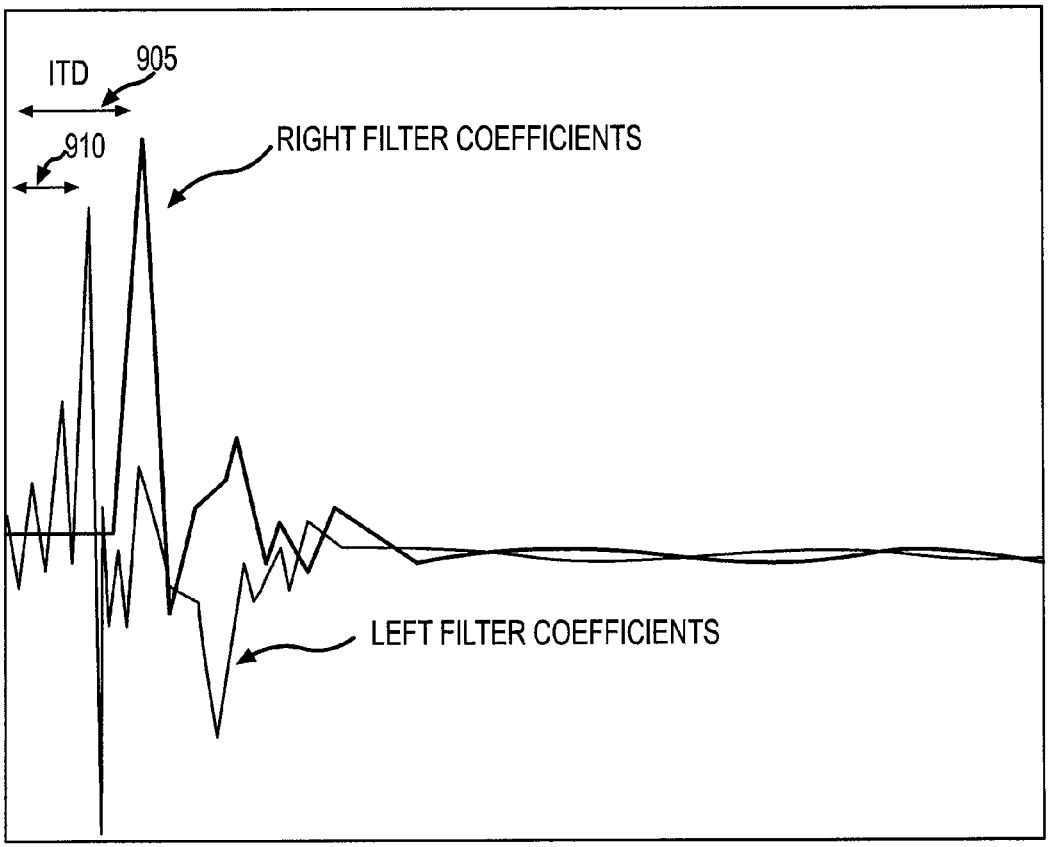
FIG. 9 illustrates the inter-aural time difference between the left and right HRTF filter coefficients.

When computing the output of the desired position, the inter-aural time difference ("ITD") generally should be considered. Each HRIR has an intrinsic delay that depends on the distance between the respective ear channel and the sound source as shown in FIG. 9. This ITD appears in the HRIR as a non-zero offset in front of the actual filter coefficients. Therefore, it may be difficult to create a filter that resembles the HRIR at the desired position x from the known positions k and k+1. When the grid is densely populated with pre-defined filters, the delay introduced by the ITD may be ignored because the error is small. However, when there is limited memory in a computing device performing the computations herein, this may not be an option.

When memory is limited and/or when computing power is to be conserved, the ITDs 905, 910 for the right and left ear channel, respectively, may be estimated so that the ITD contribution to the delay, $D_R$ and $D_L$, of the right and left filter, respectively, may be removed during the interpolation process. In one embodiment of the present disclosure, the ITD may be determined by examining the offset at which the HRIR exceeds 5% of the HRIR maximum absolute value. This estimate is not precise because the ITD is a fractional delay with a delay time D beyond the resolution of the sampling interval. The actual fraction of the delay is determined using parabolic interpolation across the peak in the HRIR to estimate the actual location T of the peak. This is generally done by finding the maximum of a parabola fitted through three known points which can be expressed mathematically as $$p_n=|h_T|-|h_{T-1}|$$

$$p_m=|h_T|-|h_{T+1}|$$

$$D=t+(p_n-p_m)/(2*(p_n+p_m+\epsilon))$$ where $\epsilon$ is a small number to make sure the denominator is not zero.

The HRIR can be time shifted ($h'_t=h_{t+D}$) in the time domain to account for the ITD in order to remove it from the filter impulse response.

After generating the new output, the ITD is added back in by delaying the right and left channel by an amount $D_R$ or $D_L$, respectively. The delay is also interpolated, according to the current position of the sound source that is being rendered. That is, for each channel $$D=\alpha D_{k+1}+(1-\alpha)D_k \text{ where } \alpha=x-k.$$

5. Digital Signal Processing and HRTF Filtering

Figure 10:
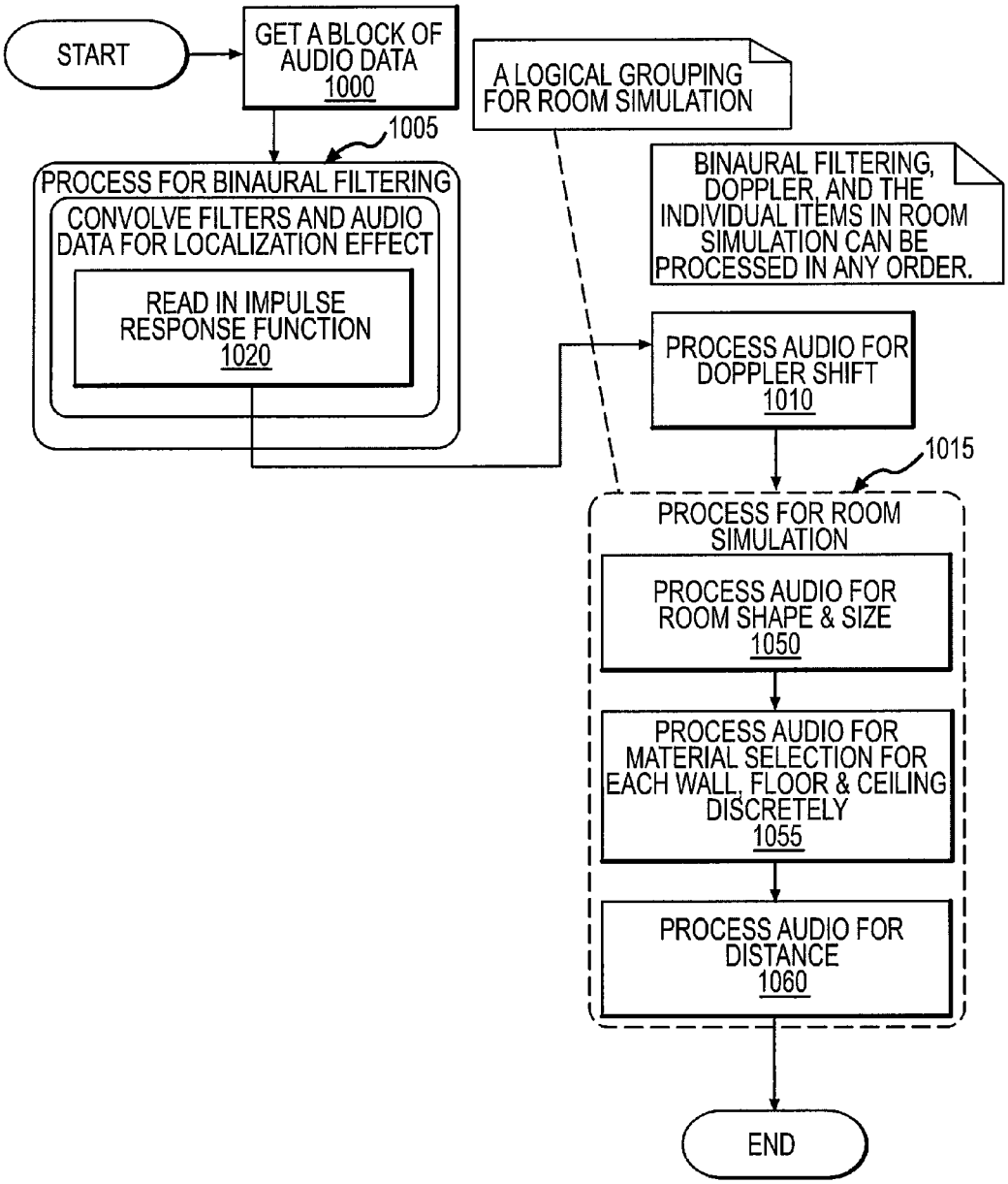
FIG. 10 depicts the DSP software processing flow for sound source localization for one embodiment of the present disclosure.

Once the binaural filter coefficients for the specified 3D sound locations have been determined, each input audio stream can be processed to provide a localized stereo output. In one embodiment of the present disclosure, the DSP unit is subdivided into three separate sub processes. These are binaural filtering, Doppler shift processing and ambience processing. FIG. 10 shows the DSP software processing flow for sound source localization for one embodiment of the present disclosure.

Initially, operation 1000 is executed to obtain a block of audio data for an audio input channel for further processing by the DSP. Then operation 1005 is executed to process the block for binaural filtering. Then operation 1010 is executed to process the block for Doppler shift. Finally, operation 1015 is executed to process the block for room simulation. Other embodiments may perform binaural filtering 1005, Doppler shift processing 1010 and room simulation processing 1015 in a different order.

During the binaural filtering operation 1005, operation 1020 is executed to read in the HRIR filter set for the specified 3D location.

During room simulation processing of the block of audio data (operation 1015), operation 1050 is executed. Operation

1050 processes the block of audio data for room shape and size. Then operation 1055 is executed. Operation 1055 processes the block of audio data for wall, floor and ceiling materials. Then operation 1060 is executed. Operation 1060 processes the block of audio data to reflect the distance from the 3D sound source location and the listener's ear.

Human ears deduce the position of a sound cue from various interactions of the sound cue with the surroundings and the human auditory system that includes the outer ear and pinna. Sound from different locations creates different resonances and cancellations in the human auditory system that enables the brain to determine the sound cue's relative position in space.

These resonances and cancellations created by the interactions of the sound cue with the environment, the ear, and the pinna are essentially linear in nature and can therefore be captured by expressing the localized sound as the response of a linear time invariant ("LTI") system to an external stimulus, as may be calculated by various embodiments of the present disclosure. (Generally, the calculations, formulae and other operations set forth herein may be, and typically are, executed by embodiments of the present disclosure. Thus, for example, an exemplary embodiment may take the form of appropriately-configured computer hardware or software that may perform the tasks, calculations, operations and so forth disclosed herein. Accordingly, discussions of such tasks, formulae, operations, calculations and so on (collectively, "data") should be understood to be set forth in the context of an exemplary embodiment including, performing, accessing or otherwise utilizing such data.)

The response of any discrete LTI system to a single impulse response is called the "impulse response" of the system. Given the impulse response h(t) of such a system, its response y(t) to an arbitrary input signal s(t) can be constructed by an embodiment through a process called convolution in the time domain. That is, $$y(t)=s(t)\cdot h(t) \text{ where } \cdot \text{ denotes convolution.}$$

Figure 11:
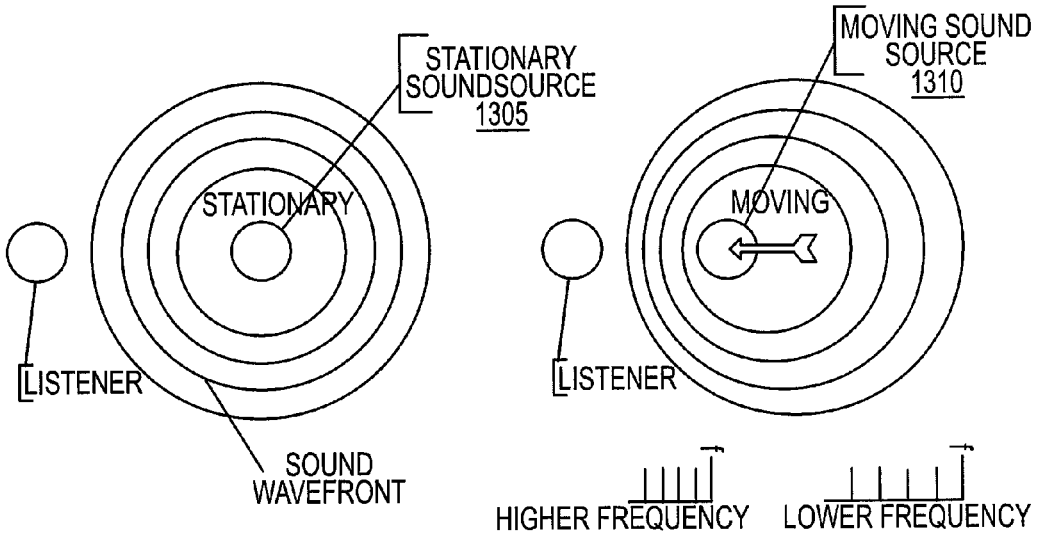
FIG. 11 illustrates the Doppler shift effect on stationary and moving sound sources.

After the block of audio data has been binaural filtered, some embodiments of the present disclosure may further process the block of audio data to account for or create a Doppler shift (operation 1010 of FIG. 10). Other embodiments may process the block of data for Doppler shift before the block of audio data is binaural filtered. Doppler shift is a change in the perceived pitch of a sound source as a result of relative movement of the sound source with respect to the listener as illustrated by FIG. 11. As FIG. 11 illustrates, a stationary sound source does not change in pitch. However, a sound source 1310 moving toward the listener is perceived to be of higher pitch while a sound source moving away from the listener is perceived to be of lower pitch. Because the speed of sound is 334 meters/second, a few times higher than the speed of a moving source, the Doppler shift is easily noticeable even for slow moving sources. Thus, the present embodiment may be configured such that the localization process may account for Doppler shift to enable the listener to determine the speed and direction of a moving sound source.

Figure 12:
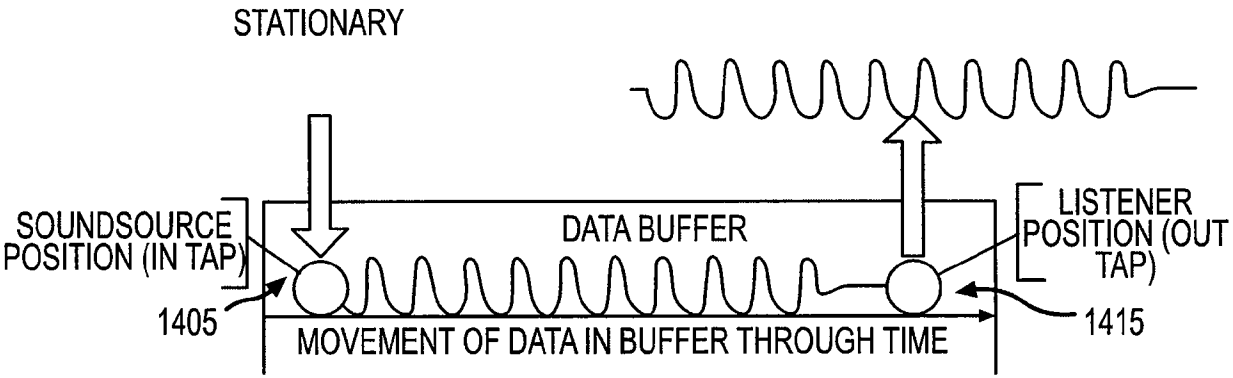
FIG. 12 illustrates how the distance between a listener and a stationary sound source is perceived as a simple delay.

The Doppler shift effect may be created by some embodiments of the present disclosure using digital signal processing. A data buffer proportional in size to the maximum distance between the sound source and the listener is created. Referring now to FIG. 12, the block of audio data is fed into the buffer at the "in tap" 1405 which may be at index 0 of the buffer and corresponds to the position of the virtual sound source. The "output tap" 1415 corresponds to the listener position. For a stationary virtual sound source, the distance between the listener and the virtual sound source will be perceived as a simple delay, as shown in FIG. 12.

Figure 13:
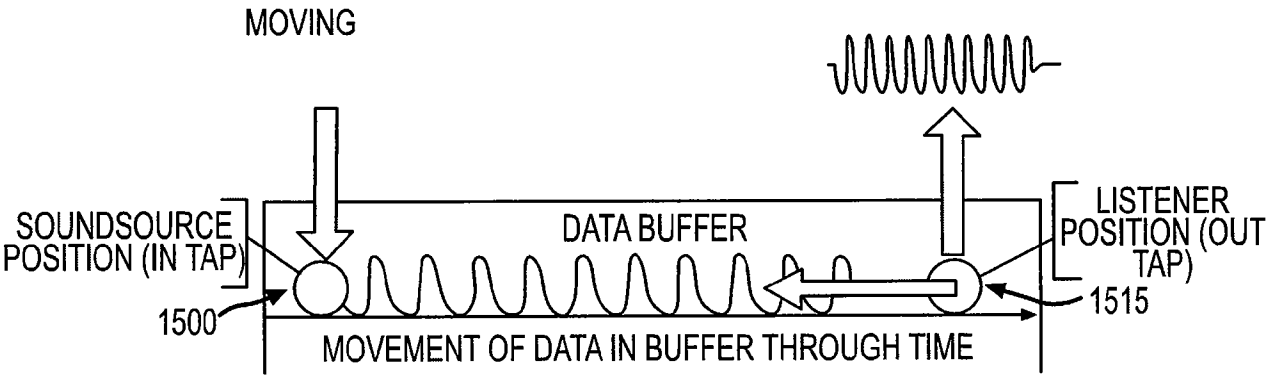
FIG. 13 illustrates how moving the listener position or source position changes the perceived pitch of the sound source.

When a virtual sound source is moved along a path, the Doppler shift effect may be introduced by moving the listener tap or sound source tap to change the perceived pitch of the sound. For example, as illustrated in FIG. 13, if the tap position 1515 of the listener is moved to the left, which means moving toward the sound source 1500, the sound wave's peaks and valleys will hit the listener's position faster, which is equivalent to an increase in pitch. Alternatively, the listener tap position 1515 can be moved away from the sound source 1500 to decrease the perceived pitch.

The present embodiment may separately create a Doppler shift for the left and right ear to simulate sound sources that are not only moving radially but also circularly with respect to the listener. Because the Doppler shift can create pitches higher in frequency when a source is approaching the listener, and because the input signal may be critically sampled, the increase in pitch may result in some frequencies falling outside the Nyquist frequency, thereby creating aliasing. Aliasing occurs when a signal sampled at a rate $S_r$ contains frequencies at or above the Nyquist frequency=$S_r/2$ (e.g., a signal sampled at 44.1 kHz has a Nyquist frequency of 22,050 Hz and the signal may have frequency content less than 22,050 Hz to avoid aliasing). Frequencies above the Nyquist frequency appear at lower frequency locations, causing an undesired aliasing effect. Some embodiments of the present disclosure may employ an anti-aliasing filter prior to or during the Doppler shift processing so that any changes in pitch will not create frequencies that alias with other frequencies in the processed audio signal.

Because the left and right ear Doppler shift are processed independently of each other, some embodiments of the present disclosure executed on a multiprocessor system may utilize separate processors for each ear to minimize overall processing time of the block of audio data.

Some embodiments of the present disclosure may perform ambience processing on a block of audio data (operation 1015 of FIG. 10). Ambience processing includes reflection processing (operations 1050 and 1055 of FIG. 10) to account for room characteristics and distance processing (operation 1060 of FIG. 10).

The loudness (decibel level) of a sound source is a function of distance between the sound source and the listener. On the way to the listener, some of the energy in a sound wave is converted to heat due to friction and dissipation (air absorption). Also, due to wave propagation in 3D space, the sound wave's energy is distributed over a larger volume of space when the listener and the sound source are further apart (distance attenuation).

In an ideal environment, the attenuation A (in dB) in sound pressure level between the listener at distance d2 from the sound source, whose reference level is measured at a distance of d1 can be expressed as $$A=20 \log 10(d2/d1)$$

This relationship is generally only valid for a point source in a perfect, loss free atmosphere without any interfering objects. In one embodiment of the present disclosure, this relationship is used to compute the attenuation factor for a sound source at distance d2.

Sound waves generally interact with objects in the environment, from which they are reflected, refracted, or diffracted. Reflection off a surface results in discrete echoes being added to the signal, while refraction and diffraction generally are more frequency dependent and create time delays that vary with frequency. Therefore, some embodiments of the present disclosure incorporate information about the immediate surroundings to enhance distance perception of the sound source.

There are several methods that may be used by embodiments of the present disclosure to model the interaction of sound waves with objects, including ray tracing and reverb processing using comb and all-pass filtering. In ray tracing, reflections of a virtual sound source are traced back from the listener's position to the sound source. This allows for realistic approximation of real rooms because the process models the paths of the sound waves.

In reverb processing using comb and all-pass filtering, the actual environment typically is not modeled. Rather, a realistic sounding effect is reproduced instead. One widely used method involves arranging comb and all-pass filters in serial and parallel configurations as described in a paper "Colorless artificial reverberation," M. R. Schroeder and B. F. Logan, *IRE Transactions*, Vol. AU-9, pp. 209-214, 1961, which is incorporated herein by reference.

Figure 14:
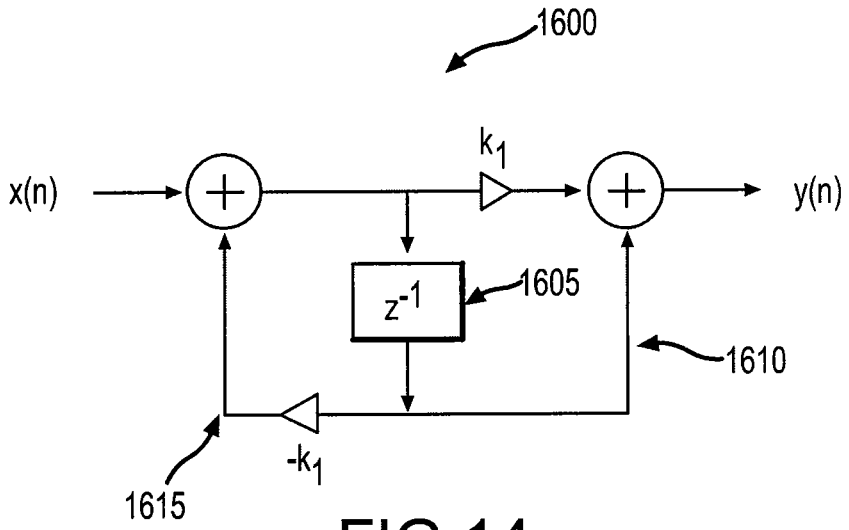
FIG. 14 is a block diagram of an all-pass filter implemented as a delay element with a feed forward and a feedback path.

An all-pass filter 1600 may be implemented as a delay element 1605 with a feed forward 1610 and a feedback 1615 path as shown in FIG. 14. In a structure of all-pass filters, filter i has a transfer function given by $$S_i(z)=(k_i+z^{-1})/(1+k_iz^{-1})$$

Figure 15:
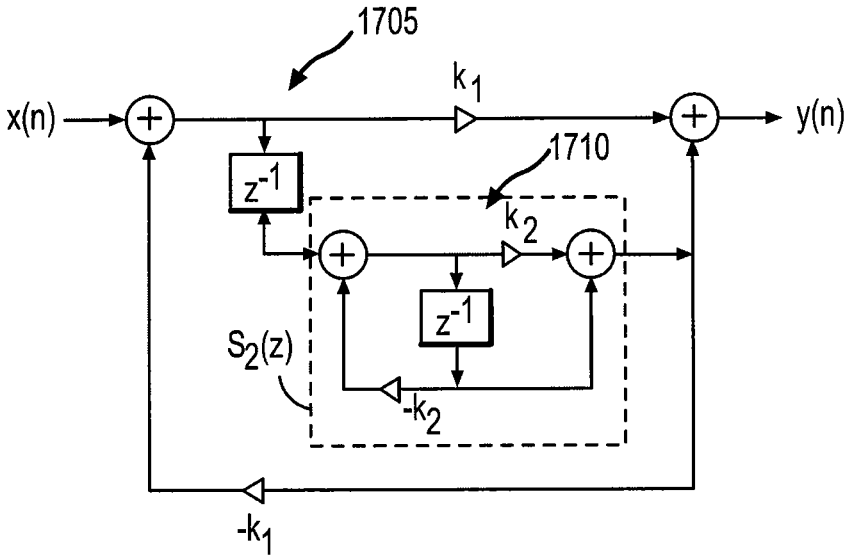
FIG. 15 depicts nesting of all-pass filters to simulate multiple reflections from objects in the vicinity of a virtual sound source being localized.

An ideal all-pass filter creates a frequency dependent delay with a long-term unity magnitude response (hence the name all-pass). As such, the all-pass filter only has an effect on the long-term phase spectrum. In one embodiment of the present disclosure, all-pass filters 1705, 1710 may be nested to achieve the acoustic effect of multiple reflections being added by objects in the vicinity of the virtual sound source being localized as shown in FIG. 15. In one particular embodiment, a network of sixteen nested all-pass filters is implemented across a shared block of memory (accumulation buffer). An additional 16 output taps, eight per audio channel, simulate the presence of walls, ceiling and floor around the virtual sound source and listener.

Figure 16:
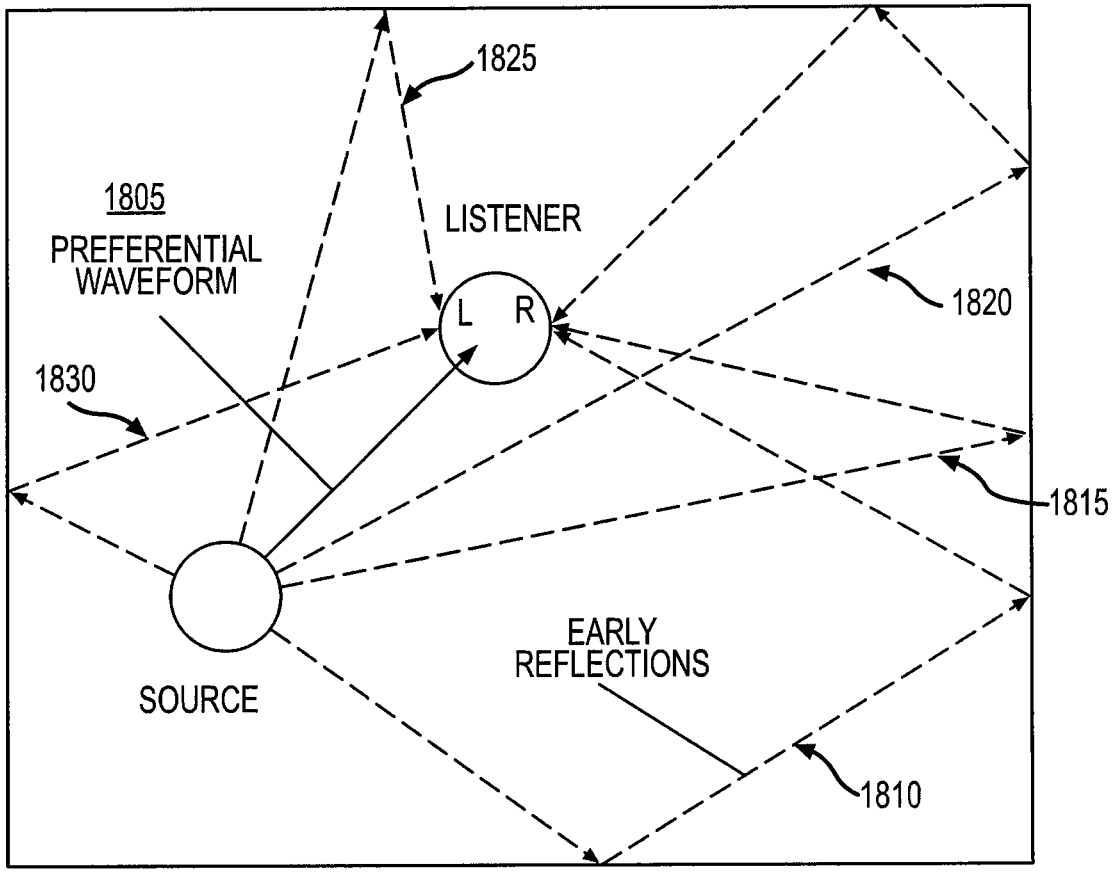
FIG. 16 depicts the results of an all-pass filter model, the preferential waveform (incident direct sound) and the early reflections from the source to the listener.

Taps into the accumulation buffer may be spaced in a way such that their time delays correspond to the first order reflection times and the path lengths between the two ears of the listener and the virtual sound source within the room. FIG. 16 depicts the results of an all-pass filter model, the preferential waveform 1805 (incident direct sound) and early reflections 1810, 1815, 1820, 1825, 1830 from the virtual sound source to the listener.

6. Further Processing Improvements

Under certain conditions, the HRTF filters may introduce a spectral imbalance that can undesirably emphasize certain frequencies. This arises from the fact that there may be large dips and peaks in the magnitude spectrum of the filters that can create an imbalance between adjacent frequency areas if the processed signal has a flat magnitude spectrum.

To counteract the effects of this tonal imbalance without affecting the small scale peaks which are generally used in producing the localization cues, an overall gain factor that varies with frequency is applied to the filter magnitude spectrum. This gain factor acts as an equalizer that smoothes out changes in the frequency spectrum and generally maximizes its flatness and minimizes large scale deviations from the ideal filter spectrum.

Additionally, some effects of the binaural filters may cancel out when a stereo track is played back through two virtual speakers positioned symmetrically with respect to the listener's position. This may be due to the symmetry of both the inter-aural level difference ("ILD"), the ITD and the phase response of the filters. That is, the ILD, ITD and phase response of left ear filter and the right ear filter are generally reciprocals of one another.

Figure 17:
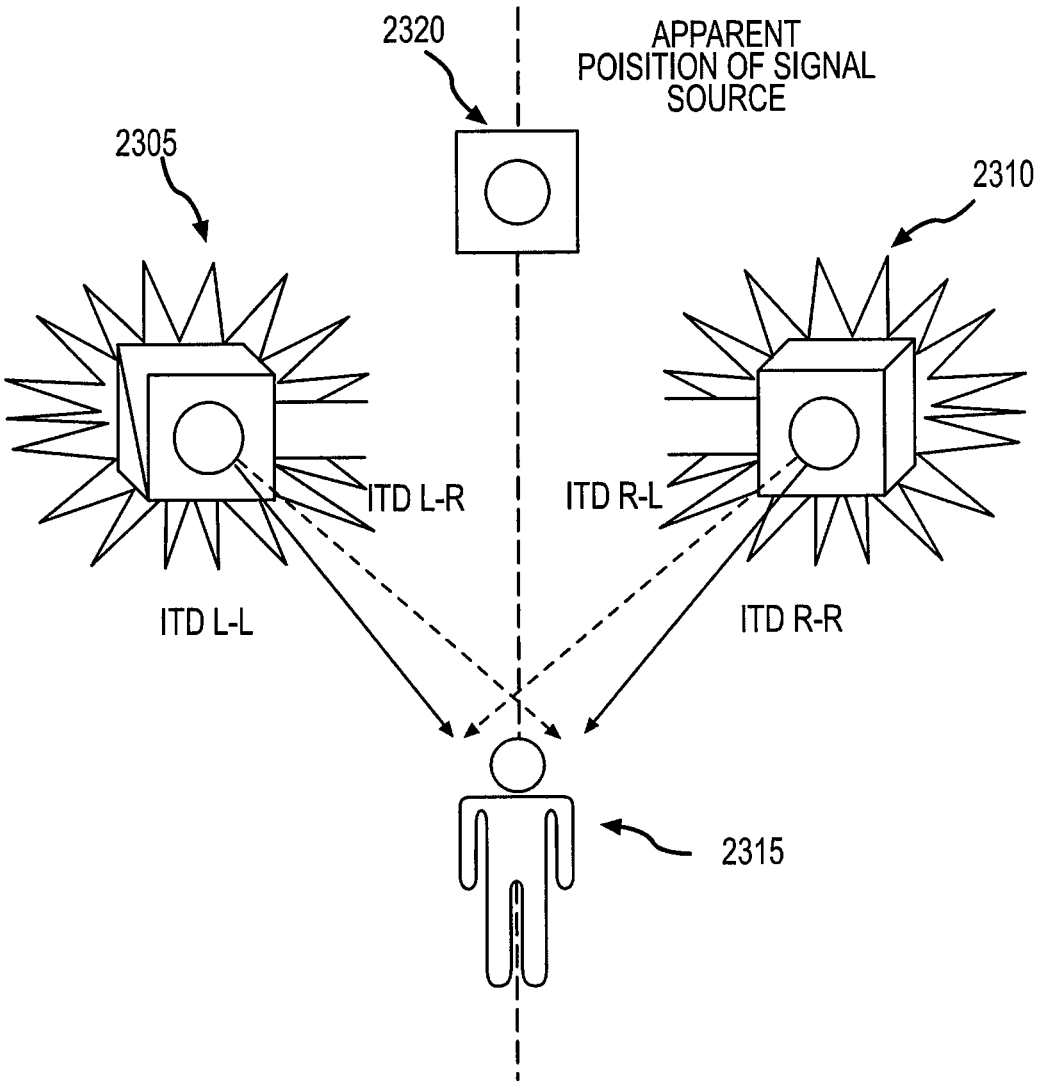
FIG. 17 illustrates the apparent position of a sound source when the left and right channels of a stereo signal are substantially identical.

FIG. 17 depicts a situation that may arise when the left and right channels of a stereo signal are substantially identical such as when a monaural signal is played through two virtual speakers 2305, 2310. Because the setup is symmetric with respect to the listener 2315, $$\text{ITD L-R}=\text{ITD R-L and ITD L-L}=\text{ITD R-R}$$

where ITD L-R is the ITD for the left channel to the right ear, ITD R-L is the ITD for the right channel to the left ear, ITD L-L is the ITD for the left channel to the left ear and ITD R-R is the ITD for the right channel to the right ear.

For a monaural signal played back over two symmetrically located virtual speakers 2305, 2310, as shown in FIG. 17, the ITDs generally sum up so that the virtual sound source appears to come from the center 2320.

Figure 18:
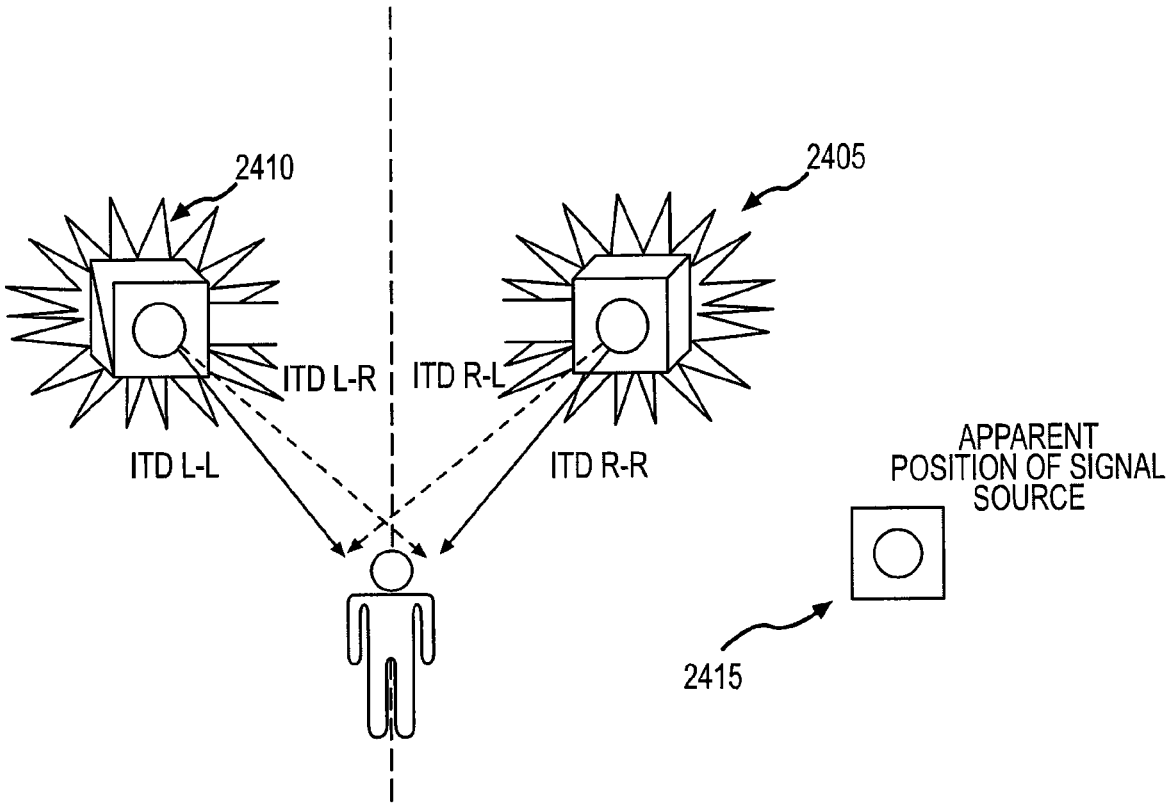
FIG. 18 illustrates the apparent position of a sound source when a signal appears only on the right channel.

Further, FIG. 18 shows a situation where a signal appears only on the right 2405 (or left 2410) channel. In such a situation, only the right (left) filter set and its ITD, ILD and phase and magnitude response will be applied to the signal, making the signal appear to come from a far right 2415 (far left) position outside the speaker field.

Figure 19:
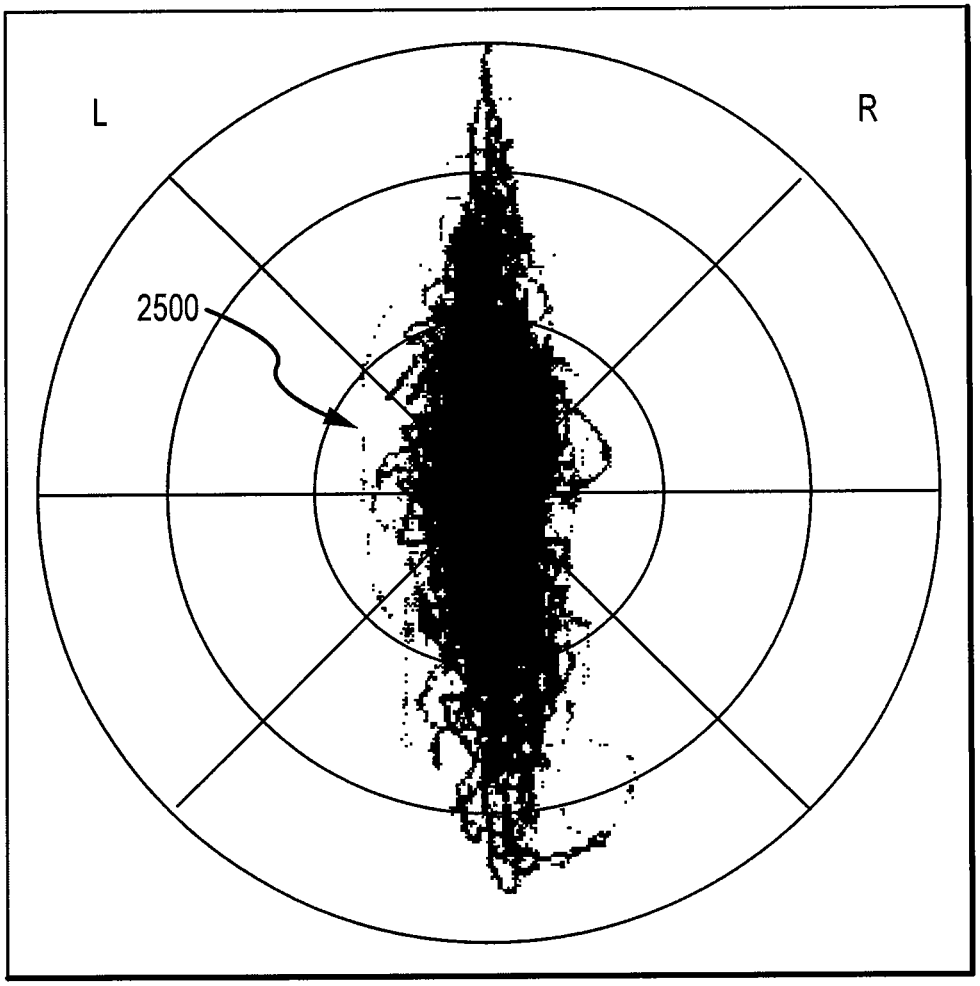
FIG. 19 depicts the Goniometer output of a typical stereo music signal showing the short term distribution of samples between the left and right channels.

Finally, when a stereo track is being processed, most of the energy will generally be located at the center of the stereo field 2500 as shown by FIG. 19. This generally means that for a stereo track with many instruments, most of the instruments will be panned to the center of the stereo image and only a few of the instruments will appear to be at the sides of the stereo image.

To make the localization more effective for a localized stereo signal played through two or more speakers, the sample distribution between the two stereo channels may be biased towards the edges of the stereo image. This effectively reduces all signals that are common to both channels by decorrelating the two input channels so that more of the input signal is localized by the binaural filters.

However, attenuating the center portion of the stereo image can introduce other issues. In particular, it may cause voice and lead instruments to be attenuated, creating an undesirable Karaoke-like effect. Some embodiments of the present disclosure may counteract this by band pass filtering a center signal to leave the voice and lead instruments virtually intact.

Figure 20:
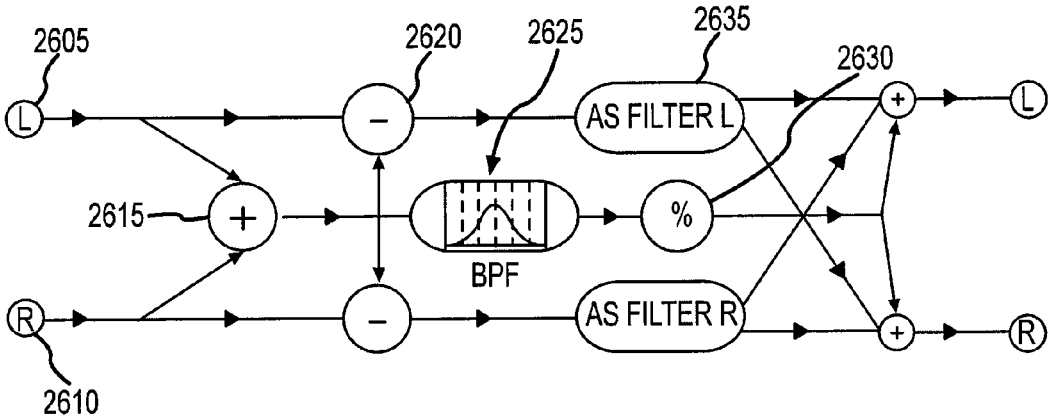
FIG. 20 depicts a signal routing for one embodiment of the present disclosure utilizing center signal band pass filtering.

FIG. 20 shows the signal routing for one embodiment of the present disclosure utilizing center signal band pass filtering. This may be incorporated into operation 525 of FIG. 5 by the embodiment.

Referring back to FIG. 5, the DSP processing mode may accept multiple input files or data streams to create multiple instances of DSP signal paths. The DSP processing mode for each signal path generally accepts a single stereo file or data stream as input, splits the input signal into its left and right channels, creates two instances of the DSP process, and assigns to one instance the left channel as a monaural signal and to the other instance the right channel as a monaural signal. FIG. 20 depicts the left instance 2605 and right instance 2610 within the processing mode.

The left instance 2605 of FIG. 20 contains all of the components depicted, but only has a signal present on the left channel. The right instance 2610 is similar to the left instance but only has a signal present on the right channel. In the case of the left instance, the signal is split with half going to the adder 2615 and half going to the left subtractor 2620. The adder 2615 produces a monaural signal of the center contribution of the stereo signal which is input to the band-pass filter 2625 where certain frequency ranges are allowed to pass through to the attenuator 2630. The center contribution may be combined with the left subtractor to produce only the left-most or left-only aspects of the stereo signal which are then processed by the left HRTF filter 2635 for localization. Finally the left localized signal is combined with the attenuated center contribution signal. Similar processing occurs for the right instance 2610.

The left and right instances may be combined into the final output. This may result in greater localization of the far left and far right sounds while retaining the presence the center contribution of the original signal.

In one embodiment, the band pass filter 2625 has a steepness of 12 dB/octave, a lower frequency cutoff of 300 Hz and an upper frequency cutoff of 2 kHz. Good results are generally produced when the percentage attenuation is between 20-40 percent. Other embodiments may use different settings for the band pass filter and/or different attenuation percentage.

7. Block Based Processing

In general, the audio input signal may be very long. Such a long input signal may be convolved with a binaural filter in the time domain to generate the localized stereo output. However, when a signal is processed digitally by some embodiments of the present disclosure, the input audio signal may be processed in blocks of audio data.

Figure 21:
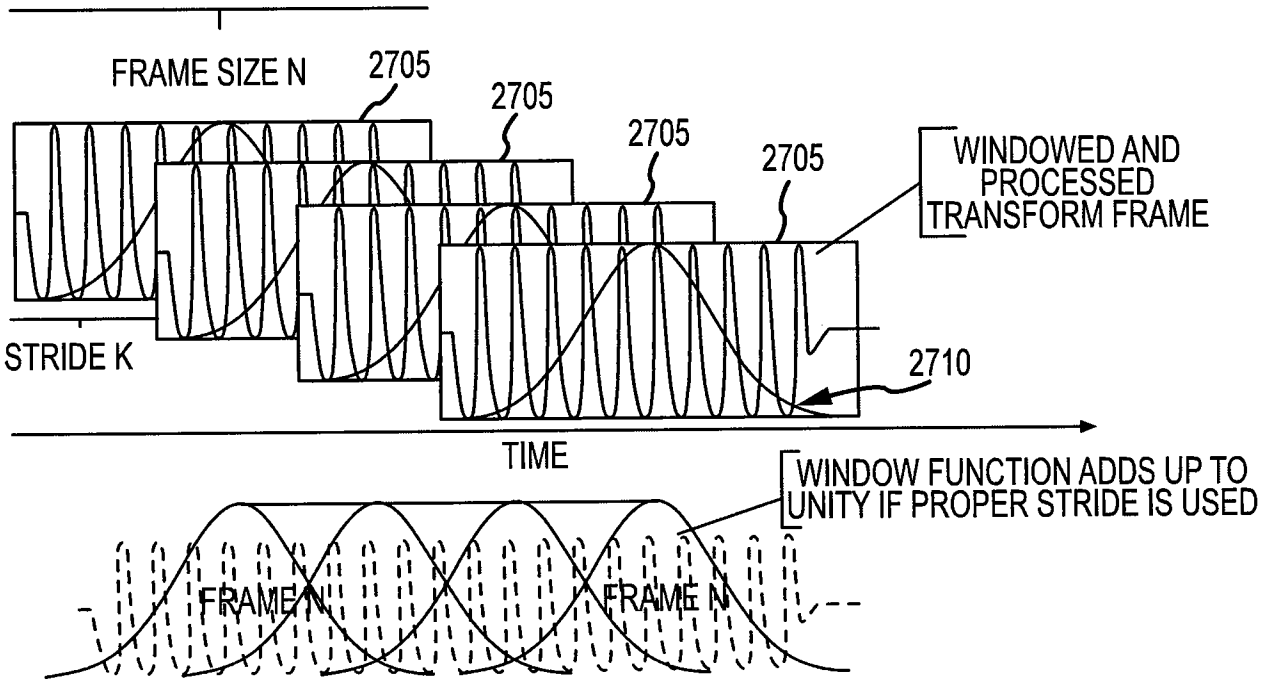
FIG. 21 illustrates how a long input signal is block processed using overlapping STFT frames.

The audio data may be processed in blocks 2705 such that the blocks overlap as shown in FIG. 21. Blocks are taken every k samples (called a stride of k samples), where k is an integer smaller than the transform frame size N. This results in adjacent blocks overlapping by the stride factor defined as (N-k)/N. Some embodiments may vary the stride factor.

The audio signal may be processed in overlapping blocks to minimize edge effects that result when a signal is cut off at the edges of the blocks. Various embodiments may apply a window 2710 (tapering function) to the data inside the block causing the data to gradually go to zero at the beginning and end of the block. One embodiment may use a Hann window as a tapering function.

The Hann window function is expressed mathematically as $$y=0.5-0.5\cos(2\pi t/N).$$

Other embodiments may employ other suitable windows such as, but not limited to, Hamming, Gauss, and Kaiser windows.

In order to create a seamless output from the individual blocks, the results from the processed blocks are added together using the same stride as previously used. This may be done using a technique called "overlap-save," where part of each block is stored to apply a cross-fade with the next frame. When a proper stride is used, the effect of the windowing function cancels out (i.e., sums up to unity) when the individual filtered blocks are strung together. This produces a glitch-free output from the individually filtered blocks. In one embodiment, a stride equal to 50% of the block size may be used, i.e., for a block size of 4096, the stride may be set to 2048. In this embodiment, each processed segment overlaps the previous segment by 50%. That is, the second half of block i may be added to the first half of block i+1 to create the final output signal. This generally results in a small amount of data being stored during signal processing to achieve the cross-fade between frames.

Generally, because a small amount of data may be stored to achieve the cross-fade, a slight latency (delay) between the input and output signals may occur. Because this delay is typically well below 20 ms and is generally the same for all processed channels, it generally has negligible effect on the processed signals. It should also be noted that data may be processed from a file, rather than being processed live, making such delay irrelevant.

Furthermore, block based processing may limit the number of parameter updates per second. In one embodiment of the present disclosure, each transform frame may be processed using a single set of HRTF filters. As such, no change in sound source position over the duration of the block occurs. This is generally not noticeable because the cross-fade between adjacent blocks also smoothly cross-fades between the renderings of two different sound source positions. Alternatively, the stride k may be increased until an overlap of 0 samples is reached, which creates a continuous output, or it may be reduced to create more overlap, but this increases the number of blocks processed per second.

In one embodiment an audio file unit may provide the input to the signal processing system. The audio file unit reads and converts (decodes) audio files to a stream of binary pulse code modulated ("PCM") data that vary proportionately with the pressure levels of the original sound. The final input data stream may be in IEEE754 floating point data format (i.e., sampled at 44.1 kHz and data values restricted to the range −1.0 to +1.0). This enables consistent precision across the whole processing chain. It should be noted that the audio files being processed are generally sampled at a constant rate. Other embodiments may utilize audio files encoded in other formats and/or sampled at different rates. Yet, other embodiments may process the input audio stream of data from a plug-in card such as a sound card in substantially real-time.

As discussed previously, one embodiment may utilize a HRTF filter set having 7,337 pre-defined filters. These filters may have coefficients that are 24 bits in length. The HRTF filter set may be changed into a new set of filters (i.e., the coefficients of the filters) by up-sampling, down-sampling, up-resolving or down-resolving to change the original 44.1 kHz, 24 bit format to any sample rate and/or resolution that may then be applied to an input audio waveform having a different sample rate and resolution (e.g., 88.2 kHz, 32 bit).

After processing of the audio data, the user may save the output to a file. The user may save the output as a single, internally mixed down stereo file, or may save each localized track as individual stereo files. The user may also choose the resulting file format (e.g., *.mp3, *.aif, *.au, *.wav, *.wma, etc.). The resulting localized stereo output may be played on conventional audio devices without any specialized equipment required to reproduce the localized stereo sound. Further, once stored, the file may be converted to standard CD audio for playback through a CD player. One example of a CD audio file format is the .CDA format. The file may also be converted to other formats including, but not limited to, DVD-Audio, HD Audio and VHS audio formats.

8. Embedded Processes

Embodiments of the present disclosure may be configured to provide DSP for audio spatialization in a variety of applications for the Consumer Electronics (CE) market. In particular, an embedded application provided according to the present disclosure within the audio chain of third party hardware, firmware, or operating system kernels can employ localization to two or more channels. Such an audio chain may be operating within a specialized DSP processor, or other standard or real-time embedded processor. For example, an embedded process can reside within the audio output chain of a variety of consumer electronic devices, which may include, but are not limited to, handheld media devices, cell phones, smart-phones, MP3 players, broadcast or streaming media devices, set-top boxes for satellite, cable, Internet, or broadcast video, streaming media servers for Internet broadcast, audio receiver/players, DVD/Blu-ray players, home, portable or automobile radio (analog or digital), home theater receiver or pre-amp, television, digital audio storage and playback devices, navigation and "infotainment" systems, automobile navigation and/or "infotainment" systems, handheld GPS units, input/output systems, external speakers, headphones, external, independent output signal modification device (i.e. a non-permanent, stand-alone device that resides between the playback source and the speaker or headphone system, containing the appropriate circuitry to support DSP processing), or microphones (mono, stereo, or multi-channel input). Other CE applications suitable for embedded DSP will be known to and appreciated by those skilled in the art, and such applications are intended to be within the scope of this disclosure.

Embedded DSP for audio spatialization may improve the capability of electronic hardware devices that capture, playback, and/or render audio. This capability may allow such devices to be intrinsically 3D audio capable or to otherwise emulate 3D audio, thereby potentially providing a realistic soundscape and better audio content clarity.

Provided below is a description of embedded processes for audio spatialization in several common CE system configurations. These include mono input to stereo output, multi-channel input to 2-channel output, multi-channel input to down-mix multi-channel output, multi-channel input to 3-channel output, 2-channel input to 3-channel output, stereo input to stereo output with a localized center channel, 2-channel LtRt (Left Total/Right Total) to virtual multi-channel stereo output (in two alternate configurations), and 2-channel input to up-mixed 5.1 multi-channel output. Such system configurations are intended to be exemplary in nature, and those skilled in the art will be able to make various modifications to allow for audio spatialization in any system configuration based on the following disclosure.

With regard to the Figures accompanying each embedded process described below (i.e., FIGS. 22, 24, 26, 28, 30, 32*a*, 32*b*, 36 and 38), the arrows depicted therein representing the flow of various types of information are intended to be broadly illustrative in nature, such that the lack of an exact connection between arrows does not mean a discontinuous flow of information (for example, with regard to FIG. 22, although the arrow connecting the external operations 3000 through 3020*b* to the process 3025 does not exactly connect with the arrows leading into operations 3030*a* and 3030*b*, no discontinuity of information flow is intended thereby). Furthermore, the use of various symbols (e.g. bars, diamonds, circles, etc.) within the Figures wherein information is combined into a single flow or separated into more than one flow are also intended to be broadly illustrative in nature, such the one particular symbol does not necessarily represent to function of a like symbol in the same Figure, or in other Figures (for example, with further regard to FIG. 22, the bar symbol is used to indicate both the separation of information flow (e.g., into operation 3030*a* and 3030*b*) and to indicate the combination of information flow (e.g., into operation 3035)). Thus, Applicants do not intend that any Figures presented herein should necessarily conform to any particular convention or style of representation, but rather are intended to broadly illustrate certain aspects of the present disclosure.

A. Mono Input to Stereo Output

An embedded process for mono signal localization in accordance with the present disclosure receives a single input mono signal and associated DSP parameters, based on some type of event cue that is external to the spatialization process. In general, these events are automatically generated by other processes due to some external stimulus, but can be human initiated through some human-machine interface. For example, mono signal localization processes have direct application for alerts, notifications, and effects in event simulators and automobile "infotainment" and navigation systems. Further applications may include responses to human game-play input within the hardware or gaming software of computer and console video gaming systems.

Mono signal localization processes can support multiple, independent, mono input signals. The output may be synchronized by taking multiple input buffers (one for each sound source), each of a common fixed frame length, serially processing each input buffer, and then mixing the resultant signals together into a single output buffer by summing the input signals together. This process may be represented by the following equations:

$$\text{OutputBufferLeft}=\Sigma(\text{InputBufferLeft}[i]*\text{gain}[i]);$$

$$\text{OutputBufferRight}\mathbf{32}\ \Sigma(\text{InputBufferRight}[i]*\text{gain}[i]);$$

where i represents each localized mono sound source. It will be appreciated that the actual number of simultaneous input signals to be mixed is a factor of processor speed.

As previously disclosed, the DSP parameters specifically contain certain azimuth [0°, 359°], elevation [90°, −90°], and distance cue data [0, 100] (where 0 results in a sound perceived in the center of the head, and 100 is arbitrarily distant) to be applied to the resultant localized signal. These parameter values can be submitted to the process in real time, at any arbitrary rate, and thus result in an audible sense of movement (e.g., the 4D effect as described above).

Figure 22:
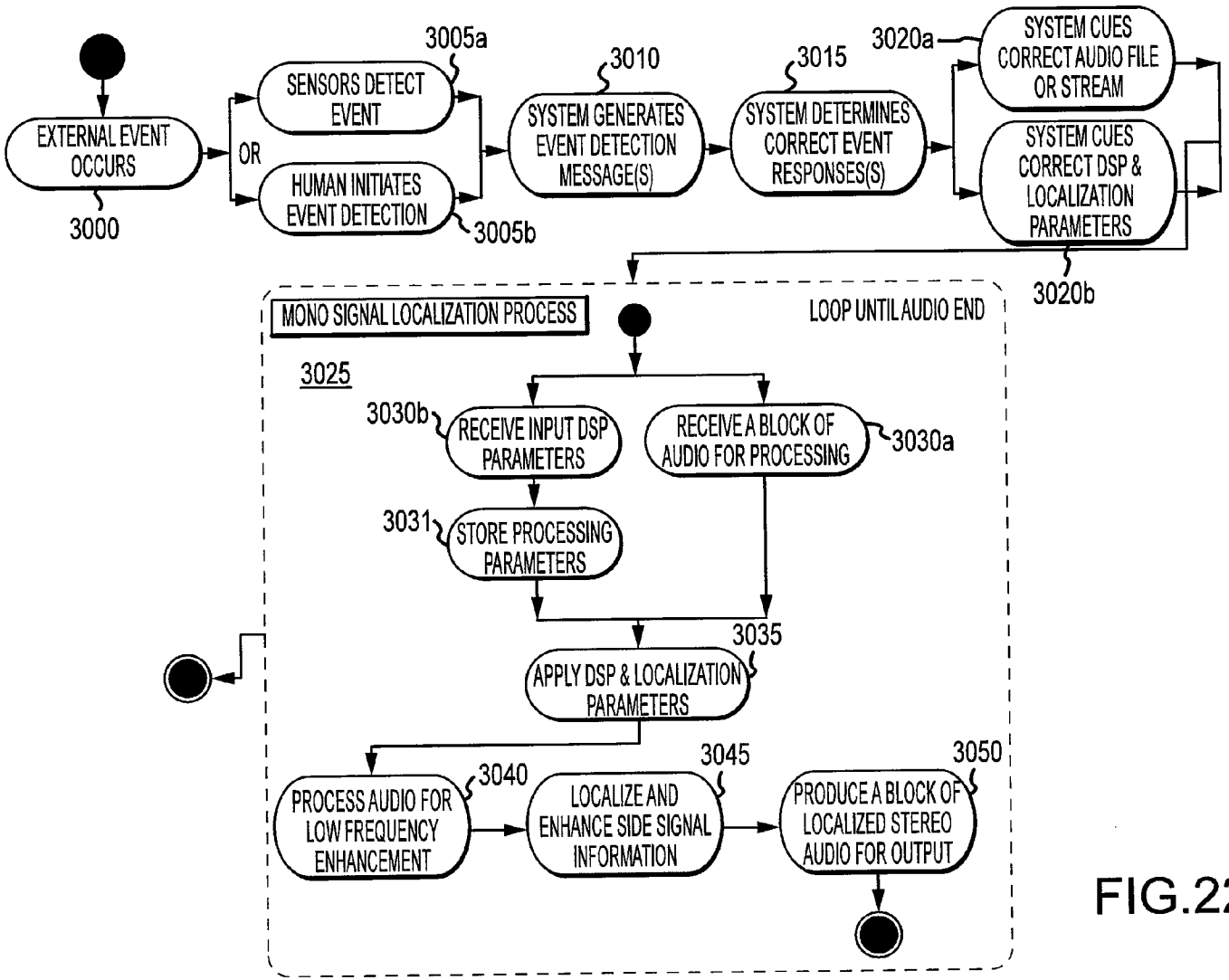
FIG. 22 illustrates a mono signal input to stereo output localization process.

FIG. 22 illustrates one embodiment of a process flow for mono signal localization in accordance with the present disclosure. Prior to localization, an external event occurs 3000, which may be detected by sensors 3005*a* or by a human initiated action 3005*b*. At this point, the system may generate an event detection message 3010, and thereafter determine a correct event response 3015. Such response may include the system cueing a correct audio file or stream 3020*a*, and it may also include the system cueing correct DSP and localization parameters 3020*b*. Of course, other responses are possible. As shown in FIG. 22, the operations 3000 through 3020(*a*, b) occur prior and external to the mono signal localization process 325.

Once the correct audio file or stream and correct DSP and localization parameters have been cued, the following operations may be performed to localize the mono signal (325). For the audio file or stream that has been cued, the process receives an input buffer of audio having a fixed frame size 3030*a*; for the DSP and localization parameters that have been cued, the process receives such parameters 3030*b* and stores them for processing 3031. Thereafter, the DSP and localization parameters are applied at operation 3035, including azimuth and elevation input parameters from operation 3030*b* to look up and retrieve the correct IIR filter. The audio may be processed for low frequency enhancement using a low pass filter, LFE gain and EQ at operation 3040. At operation 3045, the filters from operation 3035 and the distance and reverb input values are used to apply the processing method's localization effect, as previously described, and to apply room simulation reverb and multiple bands of parametric EQ to correct for any tone colorization. Finally, at operation 3050, the output buffer is populated with the processed signal and the audio buffer is returned to the external process.

Figure 23:
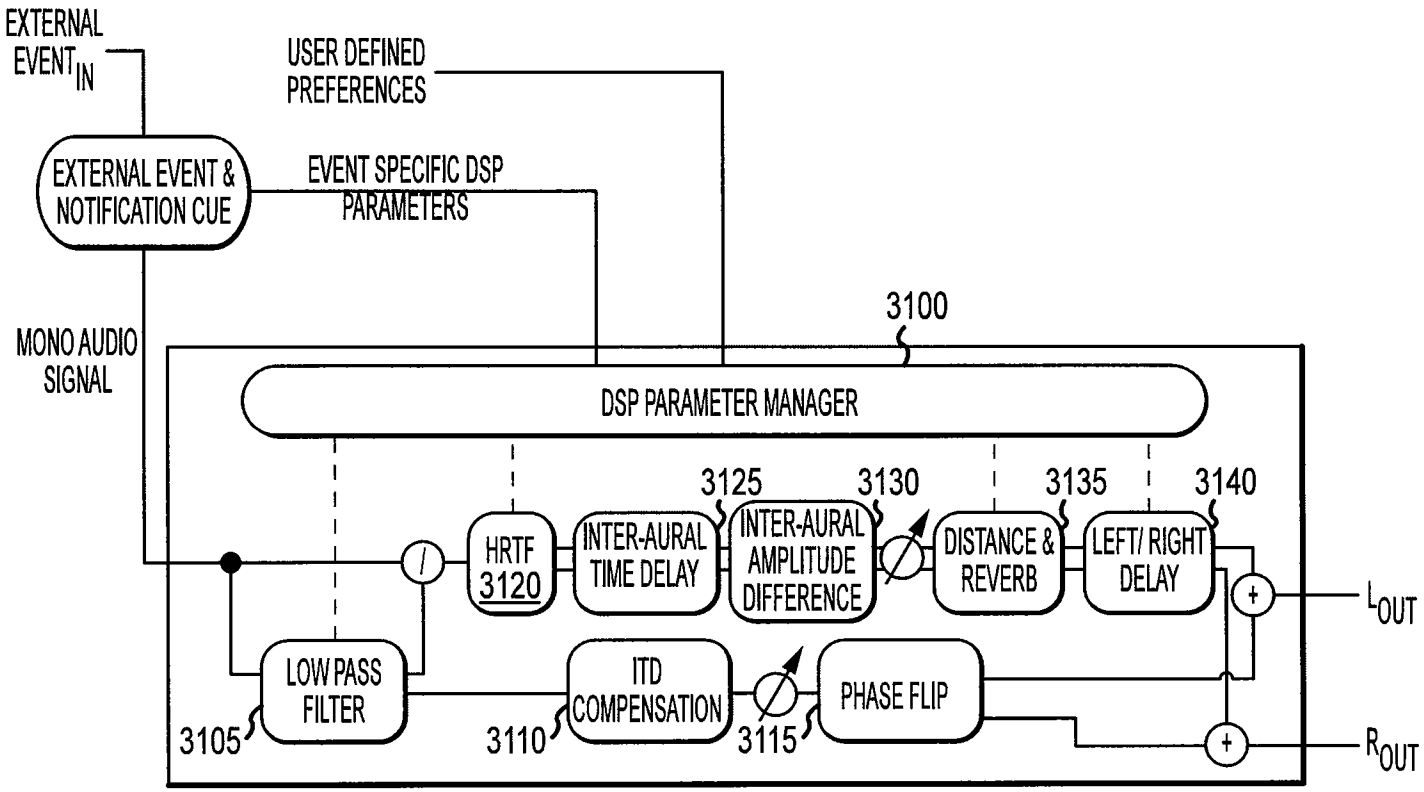
FIG. 23 is a wiring diagram configured for use with the mono signal input to stereo output localization process shown in FIG. 22.

FIG. 23 shows an example wiring diagram of components configured for use with the process described above in FIG. 22. The DSP Parameter Manager 3100 is the component that performs operations 3030(*a,b*) through 3035. The Low Pass Filter 3105, ITD Compensation 3110, and Phase Flip 3115 components perform operation 3040. With regard to operation 3045, the HRTF component 3120 directly applies the appropriate IIR filter, while the Inter-Aural Time Delay 3125 and Inter-Aural Amplitude Difference 3130 components apply the necessary left-ear/right-ear timing information to complete the localization effect. The final aspect of operation 3040 is applied by the Distance component 3135, which applies signal attenuation for distance and reverb for realistic room simulation (or free field). The Left/Right Delay component 3140 is an optional component to apply a left-right bias to the signal for certain applications, such as the desire to center the audio on the driver or passenger in an automobile audio application.

B. Multi-channel Input to 2-Channel Output

An embedded process for localized multi-channel input to a down-mixed 2-channel output in accordance with the present disclosure receives a set of discrete multi-channel mono audio signals as input, in addition to a virtual multi-channel configuration specification. This process may be applied to any multi-channel input, including but not limited to 2.1, 3.1, 4.0, 5.1, 6.1, 7.1, 10.2, etc. As such, the process supports any multi-channel configuration with a minimum of 2.1-channel input.

While any multi-channel input may be used, the present disclosure will use, for exemplary purposes only, a standard 5.1 input (left-front, right-front, center, left-surround, right-surround and low frequency effect) as the representative multi-channel source. The configuration specification affects which pair of channels (front pair or rear pair, or both) has the localization effect applied. In all configurations, the center and LFE signals are split and summed into the front pair, with a separate gain stage applied to each. If a stereo signal is present in the front pair, Mid-Side Decoding (for a detailed explanation of the Mid-Side Decode process, see the detailed description thereof provided below in subsection G) can be applied to isolate the phantom center signal and sum it into the front signal pair.

A particular application of the presently described multi-channel input to 2-channel output process is in multi-channel music and movie output, such as may be found in computers, TVs, and other CE devices where a multi-channel signal can be received as input, but the device itself only contains one stereo pair of speakers for output. Another example of an application is in specialized multi-channel microphone input, where the desired output is 2-channel virtual multi-channel.

With respect to the 5.1 multi-channel input example, the ITU 775 Surround Sound Standard for front pair and rear pair (physical) location angles can be preconfigured as virtual azimuth and elevation localization presets. ITU 775 specifies the front pair of signals to have angle of 22.5 to 30 degrees relative to forward facing center, and the rear pair of signals to have an angle of 110 degrees relative to front facing center. While ITU 775 can be used, this is not a restriction and any arbitrary localization angles can be applied.

In one configuration, the front pair of signals pass through unmodified, while the rear pair is localized. In another configuration, the front pair of signals is localized, while the rear pair of signals is left unmodified. In yet another configuration, both the front and rear signal pairs are localized. In such a configuration it may be desirable to increase the angular spread of one pair relative to the other, so that each pair audibly compliments the other. A combination of these configurations may be extended accordingly, based on the actual number of channels in the multi-channel source.

Figure 24:
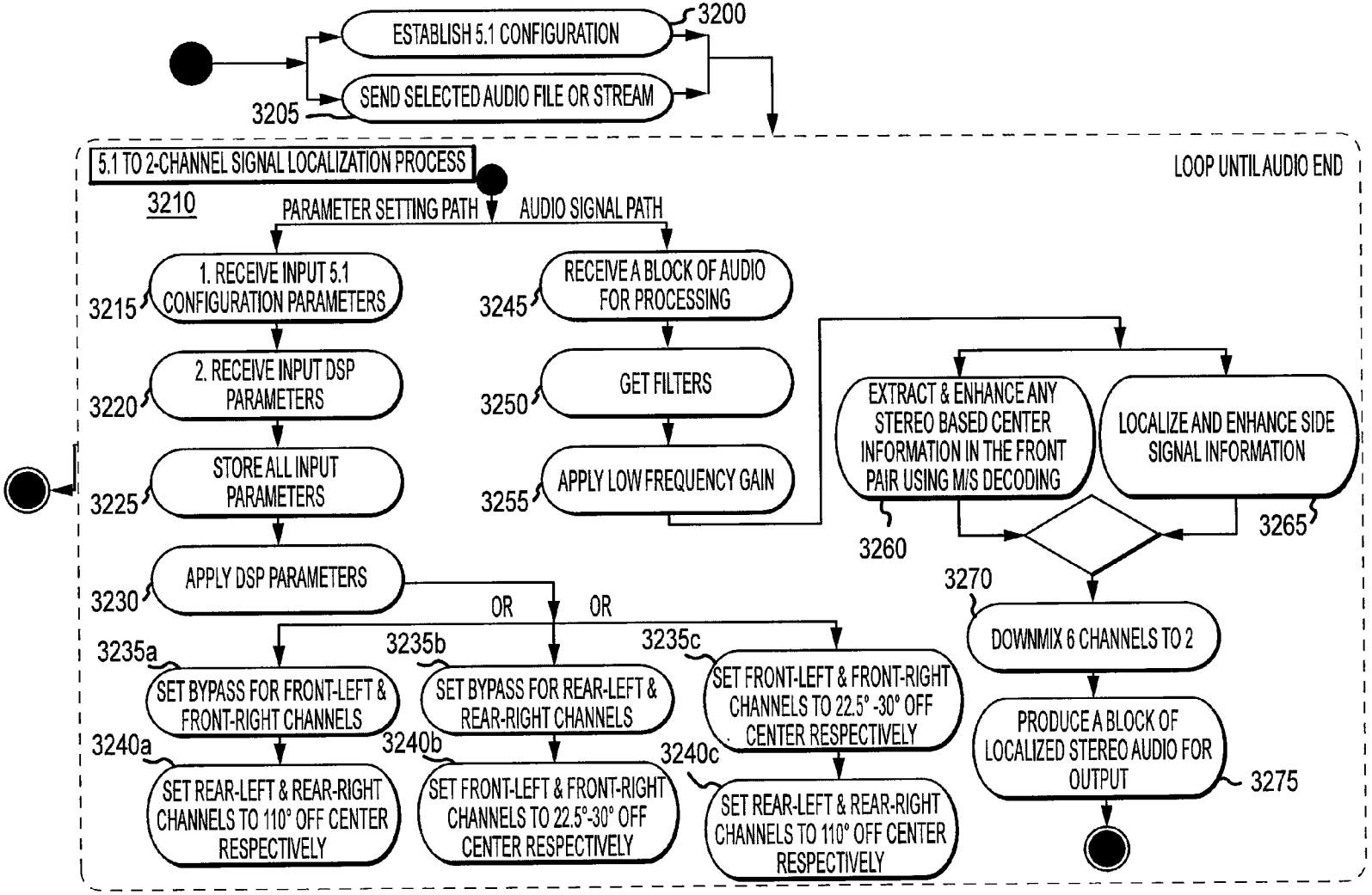
FIG. 24 illustrates a multi-channel input to 2-channel output localization process.

FIG. 24 illustrates one embodiment of a process flow for 2-channel signal localization in accordance with the present disclosure, using 5.1 input as an example. As shown in FIG. 24 the operations of establishing the 5.1 (or other input) configuration 3200 and sending a selected audio file or stream 3205 occur prior and external to the 2-channel signal localization process 3210.

The 2-channel signal localization process begins, in a parameter setting path, with an operation of receiving multi-channel configuration input parameters from the external process 3215. DSP input parameters are also received from the external process 3220. Parameters from operations 3215 and 3220 are stored for processing 3225. Thereafter, all non-localization DSP parameters are set 3230 for processing, such as gains, EQ values, etc.

Alternative operations 3235*a*, 3235*b*, and 3235*c* use the multi-channel configuration to bypass localization for either the front stereo pair (resulting in rear localization only) or the rear stereo pair (resulting in front localization only), or the azimuth localization parameters for the front stereo pair are set. In this example, if step 3235*c* is executed, the front pair azimuth values are set to standard ITU 775 values.

Alternative operations 3240*a*, 3240*b*, and 3240 correspond to and compliment operations 3235*a*, 3235*b*, and 3235*c*, respectively, by using the multi-channel configuration to complete the associated azimuth parameter settings for localization. In this example, if operation 3235*a* is executed, then it is followed by operation 3240*a*, where the rear stereo pair azimuth values are set to standard ITU 775 values. The 3235*b*/3240*b* path and the 3235*c*/3240*c* path similarly set the azimuth parameters for localization, again using ITU 775 angles as an example.

With reference now to the audio signal path of process 3210, operation 3245 includes receiving an input buffer of audio, with a fixed frame size, from the external process. At procedure 3250, the azimuth and elevation input parameters are used to look up and retrieve the correct IIR filters. Thereafter, low frequency enhancement is applied 3255 by using a low pass filter, LFE gain and EQ. If the front stereo pair contains a phantom center channel, it may be extracted at operation 3260 by means of a Mid-Side Decode process.

At operation 3265, the filters from operation 3250 and the distance and reverb input values are used to apply the processing method's localization effect, thereby producing resultant stereo signals, and to apply room simulation reverb and multiple bands of parametric EQ to correct for any tone colorization.

Finally, at operation 3270, the localized fronts, localized rears, center and LFE signals may be down-mixed by summing into a resultant stereo pair. The output stereo buffer is thereafter populated with the processed signals at operation 3275, and the audio buffer is returned to the external process.

Figure 25:
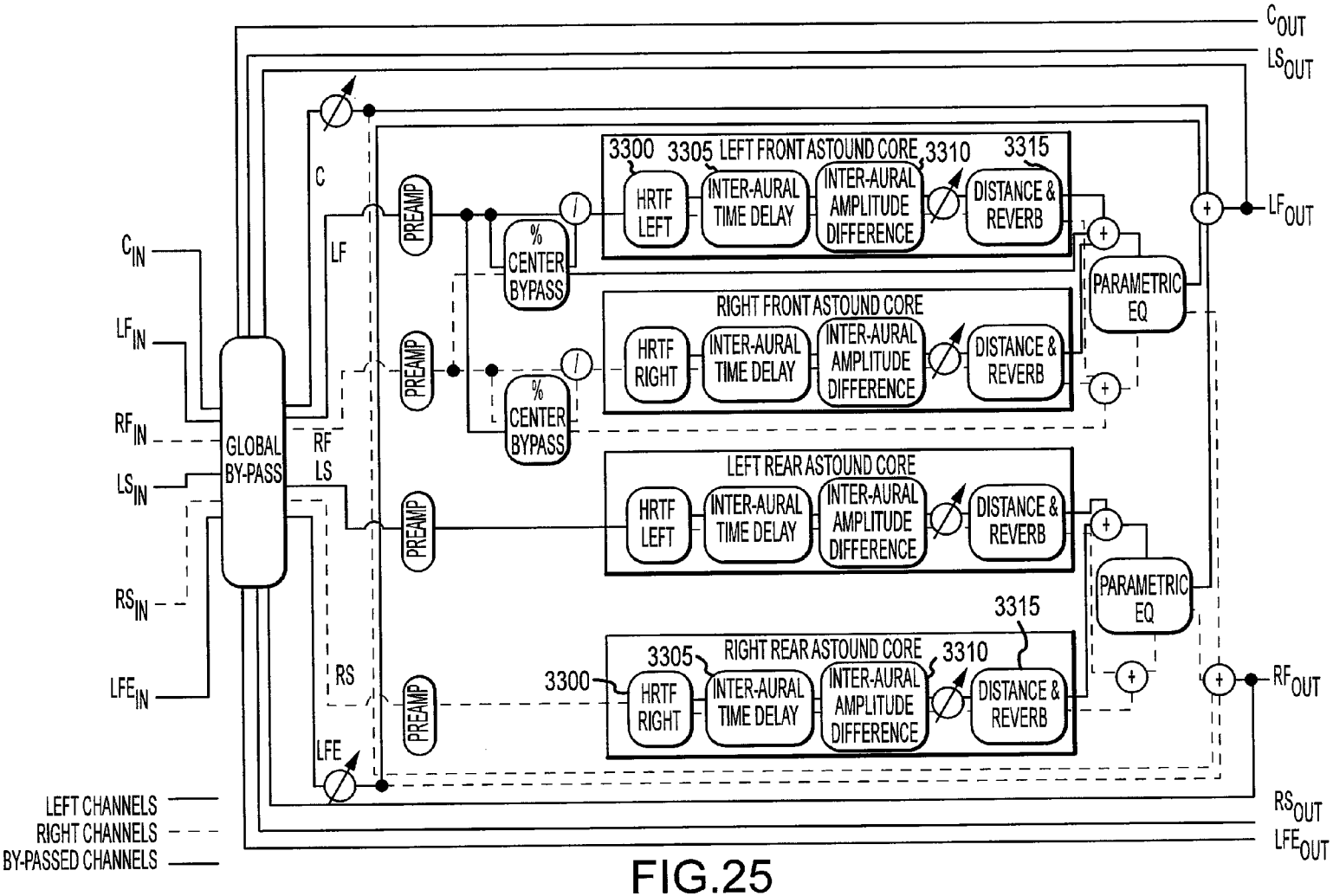
FIG. 25 is a wiring diagram configured for use with the multi-channel input to 2-channel output localization process shown in FIG. 24.

FIG. 25 shows an example wiring diagram of components configured for use with the procedure described above in FIG. 24. (With regard to the percent-center bypass operation, a detailed description thereof is provided below in subsection G). The HRTF 3300, Inter-Aural Time Delay 3305, and Inter-Aural Amplitude Difference 3310, and Distance and Reverb 3315 components (in each channel shown) perform functions as described above with regard to FIG. 23, and comprise the component utilized to perform 2-channel localization process, as described above. There are two such sets of components for front left and right localization, and two for left and right rear localization.

The components used to perform 2-channel localization processes for any set of two (2) localizations can also be applied to any mono input signal. For example, in addition or alternatively to applying any of the before mentioned 2-channel localization processes to a left-front, right-front, left-rear and/or right-rear signal, it may be configured, in one or more embodiments, to provide localization to a center channel signal. It is to be appreciated that such center channel signal may be a true center channel input, as is often provided in a multi-channel input stream, or derived from an M-S decode or other center channel decoding algorithm. Similarly, the before-mentioned 2-channel localization processes may be applied to any input signal, regardless of configuration. For example, discrete input signal localization can be applied, using in at least one embodiment the components of FIGS. 25, to 7.1, 10.2 and other multi-channel input configurations as needed and/or desired.

C. Multi-channel Input to 3-Channel Output

An embedded process for multi-channel input to 3-channel (left, center and right, or LCR) output in accordance with the present disclosure receives a set of discrete multi-channel mono audio signals as input, in addition to a virtual multi-channel configuration specification. This process may be applied to any multi-channel input, including but not limited to 3.0, 3.1, 4.0, 5.1, 6.1, 7.1, 10.2, etc. Thus, the process supports any multi-channel configuration with a minimum of 3-channel input. This process is similar to the multi-channel input to 2-channel output process previously described in sub-section B, above. Differences between the 2-channel and the 3-channel configurations include that there is no Percent-Center Bypass (see the detailed description thereof provided below in subsection G) applied to the left-front and right-front signals, and the input center channel is routed directly to the output center channel, with gain applied.

For exemplary purposes, the present disclosure will again employ a standard 5.1 input (left-front, right-front, center, left-surround, right-surround and low frequency effect) as the representative multi-channel source. Given a set of discrete mono audio signals in a standard 5.1 setup (left-front, right-front, center, left-surround, right-surround and low frequency effect) as input, a virtual 5.1 output with actual center channel output may be created. This variant enables independent localization of the signal pairs (e.g. left/right front or rear pairs) with minimal phase. This type of localization is extendable to any number of multi-channel inputs. As with the previous 2-channel example, the azimuth localization parameters are set to standard ITU 775 values, but this is not a requirement for this process; it is only used as an example.

The 3-channel variant has application in any embedded solution where a virtual multi-channel effect is desired, and a (third) physical center channel is available for output. The effect is a well-defined and balanced output, even outside the traditional stereo speaker field (i.e. a greatly expanded sweet spot is achieved).

As with the multi-channel input to 2-channel output described previously, the combination of various signal localization configurations may be extended accordingly, based on the actual number of channels in the multi-channel source.

Figure 26:
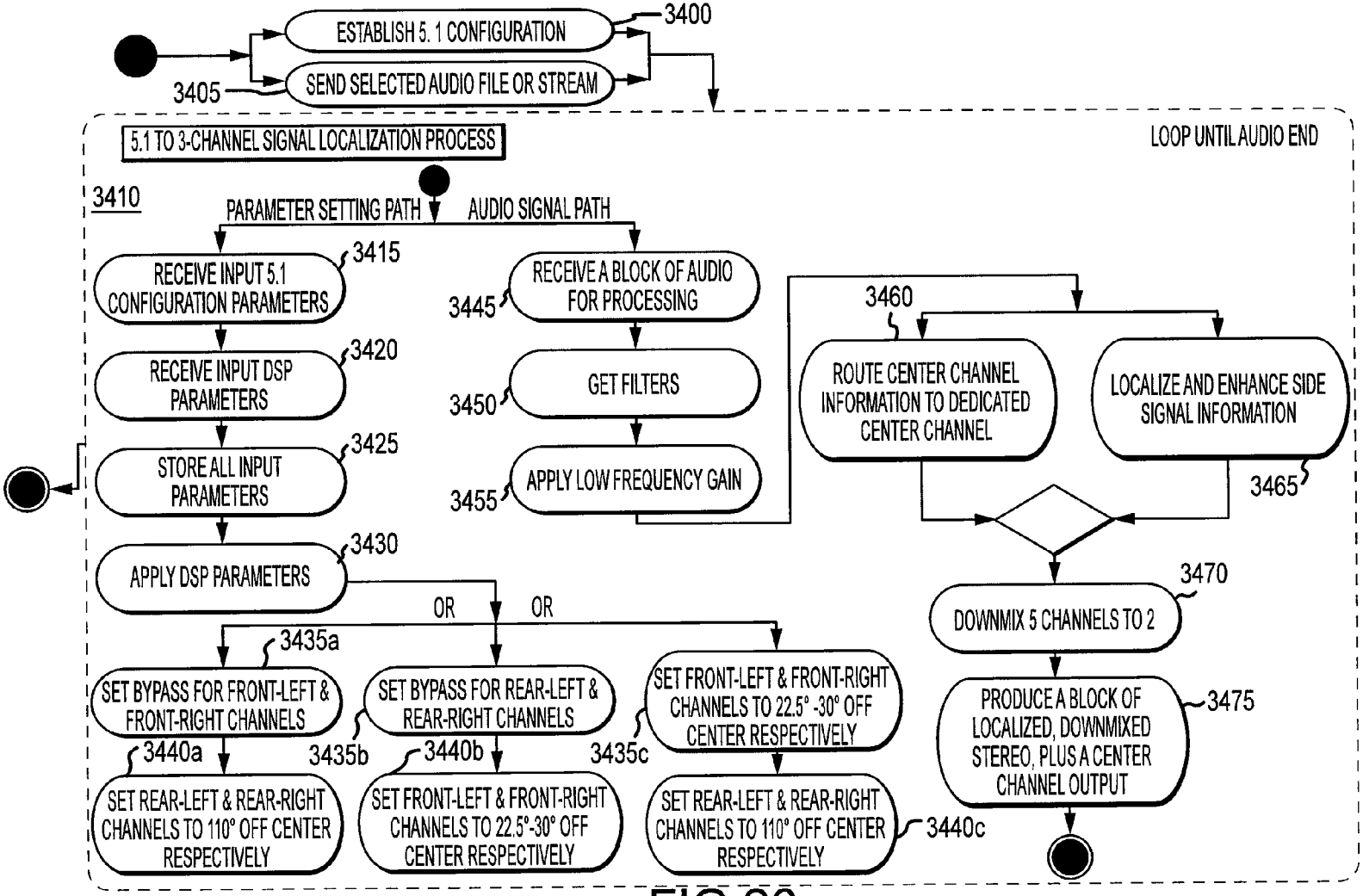
FIG. 26 illustrates a multi-channel input to 3-channel output localization process.

FIG. 26 illustrates one embodiment of a process flow for 3-channel signal localization in accordance with the present disclosure, using 5.1 input as an example. As shown in FIG. 26 the operations of establishing the 5.1 (or other input) configuration 3400 and sending a selected audio file or stream 3405 occur prior and external to the 3-channel signal localization process 3410.

The 3-channel signal localization process begins, in a parameter setting path, with an operation of receiving multi-channel configuration input parameters from the external process 3415. DSP input parameters are also received from the external process 3420. Parameters from operations 3415 and 3420 are stored for processing 3425. Thereafter, all non-localization DSP parameters are set 3430 for processing, such as gains, EQ values, etc.

Alternative operations 3435*a*, 3435*b*, and 3435*c* use the multi-channel configuration to bypass localization for either the front stereo pair (resulting in rear localization only) or the rear stereo pair (resulting in front localization only), or the azimuth localization parameters for the front stereo pair are set. In this example, if step 3435*c* is executed, the front pair azimuth values are set to standard ITU 775 values.

Alternative operations 3440*a*, 3440*b*, and 3440 correspond to and compliment operations 3435*a*, 3435*b*, and 3435*c*, respectively, by using the multi-channel configuration to complete the associated azimuth parameter settings for localization. In this example, if operation 3435*a* is executed, then it is followed by operation 3440*a*, where the rear stereo pair azimuth values are set to standard ITU 775 values. The 3435*b*/3440*b* path and the 3435*c*/3440*c* path similarly set the azimuth parameters for localization, again using ITU 775 angles as an example.

With reference now to the audio signal path of process 3410, operation 3445 includes receiving an input buffer of audio, with a fixed frame size, from the external process. At procedure 3450, the azimuth and elevation input parameters are used to look up and retrieve the correct IIR filters. Thereafter, low frequency enhancement is applied 3455 by using a low pass filter, LFE gain and EQ.

Because the input signal contains a dedicated center channel, operation 3460 includes routing the input center channel to the output channel, and applying gain values set in operation 3430. The filters from operation 3450 and the distance and reverb input values are used to apply the processing procedure's localization effect, producing resultant stereo signals, and to apply room simulation reverb and multiple bands of parametric EQ to correct for any tone colorization (Operation 3465).

Finally, at operation 3470, the localized fronts, localized rears, center and LFE signals may be down-mixed by summing into a resultant stereo pair. The output stereo buffer and the center channel output mono buffer are is thereafter populated with the processed signals at operation 3475, and the audio buffer is returned to the external process.

Figure 27:
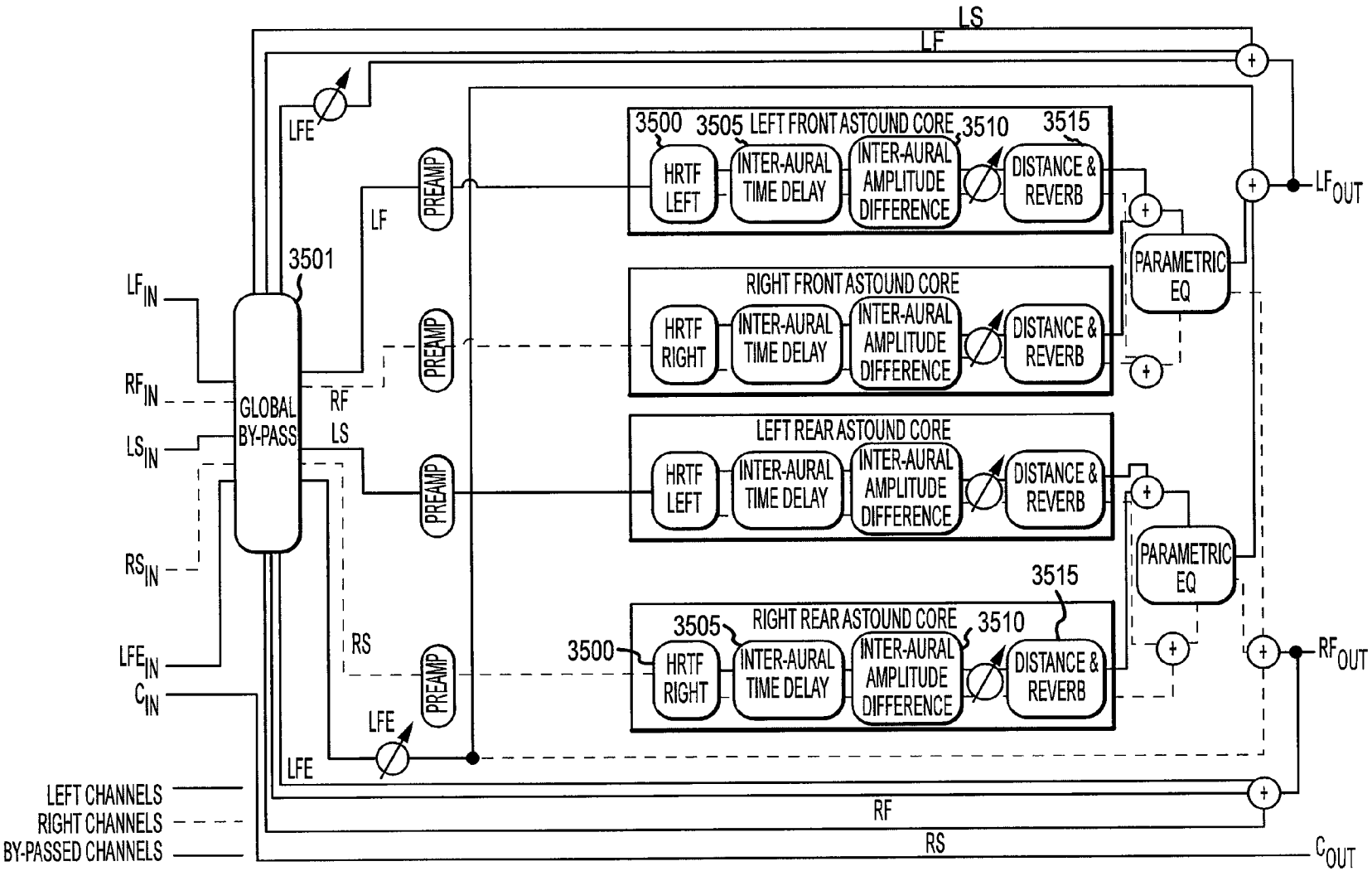
FIG. 27 is a wiring diagram configured for use with the multi-channel input to 3-channel output localization process shown in FIG. 26.

FIG. 27 shows an example wiring diagram of components configured for use with the process described above in FIG. 26. The HRTF 3500, Inter-Aural Time Delay 3505, and Inter-Aural Amplitude Difference 3510, and Distance and Reverb 3515 components (in each channel shown) perform functions as described above with regard to FIG. 23, and comprise the component utilized to perform 3-channel localization process, as described above. There are two such sets of components for front left and right localization, and two for left and right rear localization. Note, however, that as compared to FIG. 25, the center channel (Cin,out) is not connected through the center bypass 3501.

D. 2-Channel Input to 3-Channel Output

An embedded process for 2-channel input to 3-channel (left, center and right, or LCR) output in accordance with the present disclosure receives a stereo signal as input and creates a stereo expanded output with realistic center channel output. Two unique aspects of this configuration are stereo expansion with minimal phase, and a non-smeared center signal. The true mono center signal is obtained by summing the left and right signals. However, a certain amount of center information, so-called phantom center, is present in the expanded side signal. Mid-Side Decoding (see the detailed description thereof provided below in subsection G) is used to separate the phantom center from the side signal. The true mono center is subtracted from the isolated mid signal, thus leaving a clear center signal that is not smeared by stereo expansion.

This configuration has application in any embedded solution where expansion of a stereo input signal is desired, and a (third) physical center channel is available for output. The effect is a well-defined and balanced output, even outside the traditional stereo speaker field (i.e., a greatly expanded "sweet spot," as described above, is achieved).

Figure 28:
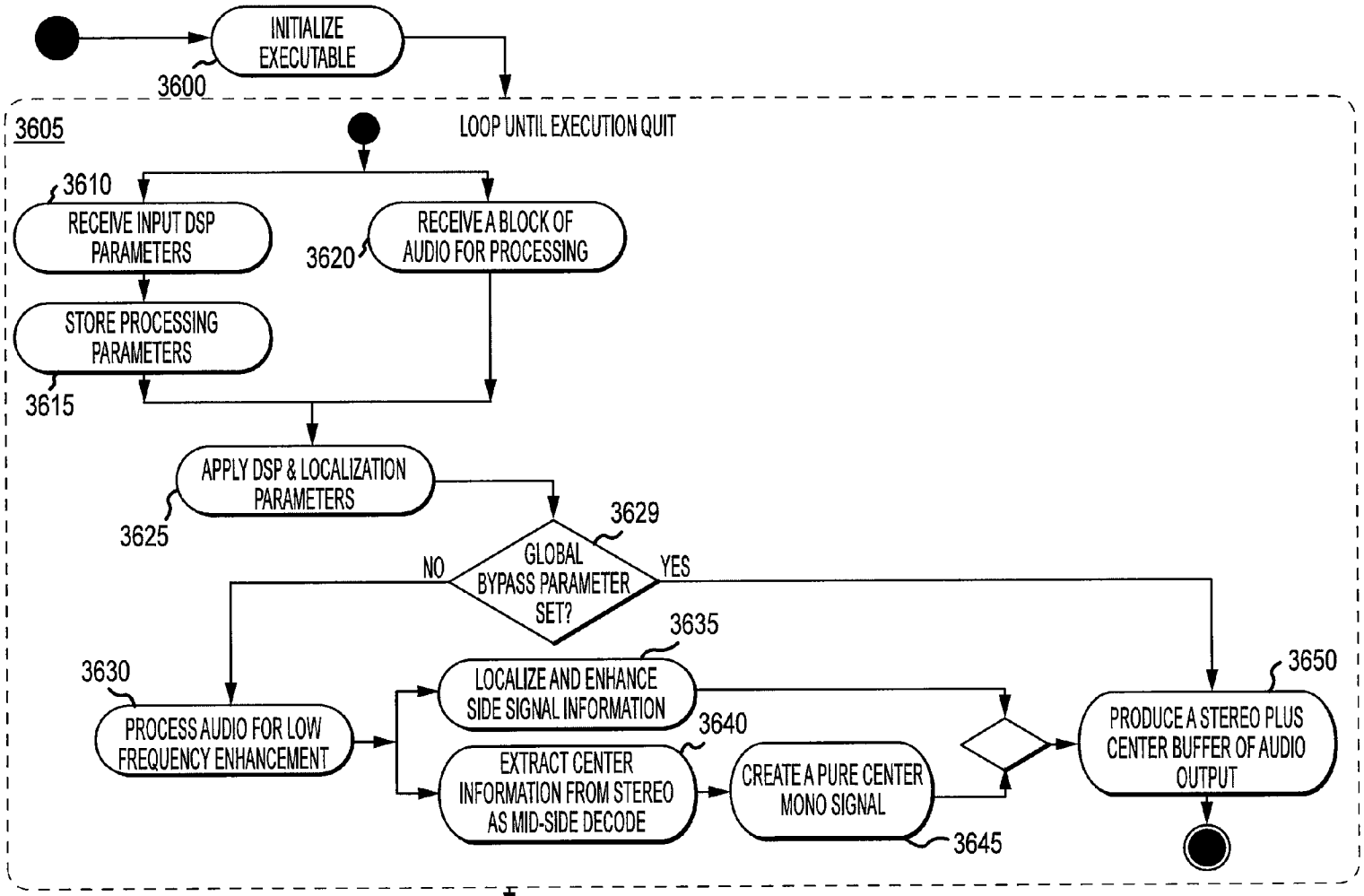
FIG. 28 illustrates a 2-channel input to 3-channel output localization process.

FIG. 28 illustrates one embodiment of a process flow for stereo input to three channel output in accordance with the present disclosure. As shown in FIG. 28 the operation of initializing an executable file 3600 occurs prior and external to the stereo to 3-channel signal localization process 3605.

The signal localization process begins with receiving the input parameters from the external process (Operation 3610), and receiving an input buffer of audio, with a fixed frame size, from the external process (Operation 3620). The input parameters are stored for processing (Operation 3615). At operation 3625, the azimuth and elevation input parameters from operation 3610 may be used to look up and retrieve the correct IIR filter.

Where a global bypass parameter has not been set (decision block 3629), a low frequency enhancement may be applied at operation 3630 by using a low pass filter, LFE gain and EQ. Thereafter, the filters from operation 3625 and the distance and reverb input values may be used to apply the processing method's localization effect, producing a resultant stereo signal, and to apply room simulation reverb and multiple bands of parametric EQ to correct for any tone colorization. Simultaneously, a phantom center channel may be extracted from the front stereo pair by means of a Mid-Side Decode process 3640 (see the detailed description thereof provided below in subsection G). Thereafter, at operation 3645, a center mono channel may be created by summing the right and left input signals (and dividing by 2), subtracting this mono signal from the phantom center extracted in 3640, and route it to the dedicated output center channel, applying a pre-amp gain value set in operation 3615. At operation 3650, the left and right signals may be summed together. One or more output buffers may be populated with the processed stereo signal and with the mono center signal, and the audio buffers may be returned to the external process.

Where a global bypass parameter has been set (decision block 3629), the process proceeds directly from operation 3625 to operation 3650, described above.

Figure 29:
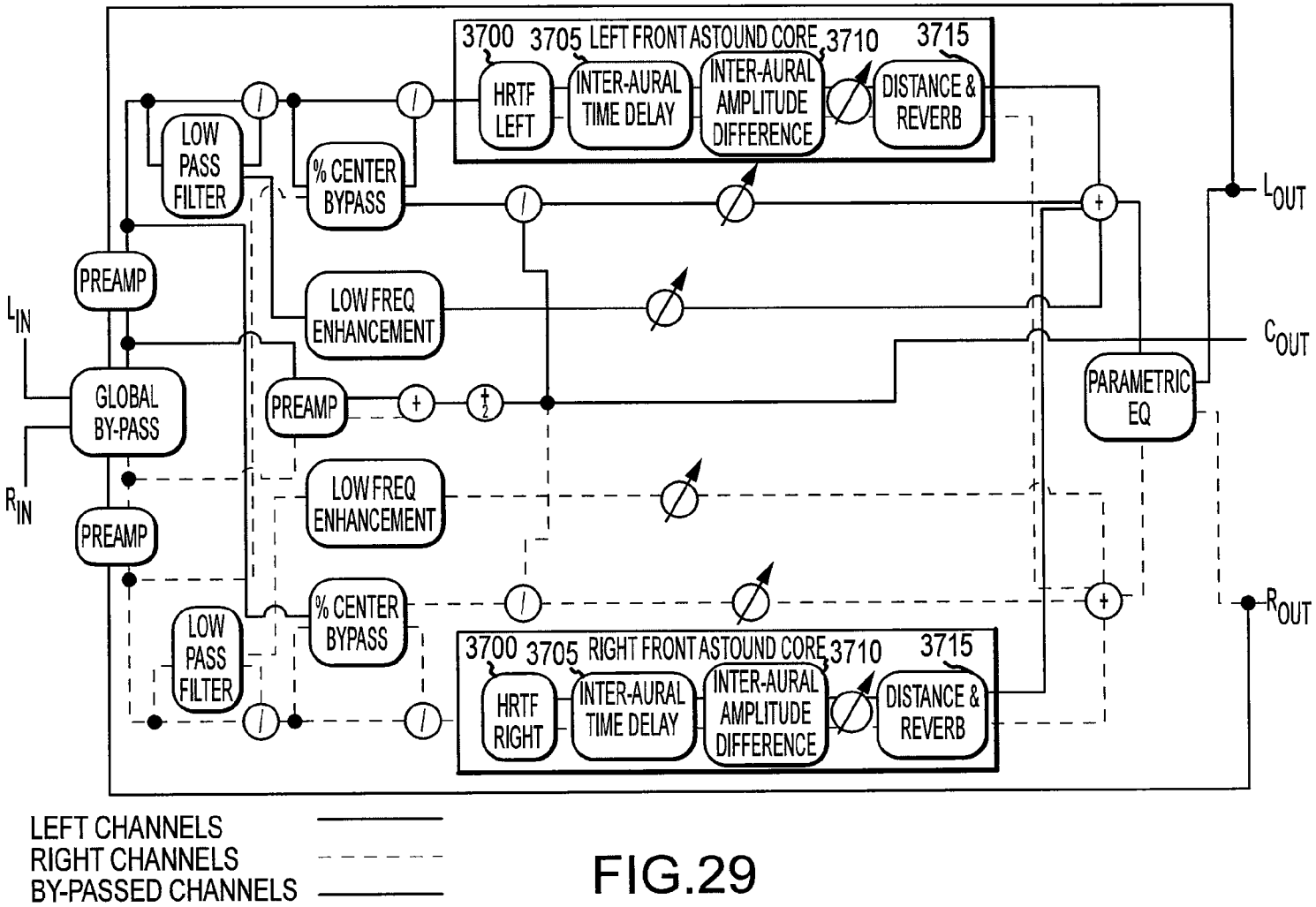
FIG. 29 is a wiring diagram configured for use with the 2-channel input to 3-channel output localization process shown in FIG. 28.

FIG. 29 shows an example wiring diagram of components configured for use with the process described above in FIG. 28. The HRTF 3700, Inter-Aural Time Delay 3705, and Inter-Aural Amplitude Difference 3710, and Distance and Reverb 3715 components (in each channel shown) perform functions as described above with regard to FIG. 23, and comprise the components utilized to perform the localization process, as described above.

E. Center Channel Localization

An embedded process for center channel localization in accordance with the present disclosure receives a stereo pair signal and produces a localized stereo output, with a localized center channel. This process is similar to the stereo input process described previously in sub-section D. A difference between the processes includes that in this process, there is no dedicated output channel. In addition, this presently described center channel localization process uses the phantom center from the input stereo pair and localizes it, typically for additional elevation and distance (but it could be biased with left or right azimuth).

For exemplary purposes only, a standard 2-channel stereo input will be employed in this disclosure. However, this process is extendable to any number of stereo pair signals, including but not limited to 2.0, 4.0, 6.0, etc.

By using Mid-Side Decoding (see the detailed description thereof provided below in subsection G), as described previously, the so-called "phantom" center channel signal may be captured, and thereafter it may be routed through a mono localization component before the down-mix to the left and right output channels. This process has the audible effect of pushing the center channel out onto the virtual audio unit sphere, where the listener is in the center of the virtual sphere. This technique is especially useful in headphone listening, because the placement of the headphone speakers causes the center channel to typically be experienced "in the center of the listener's head" (i.e. on the horizontal plane of the physical speakers), rather than out in front of the listener. However, it is also applicable in external speaker configurations. Pushing the center signal out in front of the listener allows the center signal to be consistent with the expanded/localized side signals. Of course, full localization is applied such that the center signal can have elevation cues applied in addition to distance.

This system configuration has application in any embedded solution where expansion of a stereo input signal is desired, and the output device itself only has a single stereo pair of speakers. In particular, this system configuration has direct application to headphones, either embedded in a processor within the headphones themselves or embedded within a separate unit, to which the headphones are connected.

Figure 30:
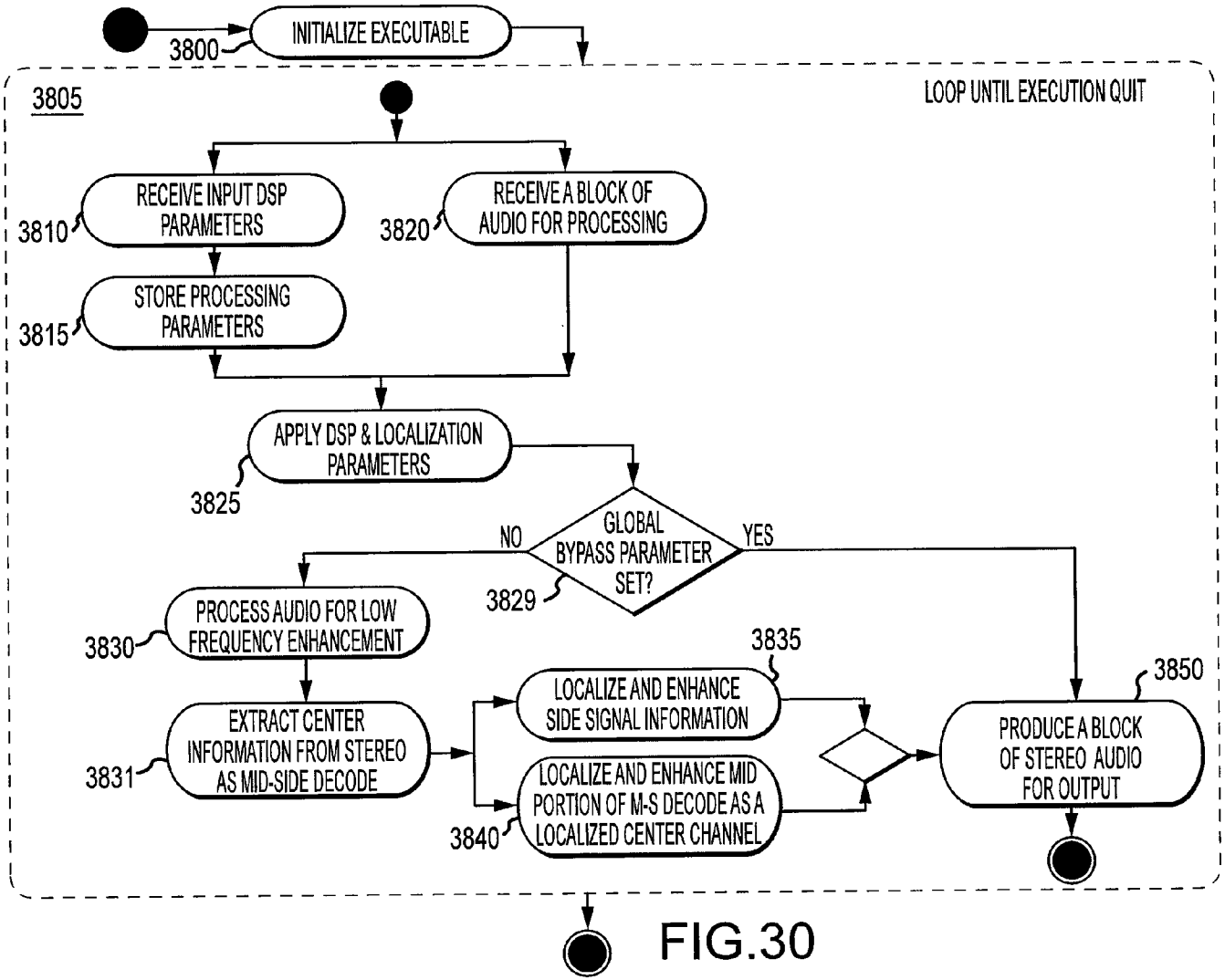
FIG. 30 illustrates a stereo in to stereo out with center channel localization process.

FIG. 30 illustrates one embodiment of a process flow for center channel localization in accordance with the present disclosure. As shown in FIG. 30 the operation of initializing an executable file 3800 typically occurs prior and external to the center channel localization process 3805.

The center channel localization process begins with an operation 3810 of receiving the input parameters from the external process, and receiving an input buffer of audio, with a fixed frame size, from the external process 3820. The input parameters are stored at operation 3815 for processing. At operation 3825, the azimuth and elevation input parameters from operation 3810 may be used to look up and retrieve the correct IIR filter. In operation 3827, the embodiment determines if a global bypass parameter has been set.

Where a global bypass parameter has not been set (decision block 3829), a low frequency enhancement may be applied at operation 3830 by using a low pass filter, LFE gain and EQ. As compared to the 3-channel example described with regard to FIG. 28, the center channel localization process includes an operation 3831 of extracting and isolating a "phantom" center channel and left and right side signals from the front stereo by means of a Mid-Side Decode process. Thereafter, at operation 3835, the filters from operation 3825 and the distance and reverb input values may be used to apply the processing procedure's localization effect, producing a resultant stereo signal, and to apply room simulation reverb and multiple bands of parametric EQ to correct for any tone colorization. Simultaneously or sequentially, a phantom center channel may be extracted from the front stereo pair by means of a Mid-Side Decode process 3840. The output from operations 3835 and 3840 may be passed to operation 3850 and, optionally, combined (as shown by the diamond between operations 3835/3840 and 3850). At operation 3850, the left and right signals may be summed together. One or more output buffers may be populated with the processed stereo signal and with the mono center signal, and the audio buffers may be returned to the external process.

Where a global bypass parameter has been set (decision block 3829), the process proceeds directly from operation 3825 to operation 3850, described above.

Figure 31:
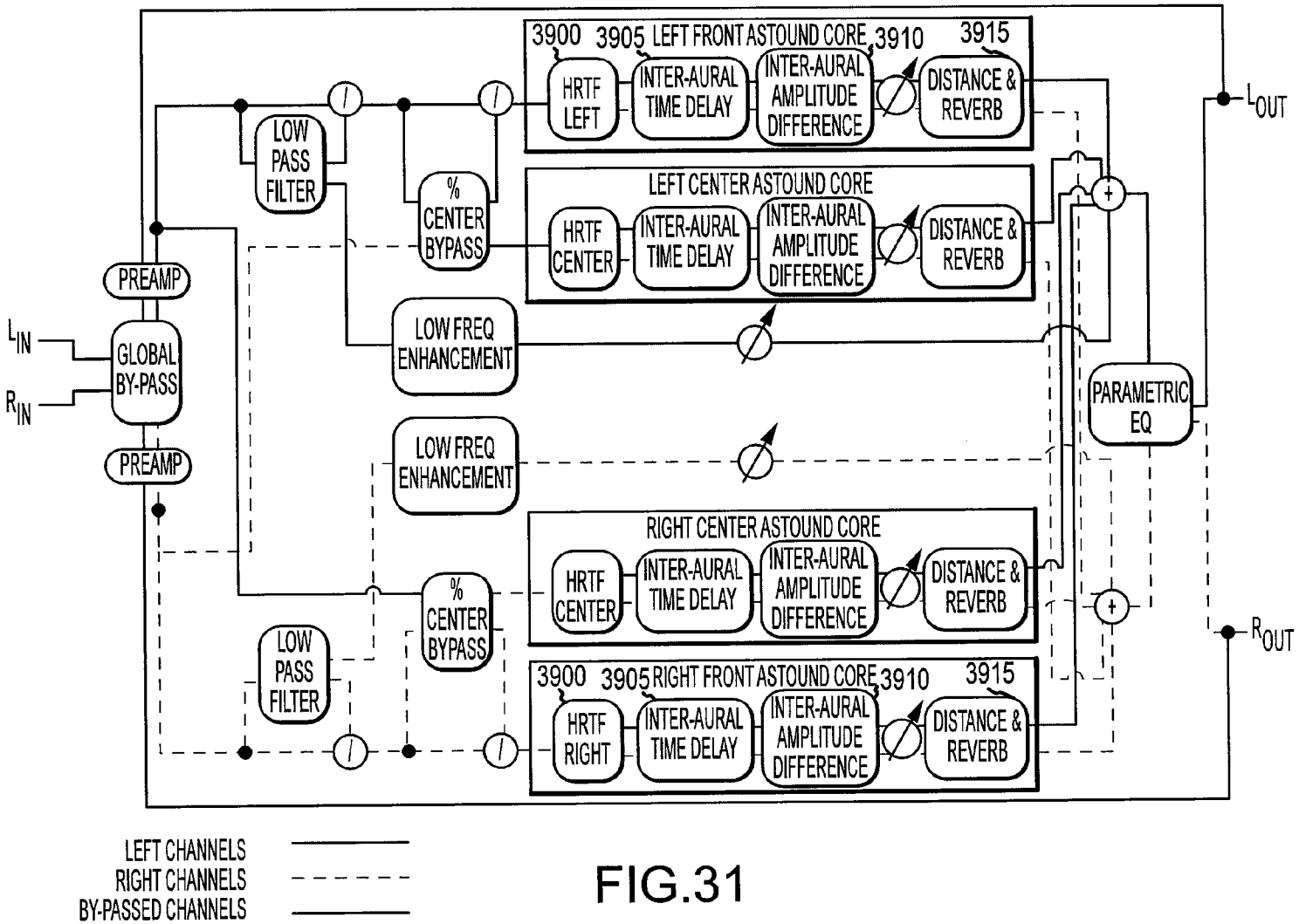
FIG. 31 is a wiring diagram configured for use with the stereo in to stereo out with center channel localization process shown in FIG. 30.

FIG. 31 shows an example wiring diagram of components configured for use with the process described above in FIG. 30. The HRTF 3900, Inter-Aural Time Delay 3905, and Inter-Aural Amplitude Difference 3910, and Distance and Reverb 3915 components (in each of the four channels shown) perform functions as described above with regard to FIG. 23, and comprise the components utilized to perform the localization process, as described above. There are two such sets of components for front left and right localization, and two for left and right center localization.

F. 2-Channel Input of an LtRt Signal

An embedded process for 2-channel input of an LtRt (Left Total/Right Total) signal in accordance with the present disclosure receives a stereo pair signal, encoded as LtRt, and produces a localized stereo output as a virtual multi-channel listening experience. In particular, this process extracts matrixed surround information and localizes it as a single virtual surround channel. LtRt signals are the result of an LCRS (left, center, right, and surround) matrix fold-down process of a multi-channel mix to stereo, for example, a 5.1 folded-down to stereo. If the LtRt audio is fed through the correct decoder, the result will be the original surround mix back out. The presently described localization process is similar to the stereo input process described in the previous subsection E regarding center channel localization, however with additional processing to extract the rear channel information from the LtRt input and localize it as a single virtual rear surround channel. Furthermore, the presently described localization process can be combined with (or applied to) the process described in the previous subsection D regarding 2-channel input to 3-channel output if there is a 3-channel output system present (i.e., a dedicated physical center speaker).

This system configuration has application in any embedded solution where an input LtRt signal (such as from a movie) is to be output as virtual multi-channel stereo, and the output device itself only has a single stereo pair of speakers. In particular, this system configuration has direct application to headphones, either embedded in a processor within the headphones themselves or embedded within a separate unit, to which the headphones are connected.

Figure 32A:
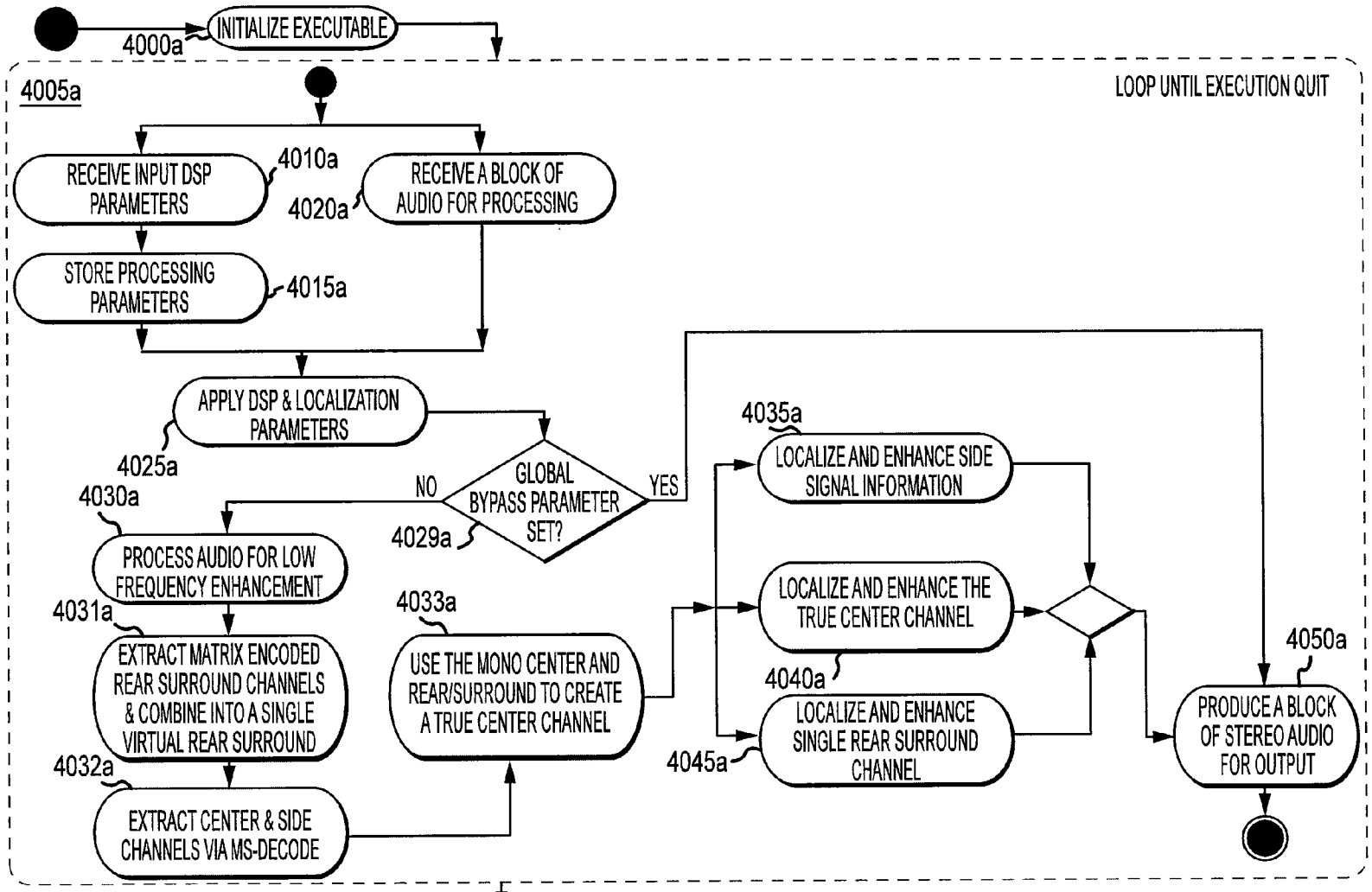
FIG. 32*a* illustrates a 2-channel LtRt input to virtual multi-channel stereo output process.

FIG. 32*a* illustrates one embodiment of a process flow for LtRt signal localization in accordance with the present disclosure. As shown in FIG. 32*a* the operation of initializing an executable file 4000*a* occurs prior and external to the LtRt signal localization process 4005*a*.

The LtRt signal localization process begins with an operation 4010*a* of receiving the input parameters from the external process, and receive an input buffer of audio, with a fixed frame size, from the external process 4020*a*. The input parameters are stored at operation 4015*a* for processing. At operation 4025*a*, the azimuth and elevation input parameters from operation 4010*a* may be used to look up and retrieve the correct IIR filter.

Where a global bypass parameter has not been set (decision block 4029*a*), a low frequency enhancement may be applied at operation 4030*a* by using a low pass filter, LFE gain and EQ. At operation 4031*a*, the process may extract out the left-biased and right-biased out-of-phase surround channel information by taking LeftBiasedRear=L-R and RightBiasedRear=R-L, summing them together, dividing by 2, and applying an adjustable (in the range [20 Hz, 10 KHz]) low-pass filter, producing the CenterRearSurround channel.

At operation 4032*a*, the process may extract and isolate the phantom center channel and left and right side signals from the front stereo pair by means of a Mid-Side Decode process (see the detailed description thereof provided below in subsection G), thereby allowing the CenterLeft and CenterRight signals to have gain applied. The process may then obtain the TrueCenter channel at operation 4033*a* by taking the MonoCenter=L+R and subtracting the CenterRearSurround created in operation 4031*a*.

Thereafter, at operation 4035*a*, the process may use the parameters from operation 4025*a*, including the distance and reverb input values, to apply the processing algorithm's localization effect to the side signals extracted from operation 4032*a*, producing a resultant stereo signal, and apply room simulation reverb and multiple bands of parametric EQ to correct for any tone colorization. Simultaneously, at operation 4040*a*, the process may use the parameters from operation 4025*a*, including the distance and reverb input values, to apply the processing algorithm's localization effect to the TrueCenter signal extracted from operation 4033*a*, producing a resultant stereo signal, and apply room simulation reverb and multiple bands of parametric EQ to correct for any tone colorization. Note that use of distance cue and reverb is optional in this operation. Also simultaneously, at operation 4045*a*, the process may use the parameters from operation 4025*a*, including the distance and reverb input values, to apply the processing algorithm's localization effect to the CenterRearSurround signal extracted from 4031*a*, producing a resultant stereo signal, and apply room simulation reverb and multiple bands of parametric EQ to correct for any tone colorization. Thereafter, the process may sum together the left and right signals and populate an output buffer with the processed stereo signal, and return the audio buffer to the external process at operation 4050*a*.

Where a global bypass parameter has been set (decision block 4029*a*), the process proceeds directly from operation 4025*a* to operation 4050*a*, described above.

Figure 33A:
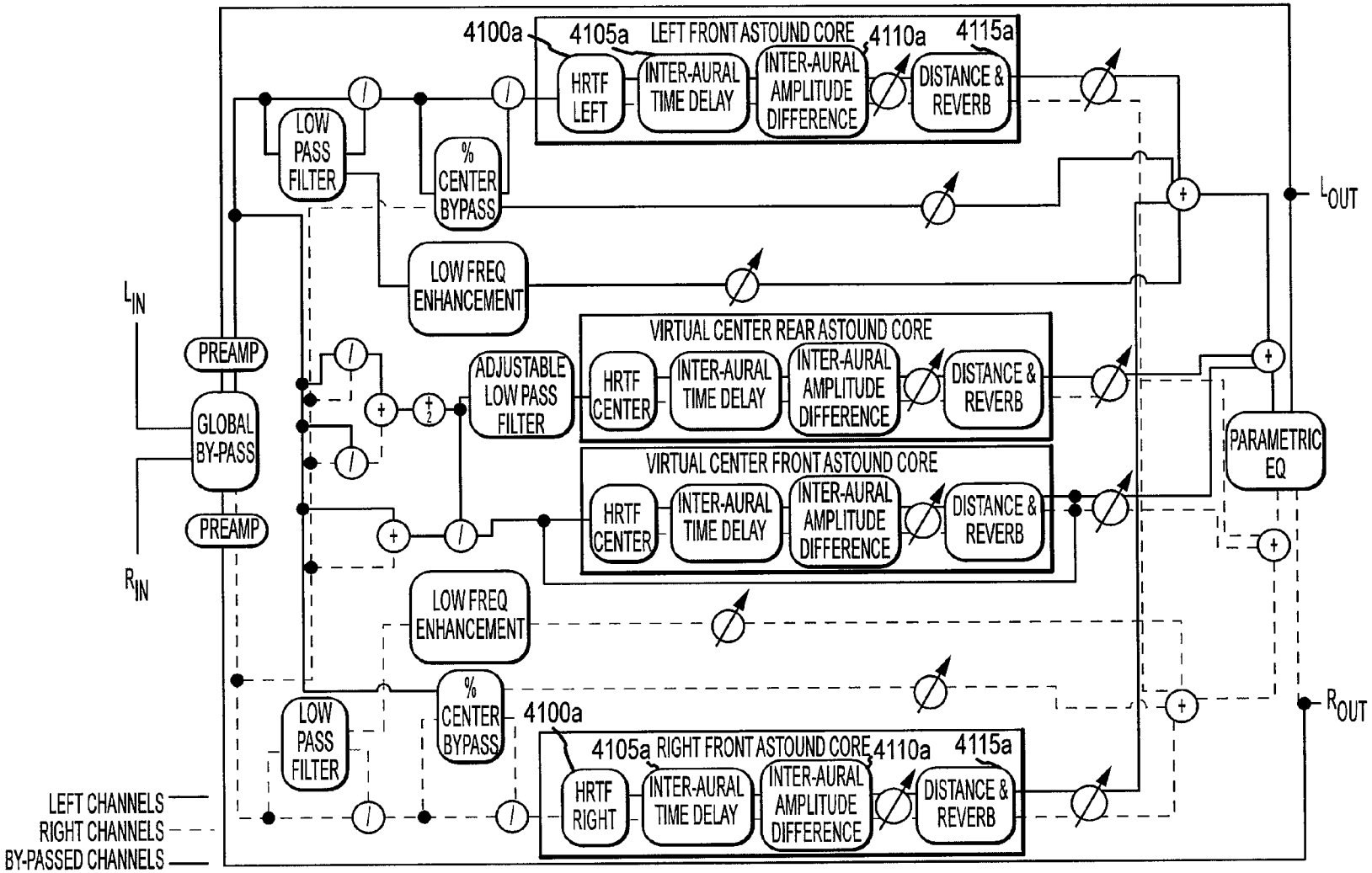
FIG. 33*a* is a wiring diagram configured for use with the 2-channel LtRt input to virtual multi-channel stereo output process shown in FIG. 32*a*.

FIG. 33*a* shows an example wiring diagram of components configured for use with the algorithm described above in FIG. 32*a*. The HRTF 4100*a*, Inter-Aural Time Delay 4105*a*, and Inter-Aural Amplitude Difference 4110*a*, and Distance and Reverb 4115*a* components (in each of the four channels shown) perform functions as described above with regard to FIG. 23, and comprise the components utilized to perform the LtRt signal localization process, as described above. There are two such sets of components for front left and right localization, and two for the virtual center front and rear localization. Furthermore, as indicated in FIG. 33*a*, the distance cues and reverb sections can be by-passed, placing the localized signal on the (audibly perceived) unit sphere.

Figure 32B:
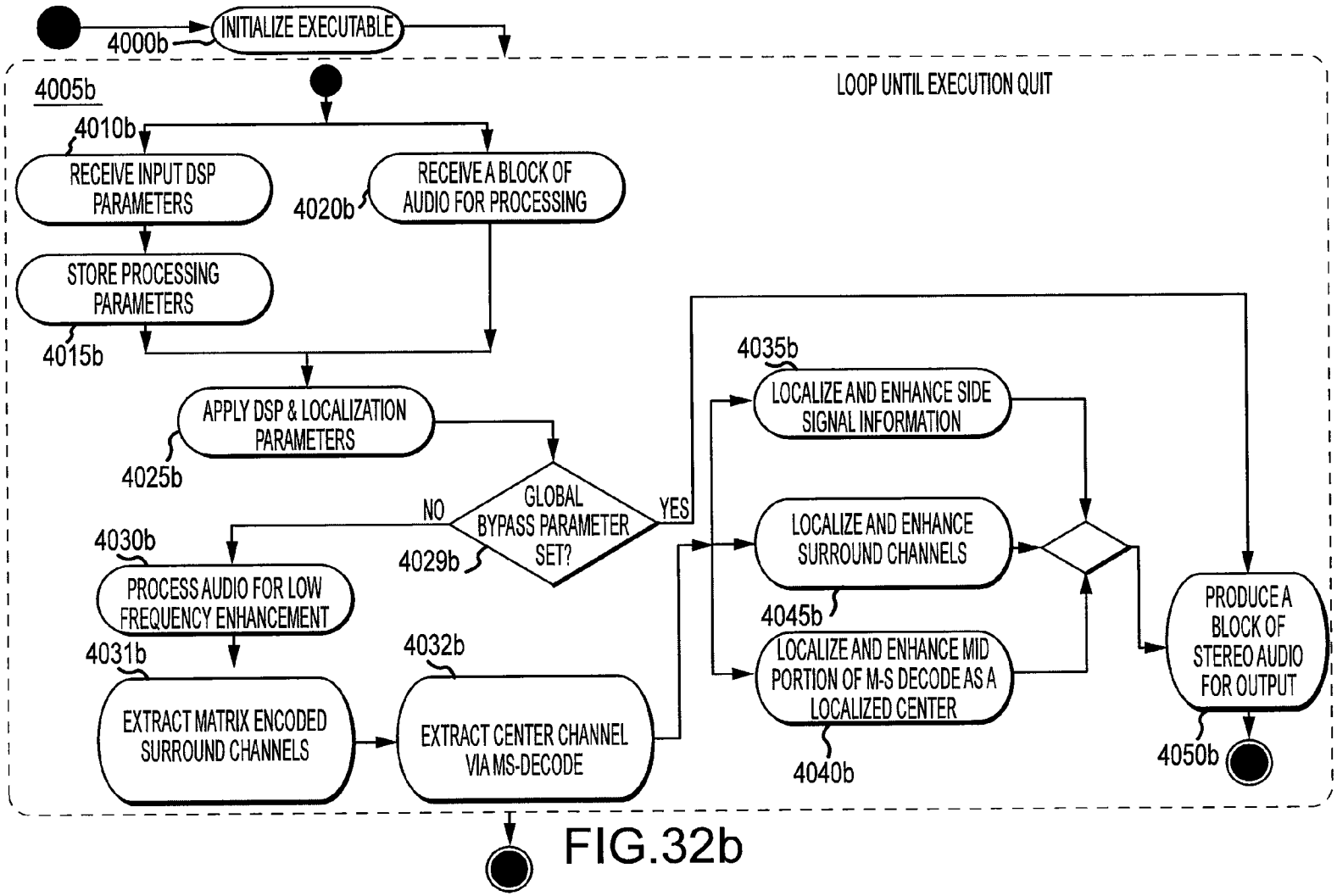
FIG. 32*b* illustrates an alternative 2-channel LtRt input to virtual multi-channel stereo output process
Figure 33B:
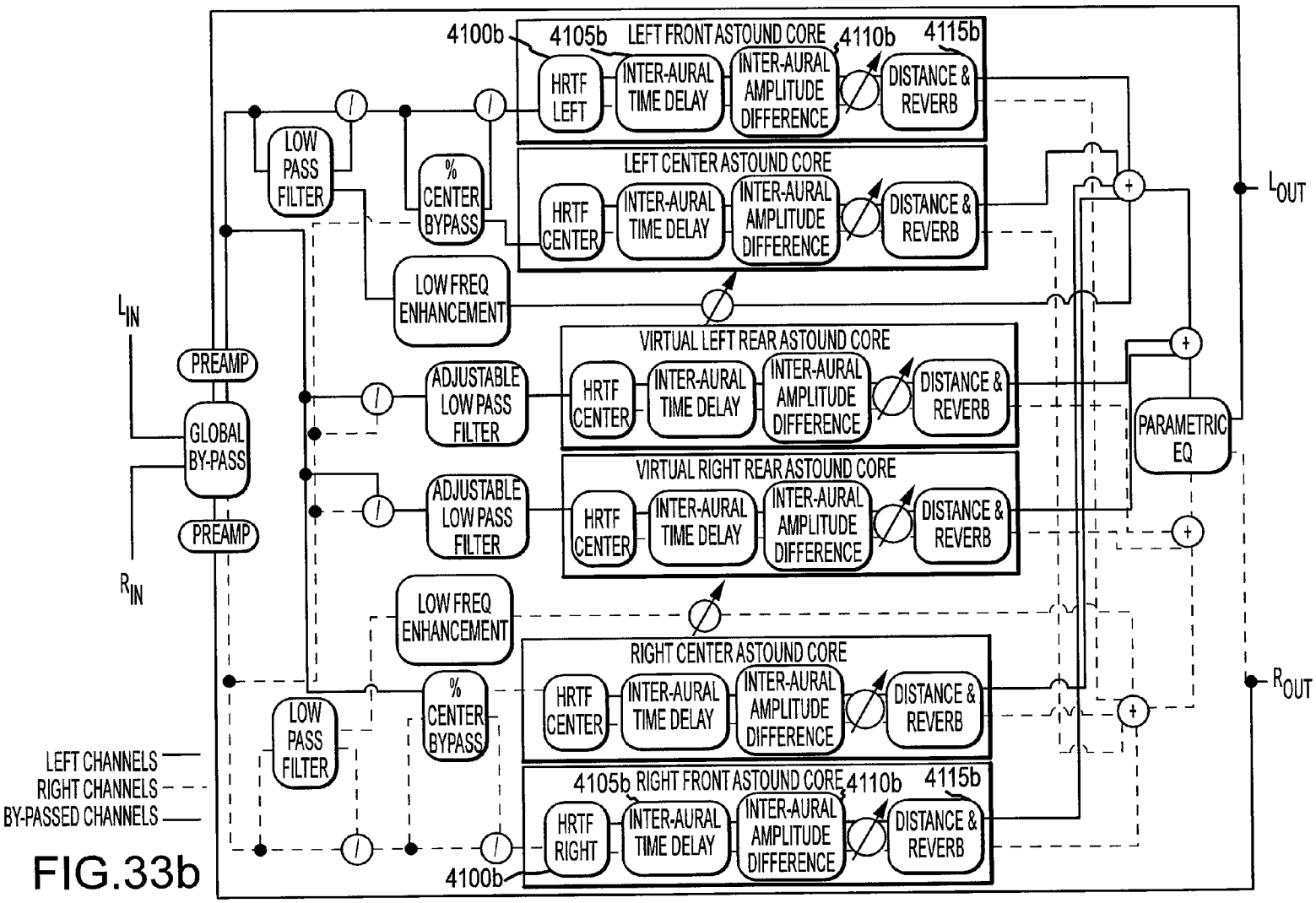
FIG. 33*b* is an wiring diagram configured for use with the alternative 2-channel LtRt input to virtual multi-channel stereo output process shown in FIG. 32*b*.

An alternate embedded process for 2-channel input of an LtRt signal in accordance with the present disclosure is shown in FIGS. 32*b* and 33*b*. This alternate process is related to the process shown and described above with regard to FIGS. 32*a* and 33*a*, but differs generally in how it handles the rear surround channels. As with the previous process, the alternate embedded process takes a stereo pair signal, encoded as LtRt, and produces a localized stereo output as a virtual multi-channel listening experience. However, this alternate method localizes each rear surround channel (left and right surround) individually, rather than localizing to a single rear surround.

Similar to the previous process, this alternate has application in any embedded solution where an input LTRT signal (such as from a movie) is to be output as virtual multi-channel stereo, and the output device itself only has a single stereo pair of speakers. In particular, this alternate has direct application to headphones, either embedded in a processor within the headphones themselves or embedded within a separate unit, to which the headphones are connected.

FIG. 32*b* illustrates one embodiment of an alternate process flow for LtRt signal localization in accordance with the present disclosure. As shown in FIG. 32*b*, the operation of initializing an executable file 4000*b* occurs prior and external to the LtRt signal localization process 4005*b*.

The LtRt signal localization process begins with an operation 4010*b* of receiving the input parameters from the external process, and receive an input buffer of audio, with a fixed frame size, from the external process 4020*b*. The input parameters are stored at operation 4015*b* for processing. At operation 4025*b*, the azimuth and elevation input parameters from operation 4010*b* may be used to look up and retrieve the correct IIR filter.

Where a global bypass parameter has not been set (decision block 4029*b*), a low frequency enhancement may be applied at operation 4030*b* by using a low pass filter, LFE gain and EQ. The LtRt signal localization process includes an operation 4031*b* of extracting and isolating the rear surround channels by subtracting the right signal from the left (giving a left biased rear surround), and by subtracting the left signal from the right (giving a right biased rear surround). Thereafter, an adjustable (in the range [20 Hz, 10 KHz]) low-pass filter may be applied. As with the center channel localization process, the LtRt signal localization process includes an operation 4032*b* of extracting and isolating a "phantom" center channel and left and right side signals from the front stereo by means of a Mid-Side Decode process.

Thereafter, at operation 4035*b*, the filters from operation 4025*b* and the distance and reverb input values may be used to apply the processing algorithm's localization effect, producing a resultant stereo signal, and to apply room simulation reverb and multiple bands of parametric EQ to correct for any tone colorization. Simultaneously, at operation 4040*b*, a mid channel may be extracted from the front stereo pair by means of a Mid-Side Decode process 4032*b*. Also simultaneously, at operation 4045*b*, the filters from 4025*b* and the distance and reverb input values may be used to apply the processing algorithm's localization effect to the left rear and right rear surround signals extracted from operation 4031*b*, producing two resultant stereo signals, and to apply room simulation reverb and multiple bands of parametric EQ to correct for any tone colorization. Finally, at operation 4050*b*, the left and right signals may be summed together. One or more output buffers may be populated with the processed stereo signal and with the mono center signal, and the audio buffers may be returned to the external process.

Where a global bypass parameter has been set (decision block 4029*b*), the process proceeds directly from operation 4025*b* to operation 4050*b*, described above.

FIG. 33*b* shows an example wiring diagram of components configured for use with the alternate algorithm described above in FIG. 32*b*. The HRTF 4100*b*, Inter-Aural Time Delay 4105*b*, and Inter-Aural Amplitude Difference 4110*b*, and Distance and Reverb 4115*b* components (in each of the six channels shown) perform functions as described above with regard to FIG. 23, and comprise the components utilized to perform the LtRt signal localization process, as described above. There are two such sets of components for front left and right localization, two for left and right center localization, and two for left and right virtual rear localization.

G. Percent-Center Bypass

Figure 34:
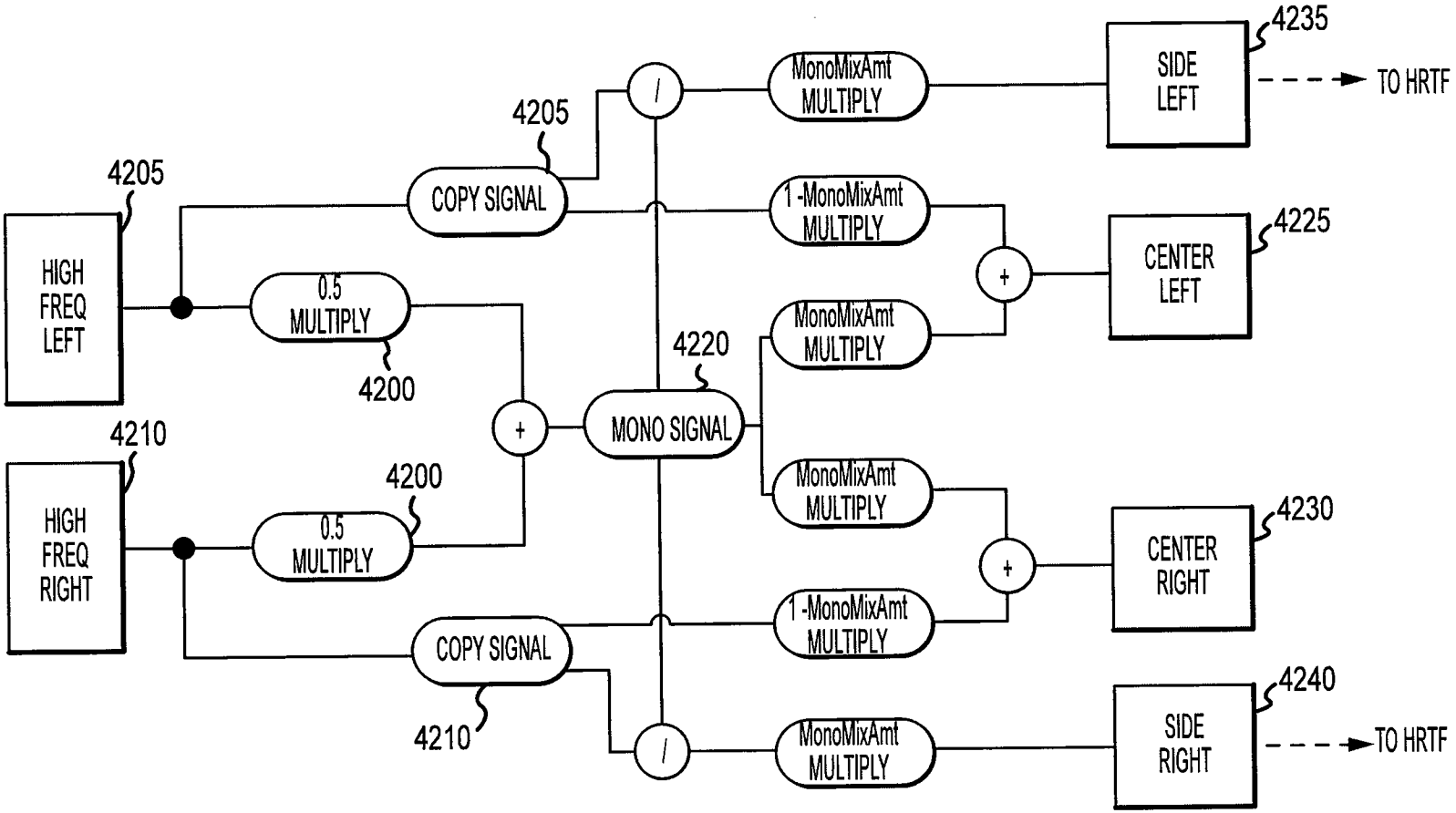
FIG. 34 is a wiring diagram employing a mid-side decoder configured for use with a %-center bypass process.

Several of the previously disclosed system configurations employ the use of a Percent-Center Bypass (hereinafter "%-Center Bypass") process, as shown in their respective example wiring diagrams. A %-Center Bypass process in accordance with the present disclosure is shown in FIG. 34.

The %-Center Bypass uses a Mid-Side Decoder. This process can be described as follows, with reference to each respective block on the diagram in [brackets]:

Let centerConcentration be a real numbered value in the range (0, 1) [blocks 4200].

Let L=left stereo signal and R=right stereo signal, and copy signals thereof [blocks 4205, 4210].

Let centerBus(L) be the left side (in a stereo pair sense) of the phantom center signal produced by the MS-Decode process [block 4225], and centerBus(R) the right side [block 4230].

Let sideChan(L) be the left side (in a stereo pair sense) of the side signal produced by the MS-Decode process [block 4235], and sideChan(R) the right side [block 4240].

mono=(*L*+*R*)/2[block 4220];

centerBus(*L*)=centerConcentration*mono+(1−centerConcentration)**L*;

centerBus(*R*)=centerConcentration*mono+(1−centerConcentration)**R*;

sideChan(*L*)=centerConcentration*(*L*−mono); and sideChan(*R*)=centerConcentration*(*R*−mono).

The centerConcentration control adjusts the amount of resultant center channel information, i.e., it controls the %-Center Bypass. Only the side signal is passed on to the respective system configuration processing component for localization. If centerConcentration is set to 100% (1.0), then the center channel gets only the mono, while the side gets the original minus the mono. This setting results in a full bypass of the phantom center information contained in the original stereo input signal, and an isolation of the side signal for localization processing. On the other extreme, if centerConcentration is set to 0% (0.0), then the center channel gets the original separated left and right channels with no mono, and the side signal is zeroed out. This setting results in no side signal for localization and a center channel bias resultant signal. At 50%, the left and right channels are attenuated by 6 db and the center gets half mono plus half side. After localization processing of the side signals, all of the left signals are summed together, and all of the right signals are summer together.

Figure 35:
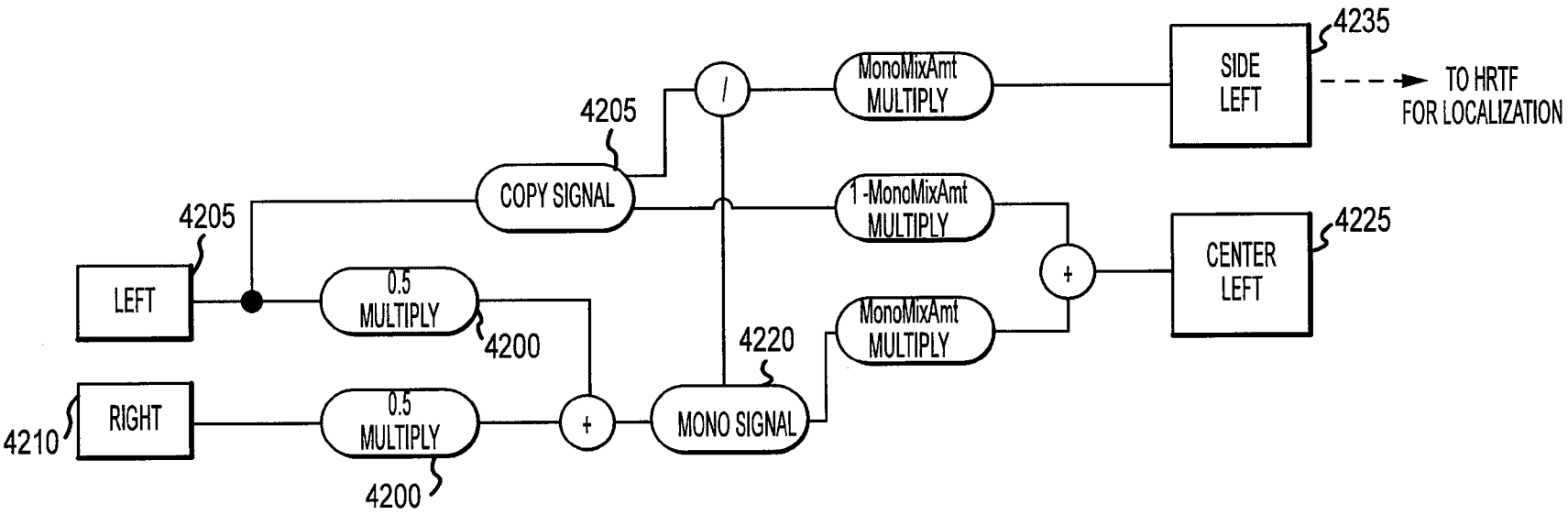
FIG. 35 shows a one-sided perspective of the wiring diagram of FIG. 34.

*L*final=centerBus(*L*)+sideChan(*L*);

*R*final=centerBus(*R*)+sideChan(*R*);

From the perspective of processing one side of a stereo pair, e.g. the left side, the single side wiring diagram would appear as illustrated in FIG. 35, which the perspective illustrated in all previously disclosed wiring diagrams within this document that use %-Center Bypass.

H. Multi-Channel Input Down-Mix to Multi-Channel Output

An embedded process for multi-channel input to a down-mix multi-channel output in accordance with the present disclosure may receive a set of discrete multi-channel audio signals and a specification of a desired multi-channel output configuration. For example, the multi-channel input audio signals may be in any format such as 5.1, 7.1, 10.2 or otherwise, while the desired output configuration includes the same or fewer components than are provided in the multi-channel input audio signals, for example, a 7.1 input signal desirably being output on a 5.1 component configuration, or a 5.1 input signal being output on a 3.1 component configuration. In at least one embodiment, in order to accommodate this down-mixing of input signals to lesser output components, various localization effects described herein may be applied. In one embodiment, one or more localization effects are applied to matched pairs of a single input signal, resulting in equivalent effects being applied to both left and right output signal components. In other embodiments, localization effects are applied to multiple input signals, resulting in equivalent effects being applied across multiple output signal components. For example, localization effects can be applied to a discrete 7.1 input, resulting in a hybrid-virtual discrete 5.1 output, where only one channel of audio signals (e.g., the rear signals) are virtualized and the remaining channels of audio signals remain unmodified and discrete. One or more localization effects, such as 3-D and/or 4-D localization effects described herein, may be applied to a number of input signals. The localized input signals then result in a stereo signal that may be routed or otherwise provided to a desired left-right output channel pair, for example, a surround left and surround right channel pair. In at least one embodiment, the remaining output signals, for example, left front and right front, remain unmodified and as a discrete output. Additionally and/or alternatively, one or more localization effects may be applied to more than one matched pair. Such an implementation may be desirable, for example, when the input and output channel count is equal, but, other localization effects are still desired. For example, a 7.1 channel input signal that does not natively contain any localization effects may be localized by one or more of the effects described herein to provide a localized 7.1 channel output signal that is provided to 7.1 output component configuration. When localization is applied without a decrease in the number of output signal channels (as based upon the number of input signal channels received) it is to be appreciated that any applied localization effects may result in a mixing of one or more new stereo signals into an appropriate pair, or more, of output channels. The application of such localization effects may enhance an audio input stream to provide expanded, or otherwise localized, sound in any domain (3-D and/or 4-D) including the virtual raising and/or lowering of sound sources in elevation, as desired. It is to be appreciated that by applying one or more of the various localization effects described herein, ever more realistic audio environments may be created. For example, the presence of a fighter jet on a first pass might seem higher (virtually), to a listener participating, for example, in an online game, then the presence of the fighter jet on a second, strafing pass, even though the component configuration and placement thereof has not actually/physically changed.

More specifically, one exemplary embodiment of the down-mixing and/or application of one or more localization effects to a multi-channel input signal to create a localized output signal of the same or a lesser number of channel components is described with reference to a 7.1 input signal embodiment. It is to be appreciated, however, that the following description may be applied, as desired for any given embodiment and configuration, to any other configuration of input signal channels. As is commonly appreciated, a 7.1 input channel signal typically includes a left-front, right-front, center, left-surround, right-surround, left-rear, right-rear and LFE channel. Each of these signals may be characterized as being individual mono audio signals, from which we desirably generate a hybrid virtualized 5.1 output signal with one or more stereo expansion techniques described herein being applied to a selected pair of output component signals, such as the left-front and right-front output signals, while the left-rear and right-rear output signals (provided in the 7.1. signal format) are completely virtualized for spatial placement in 3D space, and the remaining center channel, LFE, and left and right surround signals remain unmodified and in their originally provided discrete form. It is to be appreciated, that applying the one or more localization and/or virtualization effects described herein, may result in an output signal having the characteristics of the rear signals being independently localized (as presented to the listener by the corresponding front channels) and the expanded sound stage provided by the front signal pairs having minimal phase discontinuities and/or distortions.

Further, it is to be appreciated that the multi-channel input down-mix to multi-channel output process may be applied in any embedded solution where a 3-D effect is desired for a multi-channel output component configuration. For example, in a public or private (e.g., home theater) theatrical setting where an input source has more audio input signals than are available for a given output component configuration, rather than modifying the theater by adding more components, one or more of the localization effects described herein may be applied to the input signals so as to generate output signals matching the given output component configuration. By embedding one or more of the algorithms described herein within or otherwise making available to a audio playback system (e.g., the algorithms may be made available via a firmware download, a call over an Internet connection to an off-site processing system, or otherwise), the configurable nature of the various embodiments described herein enables any number of input channels to be processed and routed to any number of output channels (including fewer or greater channels). The specific localization effects applied may also be selected in real-time based upon various factors, such as the type of content (e.g., a gamer might desire a different localization, than a person listening to a concert), the number of input channels available, the type of input channels available, the number of output components available and the characteristics of such output components. For example, a given output component configuration wherein the front speakers are fully powered, high power components, whereas the surround or other available speaker have lesser or more specific capabilities, may result in the selection of a given one or more localization effects being applied versus other available localization effects being applied.

Figure 36:
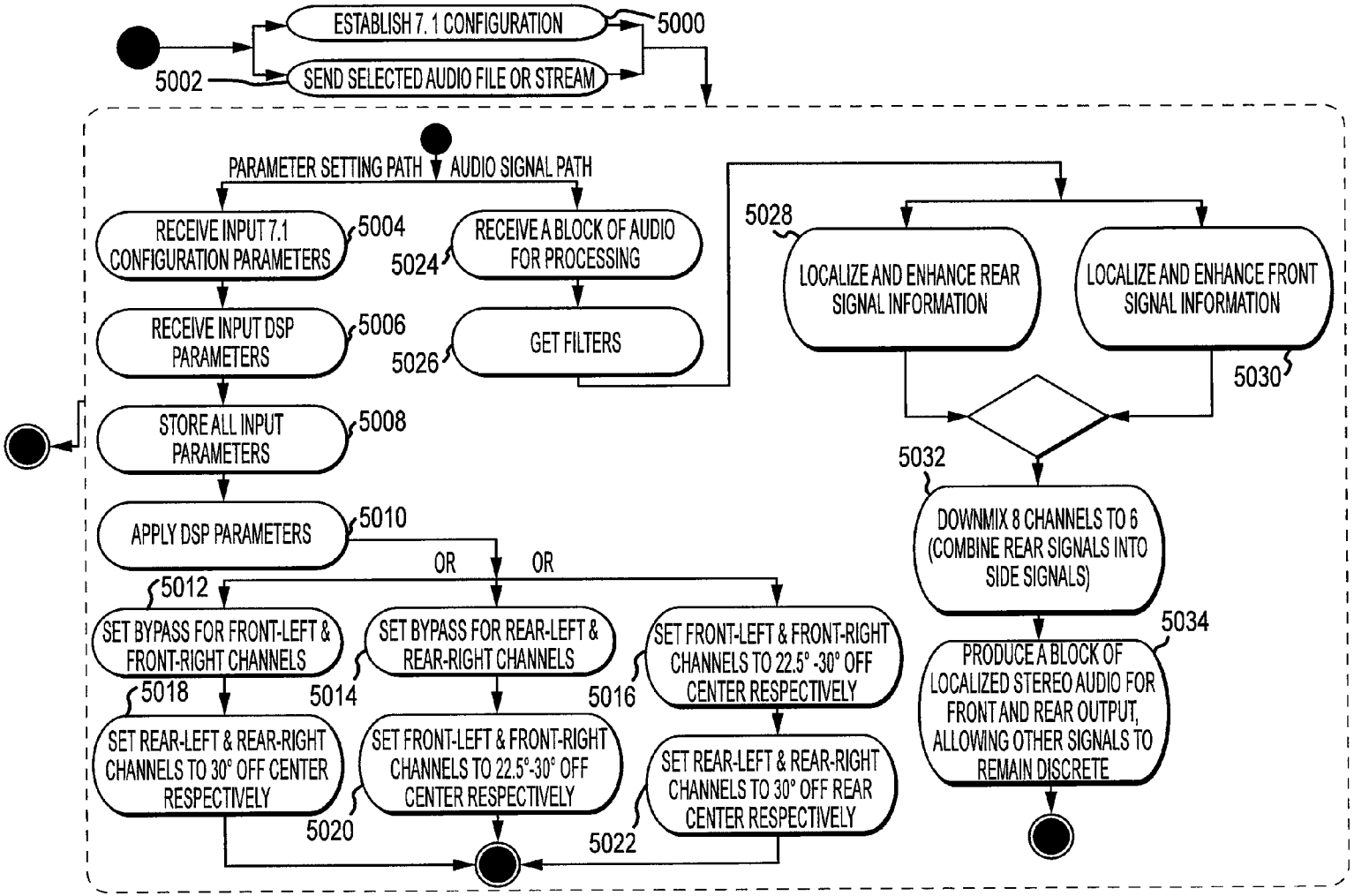
FIG. 36 illustrates a multi-channel input down-mix to multi-channel output process.

Referring now to FIG. 36, one exemplary embodiment of a process for localizing a multi-channel input signal into the same or a lesser number of localized output signals is shown. As shown, this process is illustrated with respect to a 7.1 input channel signal source resulting in a localized 5.1 output channel signal. However, the concepts, process flows and principles described herein may be applied to any desired combination of input signals and localized output signals.

As provided above with respect to the other exemplary embodiments described herein, the operations occurring outside of the dashed line area may occur outside of the localization process presently being described. As such, the process may be implemented upon an audio system receiving an identification of the configuration of the input signal (Operation 5000). For example, an input configuration of a 7.1 channel input signal source may be provided within the input signal itself, selected by an operator of the audio system, detected based upon other input parameters or otherwise. Regardless of how the input signal characteristics are received, determined or detected, upon identifying the same, the process continues with the selected audio file or stream being communicated to the audio system components applying the one or more localization effects described herein (Operation 5002).

At this instance, the operations shown in FIG. 36 proceed along at least two processing paths. It is to be appreciated, however, that multiple instances of each of these processing paths may occur in any given audio system component at the same or substantially the same time. For example, an audio system component being provided as a digital signal processor in software operating on a quad core processor may execute multiple instances of either or both paths as desired. Thus, while it is to be appreciated that the following discussion describes each path separately, it is to be appreciated that each path, when being processed as one or more process steps (that may be instantiated in hardware and/or in software) may occur separately, in combination with and/or in multiple instances and/or variations thereof.

Beginning first with the "parameter setting path" as shown in FIG. 36, the process may include the operation of receiving the input channel signal configuration (e.g., 7.1) (Operation 5004). It is to be appreciated that this operation and the other operations described herein may be considered optional based upon any give implementation. For example, a given configuration may be always configured to receive an input signal of only a certain characteristic (e.g., 7.1), in which instance no reception of configuration parameters may be needed and other process steps described herein may not be implemented or necessary.

The process also may include the operation of receiving the output signal configuration and the DSP parameters and/or other parameters utilized to achieve a desired down-mix and localization (Operation 5006). The DSP parameters may specifically contain certain azimuth [0°, 359°], elevation [90°, −90°], and distance cue data [0, 100] (where 0 results in a sound perceived in the center of the head, and 100 is arbitrarily distant) to be applied to the resultant localized signal. As described above, the localization effects applied may vary based upon, for example, the output component configuration, component characteristics, type of content, and listener preference. Further, it is to be appreciated that the parameters and/or localization effects received may be embedded, downloaded, called (to a remote or otherwise hosted service) or otherwise identified and utilized. These DSP parameters may be stored or otherwise made available, on an as needed basis, to the DSP or other processor that will be applying the desired one or more localization effects on the input signal (Operation 5008). It is to be appreciated, that such storage may occur on any local or remote storage device, provided that specified access times and other operating parameters are met.

The process may further include the operation of setting non-localized DSP parameters such as gains, equalizer values and other parameters (Operation 5010). It is to be appreciated that non-localized input channel and corresponding output channel parameters may need to be adjusted based upon the one or more localization effects to be applied to one or more input channel signals. The process includes the logic, examples of which are described hereinabove, to determine and apply such non-localization parameters, as desired at any given time.

The process, for at least this present embodiment, may then include at any given time, the implementation of one of three exemplary processes. A first of these exemplary processes may provide for bypassing localization of the front stereo output channel pairs (Operation 5012). A second exemplary process may provide for bypassing the corresponding rear stereo output channel pairs (i.e., rear-left and rear-right) (Operation 5014). A third exemplary process may provide for specifying particular azimuth's (or other dimensional parameters) for front stereo output channel pairs (Operation 5016). Exemplary azimuth ranges may vary arbitrarily from greater than 0 degrees to less than 90 degrees, but nominally from 22.5 degrees to 30 degrees.

Next, and based upon the preceding process chosen is specified in Operations 5012, 5014 and/or 5016, complimentary operations are selected and performed. These complementary operations may include setting rear-left and rear-right channels as having an azimuth that may vary arbitrarily from greater than 0 degrees off of rear center to less than 90 degrees off of rear center, but nominally 30 degrees off of rear center (Operations 5018 and 5022). Or, specifying the corresponding front channels as having an arbitrary azimuth of nominally 22.5 degrees to 30 degrees off front center (Operation 5020). Other specifications may also or alternatively be applied based upon any specific configuration of output channel components versus one or more desired localization effects to be achieved.

Referring now to the "audio signal path" as shown in FIG. 36, the process also may include the operation of receiving a frame, packet, segment, block or stream of audio signals for processing (Operation 5024). It is to be appreciated that such audio stream or stream(s) may be provided in the analog or digital domain with suitable pre-processing occurring so as to convert (as necessary) a given segment of audio signals into a packet or frame suitable for modification by one or more of the localization effects described herein.

The process also includes the operation of obtaining one or more IIR filters to be used to apply the one or more localization effects (Operation 5026). Such filters may be obtained based upon one or more azimuth, elevation and/or other parameters desired for a given localization effect. It is to be appreciated that the selection of the filters may occur prior to, coincident with or after receipt of the one or segments of audio signals received in operation 5024. Further, a filter to be utilized may vary with time based upon user preferences, content type and/or other factors.

The one or more IIR filters chosen to be applied to a given segment of received audio signals are then applied (Operations 5028 and 5030). As shown in FIG. 36, the application of the one or more selected filters or non-filter processes (e.g., distance, reverb, parametric equalization, tone colorization correction and others) to a given input audio signal may happen in parallel. Alternatively, filters may be applied serially or otherwise. The selected one or more filters are applied to the input audio signal(s) to achieve the desired localization effects, as described above. In the present exemplary embodiment, the selected filters are applied to the corresponding rear input signals (Operation 5028) and to the corresponding front input signals (Operation 5030).

The process may also include the operation of down-mixing the eight (8) input signals (as are provided in the case of a 7.1 input signal) into six (6) output signals (as are used in a 5.1 component configuration) (Operation 5032). In one embodiment, such down-mixing may occur by summing the rear input signals into resultant stereo pairs of side channels (i.e., surround-left and surround-right). In another embodiment, the down-mixing may occur by summing the rear input signals half into the corresponding front channels and half into the corresponding side channels. In other embodiments, the center channel and/or LFE with and/or without the front and/or side channels may be utilized. Practically any combination of front, side, center and/or LFE channels may be summed, in varying ratios, with the rear input signals to down-mix from a larger input signal configuration (such as 7.1) to lesser output signal configuration (such as 5.1).

The process concludes with providing and returning the processed and unprocessed signals, for example, using one more output buffers, to the audio processing stream from which the signals were obtained for localized processing in accordance with the present disclosure, for further audio processing, as needed (Operation 5034).

Figure 37:
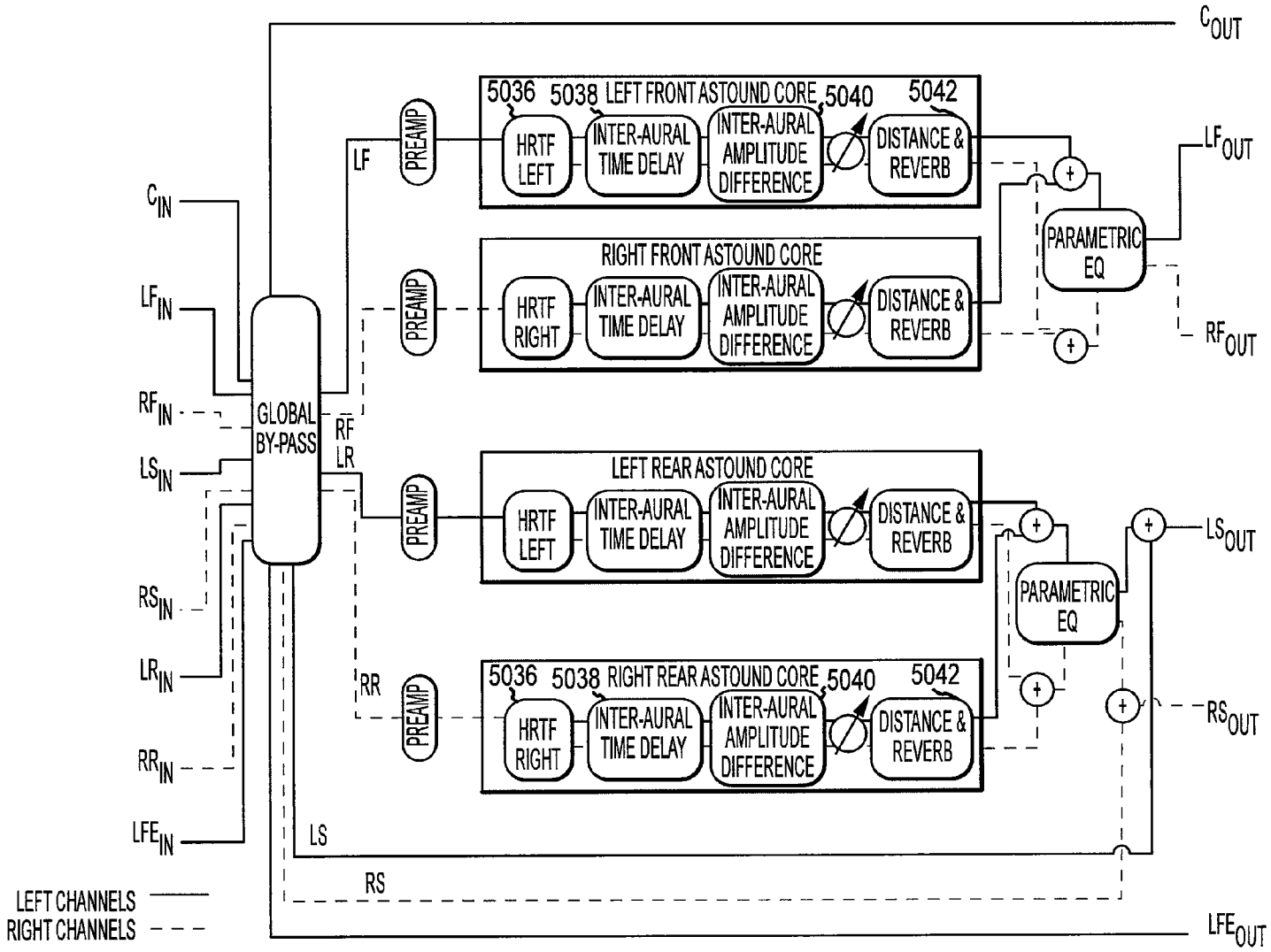
FIG. 37 is a wiring diagram configured for use with the process shown in FIG. 36.

Referring now to FIG. 37, an exemplary wiring diagram of components configured for use with the process described above in FIG. 36 is shown. As is the case for the wiring diagram shown in FIG. 37 and any of the above exemplary wiring diagrams, it is to be appreciated that the functions provided thereby may be implemented in hardware (e.g., as a system on a chip and/or in a dedicated DSP), software (e.g., as one or more operating routines implemented by a general purpose, limited purpose or specialized processor) or as combinations thereof. As shown in FIG. 37 for the embodiment of a 7.1 channel input signal being localized into a 5.1 channel output signal, exemplary process cores are shown for the left-front, right-front, left-rear and right-rear channels (the rear channels may alternatively be considered to be "surround" channels). These process cores may include the HRTF 5036, Inter-Aural Time Delay 5038, Inter-Aural Amplitude Difference 5040, and Distance and Reverb 5042 components (in each channel shown) which perform functions as described above with regard to FIG. 23. Collectively, these components perform the 3-channel localization process, as described above. As shown for this exemplary 7.1 to 5.1 down-mix embodiment, the corresponding rear blocks are applied to the corresponding front channels for stereo expansion and localization and the 7.1 configuration rear channels are applied to the corresponding 5.1 configuration side channels for rear localization. It is to be appreciated, however, that the 7.1 configuration rear channels could additionally and/or alternatively be applied to the corresponding 5.1 configuration front channels and/or a combination of the 5.1 configuration front and side channels, as particular implementations so desire.

I. Multi-Channel Input to Up-Mixed Multi-Channel Output

The various localization and other audio effect operations described herein may also be utilized to up-mix an input signal having two or more input channels to an output signal having a larger number of output channels. For example, in one embodiment a two channel input signal may be up-mixed to a 5.1 channel output signal using the various localization processes, IIR filters and techniques described herein. While any number of input signals may be up-mixed to a desired number of output signals, for this example, we assume a two channel stereo input signal is received and it constituent parts may be localized into pseudo-discrete 5.1 output signals. In at least one embodiment, such up-mixing and generation of pseudo-discrete multi-channel output signals may be accomplished by passing each of the channels of the received, lesser channel, input signal through a series of low pass filters. In one such embodiment, the low pass filters are configured in a cascading manner, such that ever greater specificity in the identification and separation of unique signal characteristics is obtained.

In other embodiments, other configurations of low pass, band pass, high pass and other filter configurations may be utilized, as desired for a given embodiment, to obtain the identify, filter and/or select the desired signal characteristics from the one or more original input signals. In addition to multiple layers of filtering, one or more mid-side decoding blocks may be used to disassemble or otherwise identify and/or separate particular signal characteristics from the original input stereo signals. Upon filter and decoding, as specified for a given implementation, one or more localization techniques described herein may be applied to such signals to virtually position the signal in front and/or rear channels. In certain embodiments, the center channel and LFE channels may remain discrete, i.e., filtered and decoded from the original input signal but without localization techniques being applied thereto.

In at least one embodiment, upon localization two sets of stereo pair output signals are generated, front and rear (with left & right channels being generated for both sets). As such, four pseudo-discrete channels and two discrete channels are generated from an otherwise discrete stereo input signals. Also, it is to be appreciated that these techniques can be utilized to up-mix any lesser numbered channel input signal into a greater numbered channel output signal, such as a 5.1 input up-mixed to a 7.1 output. Embodiments where these up-mixing techniques may be commercially viable include, any music or movie environment where the input signal has two channels, but, the output component configuration supports a greater number of components, and channels associated therewith.

When utilized in a 5.1 output channel configuration, in at least one embodiment the ITU 775 surround sound standard, the entire contents of which are incorporated herein by reference, may be utilized to specify the front and rear pair location angles. As is commonly known, these angles specify one optimum physical location for such components relative to a center facing speaker. While actual configurations will likely vary, such specifications provide a baseline from which any localization effects may be adjusted, as desired for any given actual implementation. Specifically, the ITU 775 standard specifies the front pair of speaker components (the signals emitted therefrom) have an angle of 22.5 to 30 degrees relative to a forward facing center speaker, and for the rear pair of speakers an angle of 110 degrees (also relative to the center speaker) is specified. Again, while the ITU 775 provides a well-defined baseline, it is to be appreciated that such baseline is optional and is not required—any localization angle may be utilized with desirable adjustments to the various localization effects algorithms utilized therewith being applied.

Figure 38:
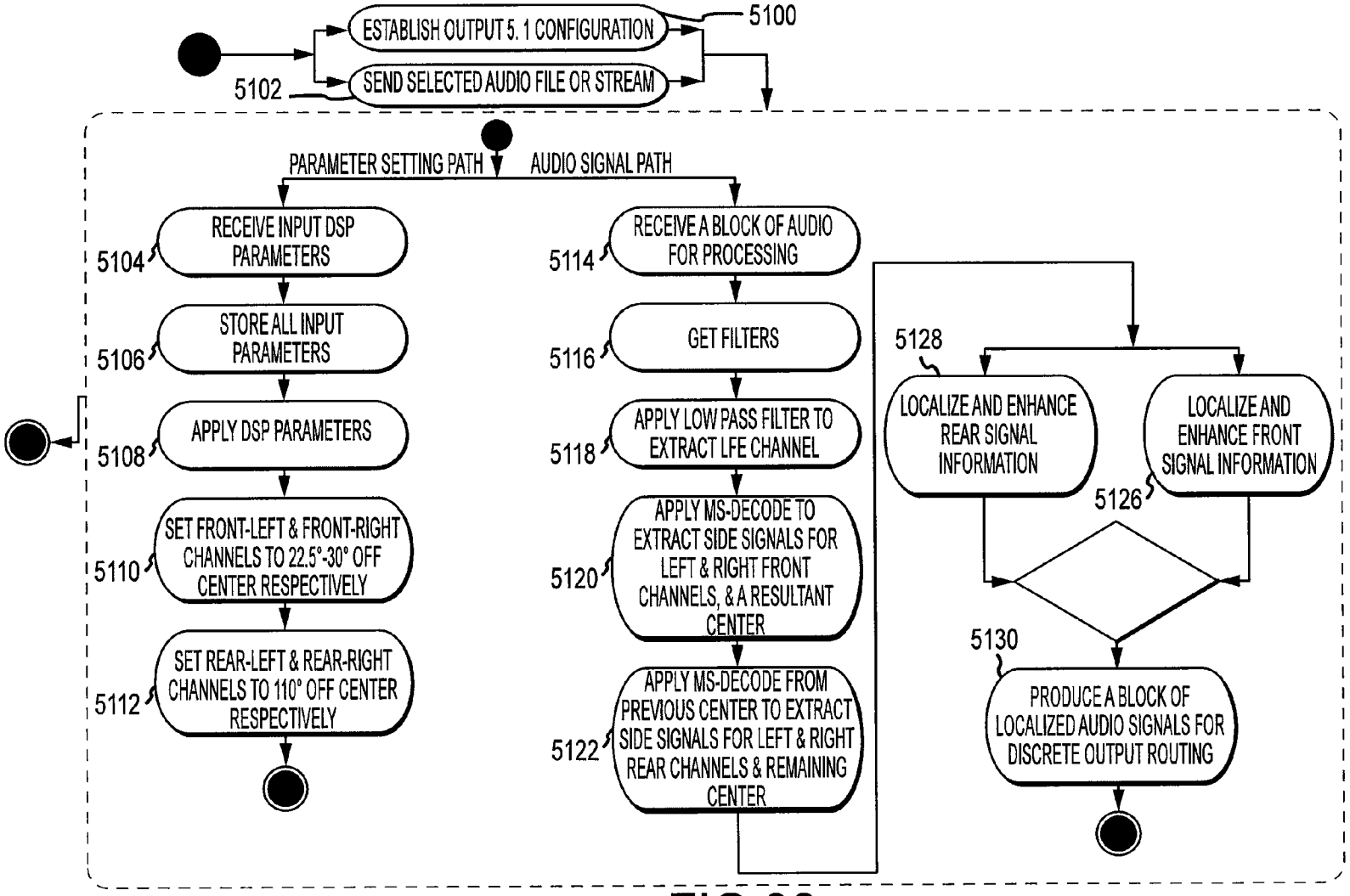
FIG. 38 illustrates a 2-channel input to up-mixed 5.1 multi-channel output process.

Referring now to FIG. 38, one exemplary embodiment of a process for localizing a multi-channel input signal into a greater number of localized output signals is shown. For this embodiment a two (2) channel input source is desirably up-mixed into a 5.1 channel output signal. As provided above, this process also includes two external operations, namely, establishing an output 5.1 configuration (Operation 5100) and sending the desired to be up-mixed two channel input signal to the process (Operation 5102). Also, the process may be implemented in parallel with a "parameter setting path" and an "audio signal path" occurring simultaneously (as desired).

Referring now to the "parameter setting path", this process flow includes the operation of receiving the DSP input parameters, the DSP parameters may specifically contain certain azimuth [0°, 359°], elevation [90°, −90°], and distance cue data [0, 100] (where 0 results in a sound perceived in the center of the head, and 100 is arbitrarily distant) to be applied to the resultant localized signal. The DSP parameters may be based upon the number of output channels desired and their configuration (Operation 5104). These parameters may then be stored (Operation 5106). As per above, such storage may occur in any suitable storage device, local or remote to the DSP and/or other processors used in a given embodiment to accomplish the desired localization effects processing.

It is to be appreciated that in certain embodiments, the pre-storage of parameters may be optional and/or unnecessary. Also, the process includes the specifying and/or setting of various non-localization DSP parameters examples of which may include setting gain levels, equalizer values, reverb and other common audio components (Operation 5108). The process also includes specifying or otherwise designating any desired azimuth values for the front left/right paired speakers (Operation 5110) and for the rear left/right paired speakers (Operation 5112). In one embodiment, these azimuth values may utilize the ITU 775 values (for example, as a default setting). In other embodiments, measured, specified, pre-configured and/or adaptively configured values may be utilized as azimuth values for any given speaker and/or pair of speakers. While FIG. 38 shows these operations as occurring in a specified sequence, it is to be appreciated that such sequence may include some, none or all of these steps. For example, a given audio system may be configured once with respect to the location of front and rear speakers relative to a center channel speaker and such configuration is then loaded, versus specified, for example in operations 5110 and 5112. Likewise, a given set of DSP parameters may also be specified once for a given audio system configuration, as per operation 5104, but non-localized settings, such as gain might vary with operators. Thus, it is to be appreciated that some, none or all of the operations specified along the "parameter setting path" may be utilized with any given implementation of an embodiment described herein.

Referring now to the "audio signal path" portion, as shown in FIG. 38, this process flow is initiated upon an audio system component, such as a DSP, receiving an input audio signal (Operation 5114). As per previously described herein embodiments, such audio signal may be received in the audio or digital format (with suitable signal processing occurring to convert the signal into a format suitable for application of one or more localization effects thereto). The signal may also be received as a frame, packet, block, stream or otherwise. In at least one embodiment, the input signal is segmented into multiple packets (or frames) of a fixed size prior to receipt thereof by the DSP in operation 5114.

Upon receiving the input signal in the desired domain and size (when a size is specified for a given embodiment), the process continues with selecting and obtaining one or more localization filters, such as the above described IIR filters (Operation 5116). Filters may be selected, in at least one embodiment, based upon any azimuth and/or elevation parameters specified for the give audio system configuration. Further, the filters may be selected from those previously stored in operation 5106 in an accessible storage device. In other embodiments, one or more filters may be selected based upon real-time inputs, such as the presence or absence of sound interfering objects, such as other people, background noise or otherwise.

Upon selection of the filters and/or in conjunction with the selection of the filters, the process may further include the operation of applying one or more low pass filters to each channel of the incoming signals to obtain LFE compatible signals (Operation 5118). It is to be appreciated that a given set of incoming signals may contain low frequency signals that are not typically presentable by a given set of only two standard speakers (such as headphones), but, which are presentable by a suitably configured LFE audio component. Similarly, the incoming signal may also be filtered by one or more higher-band pass filters (as compared with the low band pass filters used in operation 5118) for presentation to one or more mid-side decode processes (Operation 5120). The results of such filtering and mid-side decoding desirably results in at least one set of side signals suitable for eventual outputting (after further processing) to the front (left/right) channels.

The mid-side decoded and accordingly filtered signals generated by operation 5120 may also be presented to a second mid-side decode process, so as to generate rear (left/right) output signals and the signals detected by the mid-side decoding being designated for the center channel output signal (Operation 5122). It is to be appreciated that operations 5118, 5120 and 5122 may occur in parallel, when a given DSP has sufficient processing capabilities to analyze an input signal that has been duplicated into three process streams, such parallel processing may be desirable when live streaming of an audio signal is being localized.

With the identification and generation of the front pair and rear pair signals (as per operations 5120 and 5122), the processing may continue with applying one more localization filters to each of the previously generated front and rear signals (Operations 5126 and 5128, respectively). As described above with reference to operation 5106, such previously identified localization filters may be pre-stored. In at least one embodiment, however, such filters may be obtained real-time. Thus, the pre-storage of filters prior to use thereof should be considered optional and not essential to any implementation of the embodiments described herein. The application of the one or more localization filters to the corresponding front and/or rear signals generate a resultant stereo signal to which additional filtering and/or other commonly known audio processing techniques may be applied, as desired for a given implementation, including but not limited to adjusting gain, reverb, and parametric equalizing to adjust for any tone colorization or other undesired effects.

The process concludes with the production of a packets of synchronized blocks of multi-channel output signals which are returned to any external processes for further processing and eventual outputting.

Figure 39:
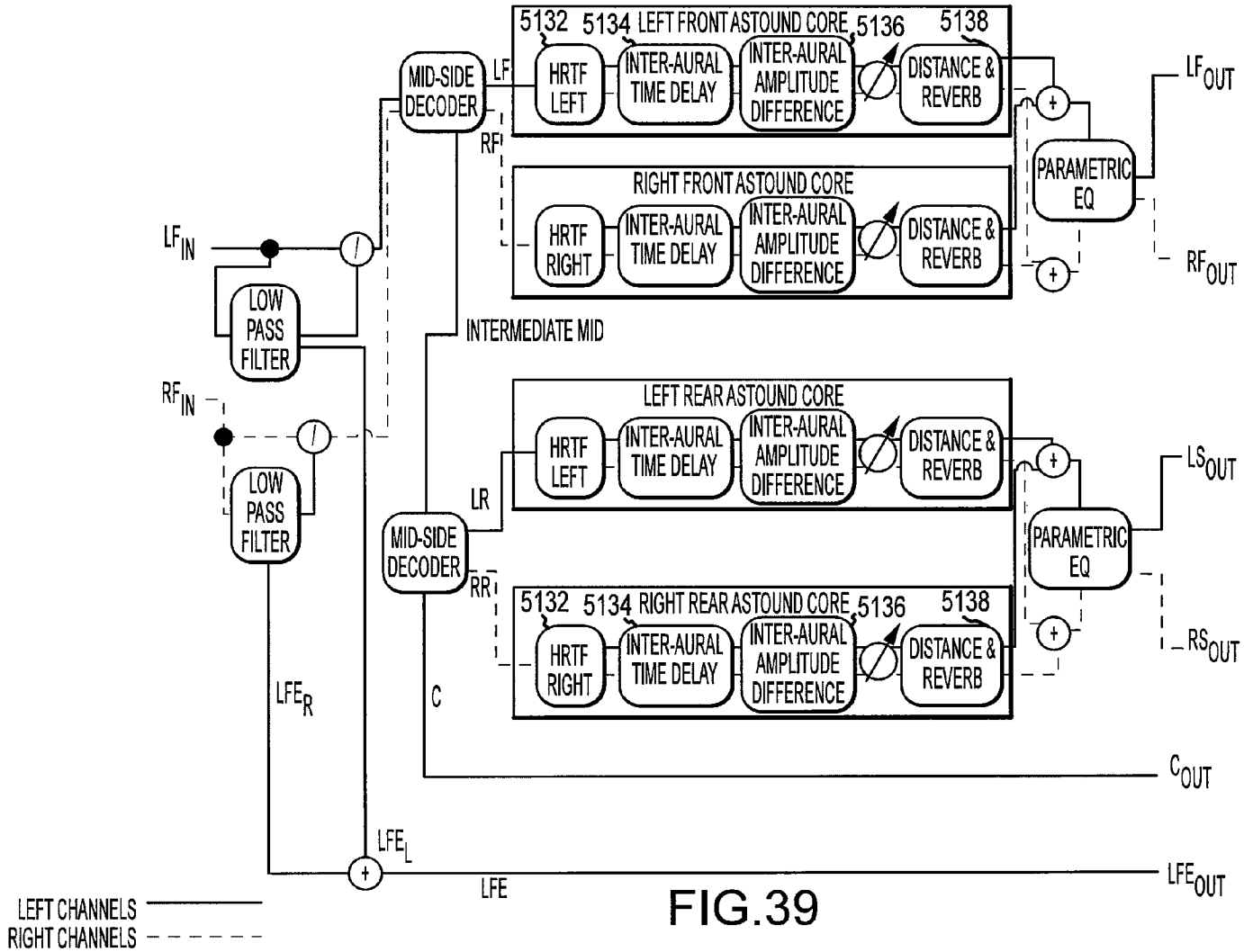
FIG. 39 is a wiring diagram configured for use with the process shown in FIG. 38.

Referring now to FIG. 39, an exemplary wiring diagram of components configured for use with the process described above in FIG. 38 is shown. As is the case for the wiring diagram shown in FIG. 39 and any of the above exemplary wiring diagrams, it is to be appreciated that the functions provided thereby may be implemented in hardware (e.g., as a system on a chip and/or in a dedicated DSP), software (e.g., as one or more operating routines implemented by a general purpose, limited purpose or specialized processor) or as combinations thereof. As shown in FIG. 39 for the embodiment of a two channel input signal being up-mixed to a 5.1 channel output signal, exemplary process cores are shown for the left-front, right-front, left-rear and right-rear channels (the rear channels may alternatively be considered to be "surround" channels). These process cores may include the HRTF 5132, Inter-Aural Time Delay 5134, Inter-Aural Amplitude Difference 5136, and Distance and Reverb 5138 components (in each channel shown) which perform functions as described above with regard to FIG. 23. Collectively, these components perform up-mixing and localization processes, as described above. As shown for this exemplary two channel to 5.1 channel up-mix embodiment, the corresponding two input signals are low pass filtered, mid-side decoded twice and then the localization effects are applied by the corresponding components 5132, 5134, 5136 and 5138. The generation of the center channel is as described above in section G with reference to the %-Center Bypass embodiment.

With regard to any of the processing algorithms described above (e.g., FIGS. 22 through 39 and the description provided in connection therewith), each major processing block is optional (i.e., can be by-passed in real time). In particular, all localization processing blocks, all distance cue processing blocks, all reverb processing blocks, all center-channel processing blocks, and all LFE processing blocks can be by-passed in real-time. This allows the processing algorithms to be further tailored to the application of use. If a given processing block is not needed or desired, or the overall audible effect is enhanced without the need for additional processing, then such extra processing blocks may be by-passed. This feature implies that when a processing block is by-passed, there is a reduction in CPU processing, and any input signal to such blocks are passed through to the output stage unaltered, or with only some amount of gain applied to better balance the unaltered signal with the final output.

9. Applications

Localized stereo (or multi-channel) sound, which provides directional audio cues, can be applied in many different applications to provide the listener with a greater sense of realism. For example, the localized 2 channel stereo sound output may be channeled to a multi-speaker set-up such as 5.1. This may be done by importing the localized stereo file into a mixing tool such as DigiDesign's ProTools to generate a final 5.1 output file. Such a technique would find application in high definition radio, home, auto, commercial receiver systems and portable music systems by providing a realistic perception of multiple sound sources moving in 3D space over time. The output may also be broadcast to TVs, used to enhance DVD sound or used to enhance movie sound.

The operations and methods described in this document may be performed by any appropriately-configured computing device. As one example, the method may be performed by a computer executing software embodying one or more of the methods disclosed herein. Thus, localized sound may be produced from non-localized sound data and stored on a computer-accessible storage medium as one or more data files that, when accessed, permit a computer, or another device in communication therewith, to play back the localized sound. The data may be formatted and stored such that standard audio equipment (receivers, headphones, mixers and the like) may likewise play back the localized sound.

The technology may also be used to enhance the realism and overall experience of virtual reality environments of video games. Virtual projections combined with exercise equipment such as treadmills and stationary bicycles may also be enhanced to provide a more pleasurable workout experience. Simulators such as aircraft, car and boat simulators may be made more realistic by incorporating virtual directional sound.

Stereo sound sources may be made to sound much more expansive, thereby providing a more pleasant listening experience. Such stereo sound sources may include home and commercial stereo receivers as well as portable music players.

The technology may also be incorporated into digital hearing aids so that individuals with partial hearing loss in one ear may experience sound localization from the non-hearing side of the body. Individuals with total loss of hearing in one ear may also have this experience, provided that the hearing loss is not congenital.

The technology may be incorporated into cellular phones, "smart" phones and other wireless communication devices that support multiple, simultaneous (i.e., conference) calls, such that in real-time each caller may be placed in a distinct virtual spatial location. That is, the technology may be applied to voice over IP and plain old telephone service as well as to mobile cellular service.

Additionally, the technology may enable military and civilian navigation systems to provide more accurate directional cues to users. Such enhancement may aid pilots using collision avoidance systems, military pilots engaged in air-to-air combat situations and users of GPS navigation systems by providing better directional audio cues that enable the user to more easily identify the sound location.

As will be recognized by those skilled in the art from the foregoing description of example embodiments of the disclosure, numerous variations of the described embodiments may be made without departing from the spirit and scope of the disclosure. For example, more or fewer HRTF filter sets may be stored, the HRTF may be approximated using other types of impulse response filters, and the filter coefficients may be stored differently (such as entries in a SQL database). Further, while the present disclosure has been described in the context of specific embodiments and processes, such descriptions are by way of example and not limitation. Accordingly, the proper scope of the present disclosure is specified by the following claims and not by the preceding examples.

I claim:

1. A method of producing a localized stereo output audio signal, wherein the localized stereo output audio signal is associated with corresponding input audio channels, comprising:

in a processor, receiving at least one pair of channels of an input audio signal;

mid-side decoding the at least one pair of channels of the input audio signal to generate a phantom center channel and at least one pair of side channels, the mid-side decoding comprising:

generating a mono signal from the at least one pair of channels of the input audio signal, wherein:

the phantom center channel outputs a pair of center channel audio signals, and each of the center channel audio signals comprises a mixture including a first portion X of the mono signal and a second portion 1-X of a corresponding channel of the at least one pair of channels of the input audio signal;

processing the at least one of pair of side channels to produce two or more localized channel output audio signals; and mixing the two or more localized channel output audio signals and the corresponding center channel audio signals from the phantom center channel to generate the localized stereo output audio signal having at least two output channels.

2. The method of claim 1, wherein the input audio signal is received in a sequence of two or more packets, with each packet having a fixed frame length.

3. The method of claim 1, wherein the localized stereo output audio signal includes two or more output channels.

4. The method of claim 1, wherein the operation of processing the at least one pair of side channels to produce the two or more localized channel output audio signals further comprises:

processing each received channel utilizing one or more digital signal processing (DSP) parameters.

5. The method of claim 4, wherein at least one of the one or more DSP parameters utilized is associated with an azimuth and an elevation specified for use with at least one of the two or more localized channel output audio signals.

6. The method of claim 4, wherein the specified azimuth and elevation are utilized by the DSP to identify a filter to apply to the input audio signal.

7. The method of claim 6, wherein the filter is configured as an infinite impulse response (IIR) filter.

8. The method of claim 4, further comprising: processing each of the two or more localized channel output audio signals to adjust at least one of a reverb, a gain and a parametric equalization setting.

9. The method of claim 8, wherein the two or more localized channel output audio signals processed include one or more matched pairs of corresponding output channels selected from the group consisting of front channels, side channels, rear channels, and surround channels.

10. The method of claim 4, further comprising: receiving an identification of the one or more DSP parameters.

11. The method of claim 10, further comprising storing the DSP parameters in a storage medium accessible to a digital signal processor.

12. The method of claim 1, wherein the input audio signal includes N×M channels, wherein N is an integer>1 and M is a non-negative integer.

13. The method of claim 12, further comprising:

receiving an identification of a desired output channel configuration including Q×R channels wherein Q is an integer>1 and R is a non-negative integer; and processing the input audio signals to generate the localized stereo output audio signal to include each of the Q×R channels.

14. The method of claim 13, wherein Q>N.

15. The method of claim 13, wherein Q<=N.

16. The method of claim 13, wherein at least one of M=1 and R=1.

17. The method of claim 12, further comprising:

selecting a bypass configuration for a pair of corresponding input channels selected from corresponding pairs of front channels and corresponding pairs of rear channels of the N×M channels of input audio signals.

18. The method of claim 17, wherein the operation of selecting a bypass configuration for a pair of corresponding input channels selected from corresponding pairs of front channels and corresponding pairs of rear channels of the N×M channels of input audio signals further comprises:

specifying an azimuth and an elevation for each of the selected corresponding pairs of input channels, wherein each azimuth and each elevation are specified based upon a relationship of a virtual audio output component, associated with each of the selected corresponding pairs of input channels, relative to the virtual audio output component configured for outputting the center channel audio signal.

19. The method of claim 18, wherein the corresponding pairs of rear channels are selected and the specified azimuth for each of the selected corresponding pairs of rear input channels equals 110°.

20. The method of claim 19, further comprising:

specifying a second azimuth setting, ranging from 22.5° to 30° , for each of the corresponding pairs of front channels, wherein each specified second azimuth setting is specified based upon a relationship of each of a respective front left virtual audio component and a respective front right virtual audio component, wherein each of the left and right virtual audio components is associated with the corresponding input channel of the N×M channels of input audio signals, relative to the virtual audio output component.

21. The method of claim 17, further comprising:

identifying and enhancing any low frequency signals provided by each of the N×M channels of input audio channels by applying low pass frequency filtering, gain and equalization to each of the N×M channels of input audio signals; and mid-side decoding each of the N×M channels of input audio signals corresponding to a front pair of stereo channels.

22. The method of claim 21, further comprising:

down-mixing the N×M channels of input audio signals into the localized stereo output audio signal.

23. The method of claim 21, further comprising:

up-mixing each of the N×M channels of audio signals into the localized stereo output audio signal.

24. The method of claim 1, further comprising:

selecting, from the input audio signal, one or more input channels;

specifying an elevation and an azimuth for each input channel; and identifying an IIR filter to apply to each selected input channel based upon the elevation and azimuth specified for each input channel.

25. The method of claim 24, further comprising:

processing each of the selected input channels with the IIR filter to generate N localized channels.

26. The method of claim 25, further comprising:

down-mixing the N localized channels into two stereo paired output channels.

27. The method of claim 25, further comprising:

up-mixing each of the N localized channels into two stereo paired output channels.

28. The method of claim 25, further comprising:

applying a low pass frequency filter to each of the N×M channels of input audio signals.

29. The method of claim 25, wherein the N×M channels of input audio signals include at least two side channels, further comprising:

mid-side decoding each side channel to generate a first phantom center channel.

30. The method of claim 29, wherein the N×M channels of input audio signals include at least two front channels, and the method further comprises:

mid-side decoding each of the at least two front channels to generate a second phantom center channel.

31. The method of claim 1, further comprising processing the at least one pair of channels of the input audio signal by using at least one of a low pass filter and a low pass signal enhancer.

32. The method of claim 1, wherein the at least one pair of side channels are selected from the group consisting of front channels, surround channels and rear channels.

33. The method of claim 1, wherein the at least one pair of channels of the input audio signal includes left and right signals in an LtRt signal or signals split from an audio signal.

34. The method of claim 33, further comprising:

isolating a left rear surround channel from the input audio signal by subtracting the right signal from the left signal; and isolating a right rear surround channel from the input audio signal by subtracting the left signal from the right signal.

35. The method of claim 1, wherein each side channel comprises a portion X of the corresponding channel of the at least one pair of channels of the input audio signal subtracted by the mono signal.

* * * * *